US007416177B2

(12) United States Patent
Suzuki et al.

(10) Patent No.: US 7,416,177 B2
(45) Date of Patent: Aug. 26, 2008

(54) SHEET FOLDING APPARATUS, SHEET PROCESSING APPARATUS AND IMAGE FORMING APPARATUS

(75) Inventors: Nobuyoshi Suzuki, Tokyo (JP); Kenji Yamada, Tokyo (JP); Hiromoto Saitoh, Kanagawa (JP); Naohiro Kikkawa, Tokyo (JP); Junichi Iida, Kanagawa (JP); Junichi Tokita, Kanagawa (JP); Shingo Matsushita, Kanagawa (JP); Masahiro Tamura, Tokyo (JP); Shuuya Nagasako, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

(21) Appl. No.: 11/223,052

(22) Filed: Sep. 12, 2005

(65) Prior Publication Data

US 2006/0055100 A1 Mar. 16, 2006

(30) Foreign Application Priority Data

Sep. 16, 2004 (JP) ..... 2004-270326
Oct. 29, 2004 (JP) ..... 2004-315748
Nov. 15, 2004 (JP) ..... 2004-330196

(51) Int. Cl.
*B65H 37/04* (2006.01)

(52) U.S. Cl. ..... 270/37; 270/32; 270/45; 270/58.07

(58) Field of Classification Search ..... 270/32, 270/45, 58.07; 493/424, 427, 434, 442, 478
See application file for complete search history.

(56) References Cited

U.S. PATENT DOCUMENTS 3,719,266 A 3/1973 Korn et al.
5,692,411 A 12/1997 Tamura
5,704,602 A * 1/1998 Taylor et al. ..... 270/1.02
5,709,374 A * 1/1998 Taylor et al. ..... 270/1.02
6,145,825 A 11/2000 Kunihiro et al.
6,199,853 B1 3/2001 Andoh et al.
6,231,045 B1 5/2001 Yamada et al.

(Continued)

FOREIGN PATENT DOCUMENTS

CH 683 179 A5 1/1994

(Continued)

OTHER PUBLICATIONS

U.S. Appl. No. 11/519,039, filed Sep. 12, 2006, Yamada et al.
U.S. Appl. No. 11/682,238, filed Mar. 5, 2007, Iida et al.

*Primary Examiner*—Gene O. Crawford
*Assistant Examiner*—Leslie A Nicholson, III
(74) *Attorney, Agent, or Firm*—Oblon, Spivak, McClelland, Maier & Neustadt, P.C.

(57) ABSTRACT

A sheet processing apparatus for an image forming apparatus is configured so as to be capable of preventing the misalignment of the end edge of sheets to be scooped and transported from an intermediate tray, and reliably preventing the so-called displacement of end edges in the post-processing steps of sheets as a recording medium with an image formed thereon, and thereby preventing the inferior appearance during binding. A sheet folding apparatus enables a user to easily adjust the misalignment of the fold line of sheets that occurs during actual use, in the middle folding processing steps of sheets as a recording medium with an image formed thereon.

21 Claims, 38 Drawing Sheets

U.S. PATENT DOCUMENTS

| | | | |
|---|---|---|---|
| 6,264,191 | B1 | 7/2001 | Suzuki et al. |
| 6,296,247 | B1 | 10/2001 | Tamura et al. |
| 6,322,070 | B2 | 11/2001 | Yamada et al. |
| 6,343,785 | B1 | 2/2002 | Yamada et al. |
| 6,394,448 | B2 | 5/2002 | Suzuki et al. |
| 6,416,052 | B2 | 7/2002 | Yamada et al. |
| 6,494,449 | B2 | 12/2002 | Tamura et al. |
| 6,494,453 | B1 | 12/2002 | Yamada et al. |
| 6,527,269 | B2 | 3/2003 | Yamada et al. |
| 6,549,734 | B2 | 4/2003 | Yamada et al. |
| 6,631,896 | B2 | 10/2003 | Yamada et al. |
| 6,698,744 | B2 | 3/2004 | Yamada et al. |
| 6,783,124 | B2 | 8/2004 | Tamura et al. |
| 6,832,759 | B2 | 12/2004 | Nagasako et al. |
| 6,871,851 | B2 | 3/2005 | Tamura et al. |
| 6,889,974 | B2 | 5/2005 | Tamura et al. |
| 6,905,118 | B2 | 6/2005 | Yamada et al. |
| 6,921,069 | B2 | 7/2005 | Suzuki et al. |
| 2002/0135119 | A1 | 9/2002 | Suzuki et al. |
| 2003/0006543 | A1 | 1/2003 | Tamura et al. |
| 2003/0057641 | A1 | 3/2003 | Yamada et al. |
| 2003/0160376 | A1 | 8/2003 | Yamada et al. |
| 2003/0215275 | A1 | 11/2003 | Tamura et al. |
| 2003/0219295 | A1 | 11/2003 | Saitoh et al. |
| 2003/0234487 | A1 | 12/2003 | Tamura et al. |
| 2004/0051238 | A1 | 3/2004 | Yamada et al. |
| 2004/0104525 | A1 | 6/2004 | Suzuki et al. |
| 2004/0254054 | A1 | 12/2004 | Suzuki et al. |
| 2004/0256783 | A1 | 12/2004 | Iida et al. |
| 2005/0061131 | A1 | 3/2005 | Tamura et al. |
| 2005/0067764 | A1 | 3/2005 | Tamura et al. |
| 2005/0067777 | A1 | 3/2005 | Iida et al. |
| 2005/0082747 | A1 | 4/2005 | Tamura et al. |
| 2006/0055100 | A1 | 3/2006 | Suzuki et al. |

FOREIGN PATENT DOCUMENTS

| | | | |
|---|---|---|---|
| DE | 26 49 093 | | 5/1977 |
| DE | 32 39 799 | A1 | 5/1984 |
| DE | 35 00 826 | A1 | 10/1985 |
| EP | 1 168 091 | A1 | 1/2002 |
| EP | 1 182 161 | A1 | 2/2002 |
| EP | 1 251 095 | A2 | 10/2002 |
| GB | 710 868 | | 6/1954 |
| GB | 2 195 319 | A | 4/1988 |
| JP | 60-93062 | | 5/1985 |
| JP | 8-137151 | | 5/1996 |
| JP | 11-301911 | | 11/1999 |
| JP | 2001-19251 | | 1/2001 |
| JP | 2001-206629 | | 7/2001 |
| JP | 2002-167120 | | 6/2002 |
| JP | 2004-83261 | | 3/2004 |
| WO | WO 00/32505 | | 6/2000 |

* cited by examiner

| FIG. 14A |
| --- |
| FIG. 14B |

SHEET FOLDING APPARATUS, SHEET PROCESSING APPARATUS AND IMAGE FORMING APPARATUS

BACKGROUND OF THE INVENTION

1. Field of the Invention

The present invention relates to a sheet folding apparatus for folding a sheet-shaped recording medium, a sheet processing apparatus having this sheet folding apparatus and which conducts saddle stitch binding and the like, and an image forming apparatus such as a photocopier, printer, facsimile device and printer having such sheet folding apparatus or sheet processing apparatus.

2. Description of the Background Art

In an image forming apparatus such as a photocopier, printer, facsimile device and printer, an image is formed by visualizing a latent image carrier such as a photoconductive drum or photoconductive belt with a development agent such as a toner and transcribing this to a recording medium (as a matter of convenience, this is hereinafter represented as paper or a sheet).

In addition to a case of discharging only a single sheet having an image formed thereon from the image forming apparatus, there are cases where a plurality of sheets having an image formed thereon are bundled and collated in a required number of copies, fastened and bound with a stapler and thereafter discharged from the image forming apparatus, and a sheet post-processing apparatus or finisher is used as such a device.

With this kind of sheet post-processing apparatus, the sheets to be discharged from the image forming apparatus are sequentially received in an inclined intermediate tray, and the end edge of sheets in the width direction is aligned with a jogger fence or the like and the end edge of recording sheets that slid off to the lower end side of the intermediate tray is aligned by being pressed against a stopper or the like, respectively. Then, the end edge of sheets is subject to binding processing with a stapler, and the bundled sheet group is discharged to the discharge tray.

Conventionally, a configuration of providing a pawl for scooping the lower end of sheets to the transport belt for transporting the sheets housed in the intermediate tray, scooping the sheets in conjunction with the movement of the transport belt and transporting such sheets to the position of a discharge roller in order to discharge the bundled sheet group to the discharge tray after performing such binding processing is proposed in the gazette of Japanese Patent Laid-Open Publication No. H8-137151.

Meanwhile, as a method of sheet post-processing, in addition to the method of performing binding processing with a stapler to the end edge of sheets as described above, for instance, a saddle stitching method where the end edge is not bound and the center portion of the discharged sheets in the discharging direction is bound, and a middle folding method of folding the sheets at the saddle stitched position are also proposed in the gazettes of Japanese Patent Laid-Open Publication No. 2001-19251, Japanese Patent Laid-Open Publication No. 2001-206629 and Japanese Patent Laid-Open Publication No. 2002-167120.

Incidentally, in the configuration of the sheet post-processing apparatus which binds the end edge of sheets, a bundle pressing means for preventing the bulging of end edges; that is, a transport auxiliary rotative member having a wing member capable of pressing the surface of sheets is provided to a position facing the stapler; in other words, at a position where the end edges of sheets that slid off toward the stopper collide, in order to prevent the defective transport of sheets when the end edges of the bound sheets float.

Nevertheless, when re-transporting the sheets subject to binding processing, although the end edge of sheets in the width direction will be aligned with a jogger fence, since the end edge to be scooped with the pawl member; that is, the end edge on the back side of the transport direction of the sheets (hereinafter simply referred to as "back side end edge") will merely be in a state of being mounted on the inner bottom face of the pawl member, the back side end edge of sheets will be disarranged depending on the number of sheets in relation to the size of the housing space in the inner bottom face. In particular, when binding via saddle stitching or middle folding, if the back side end edge of sheets becomes disarranged, misalignment of the end edge of the sheet bundle after the binding will become noticeable, and the finish will result in an inferior appearance.

Meanwhile, with a sheet processing apparatus having this kind of saddle stitching or middle folding function, the half folding of the sheet bundle is conducted by extruding with a folding plate the bound portion of the sheet bundle in which the center portion thereof was bound, and making a fold line by passing therethrough a pair of folding rollers provided in the moving direction thereof. When binding with this kind of saddle stitching, it is important that the folding position by the folding roller and the binding position coincide accurately, and that the folding position is not misaligned obliquely, which are also the strong demand of users.

Thus, in order to meet such demand, for instance, Japanese Patent Laid-Open Publication No. 2001-206629 discloses a configuration of aligning the sheet bundle, thereafter performing binding processing to 2 locations in the width direction thereof, and further hooking the leading edge of the folding plate to the binding needle and pressing it into a folding roller nip. Further, Japanese Patent Laid-Open Publication No. 2002-167120 discloses a configuration of providing, in order to determine the folding position, a stopper in the transport direction, and providing an alignment mechanism capable of moving in the width direction.

Nevertheless, with the configuration of these background arts, since a position in which the fold line will not become misaligned obliquely is set theoretically, there are cases where the fold line will become misaligned during the actual operation. This occurs because sheets that are cut into standard sizes are not a perfect rectangle.

SUMMARY OF THE INVENTION

The first object of the present invention is to provide a sheet processing apparatus and an image forming apparatus configured so as to be capable of preventing the misalignment of the end edge of sheets to be scooped and transported from an intermediate tray in the processing steps of sheet as a recording medium with an image formed thereon, and reliably preventing the so-called displacement of end edges and preventing the inferior appearance during binding.

The second object of the present invention is to provide a sheet folding apparatus, sheet processing apparatus and image forming apparatus which enable a user to easily adjust the misalignment of the fold line of sheets that occurs during actual use in the middle folding processing steps of sheets as a recording medium with an image formed thereon.

A sheet processing apparatus of the present invention comprises a sheet housing unit capable of housing sheets that slid off, and a transport device provided so as to be capable of passing through the sheet housing unit and, when passing therethrough, transporting sheets from the sheet housing unit to another position by scooping a plurality of sheets positioned in the sheet housing unit in a state where the end edge of the sheets is mounted thereon. The transport device transports the sheets while maintaining the mounted sheet group in a state of being bundled on one side in the thickness direction thereof.

An image forming apparatus of the present invention employs a sheet processing apparatus. The sheet processing apparatus comprises a sheet housing unit capable of housing sheets that slid off and a transport device provided so as to be capable of passing through the sheet housing unit and, when passing therethrough, transporting sheets from the sheet housing unit to another position by scooping a plurality of sheets positioned in the sheet housing unit in a state where the end edge of the sheets is mounted thereon. The transport device transports the sheets while maintaining the mounted sheet group in a state of being bundled on one side in the thickness direction thereof.

A sheet folding apparatus of the present invention comprises a sheet transport device for transporting sheets or a sheet bundle along a sheet transport path, a support device that is movable in the transport direction of the sheets or sheet bundle, and for supporting the sheets or sheet bundle in the sheet transport path, a folding plate disposed so as to be capable of moving forward or backward in a direction substantially perpendicular to said transport path, a pair of folding rollers disposed in the forward direction of the folding plate, and for folding the sheets or sheet bundle pressed into a nip with the folding plate and an angle adjustment device for adjusting the relative angle of an arbitrary end face of the sheets or sheet bundle, and the fold line.

A sheet processing apparatus of the present invention comprises a sheet folding apparatus. The sheet folding apparatus comprises a sheet transport device for transporting sheets or a sheet bundle along a sheet transport path, a support device that is movable in the transport direction of the sheets or sheet bundle, and for supporting said sheets or sheet bundle in the sheet transport path, a folding plate disposed so as to be capable of moving forward or backward in a direction substantially perpendicular to said transport path, a pair of folding rollers disposed in the forward direction of the holding plate, and for folding the sheets or sheet bundle pressed into a nip with the folding plate and an angle adjustment device for adjusting the relative angle of an arbitrary end face of the sheets or sheet bundle and the fold line.

An image forming apparatus of the present invention comprises a sheet folding apparatus. The sheet folding apparatus comprises a sheet transport device for transporting sheets or a sheet bundle along a sheet transport path, a support device that is movable in the transport direction of the sheets or sheet bundle, and for supporting the sheets or sheet bundle in the sheet transport path, a folding plate disposed so as to be capable of moving forward or backward in a direction substantially perpendicular to the transport path, a pair of folding rollers disposed in the forward direction of the folding plate, and for folding the sheets or sheet bundle pressed into a nip with the folding plate and an angle adjustment device for adjusting the relative angle of an arbitrary end face of the sheets or sheet bundle and the fold line.

An image forming apparatus of the present invention comprises a sheet processing apparatus integrally or separately which has a sheet folding apparatus. The sheet folding apparatus comprises a sheet transport device for transporting sheets or a sheet bundle along a sheet transport path, a support device that is movable in the transport direction of the sheets or sheet bundle, and for supporting said sheets or sheet bundle in the sheet transport path, a folding plate disposed so as to be capable of moving forward or backward in a direction substantially perpendicular to the transport path, a pair of folding rollers disposed in the forward direction of the folding plate, and for folding the sheets or sheet bundle pressed into a nip with the folding plate and an angle adjustment device for adjusting the relative angle of an arbitrary end face of the sheets or sheet bundle and the fold line.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

The respective embodiments of the present invention are now explained in detail with reference to the drawings.

FIRST EMBODIMENT

The main purpose of the first embodiment is to achieve the first object of the present invention described above.

As indicated above, with a conventional sheet processing apparatus, when binding via saddle stitching or middle folding, if the back side end edge of sheets becomes disarranged, there is a problem in that the misalignment of the end edge of the bound sheet bundle will become noticeable, and the finish will result in an inferior appearance. This is explained with reference to FIG. 1A, FIG. 1B and FIG. 2.

Figure 1B:
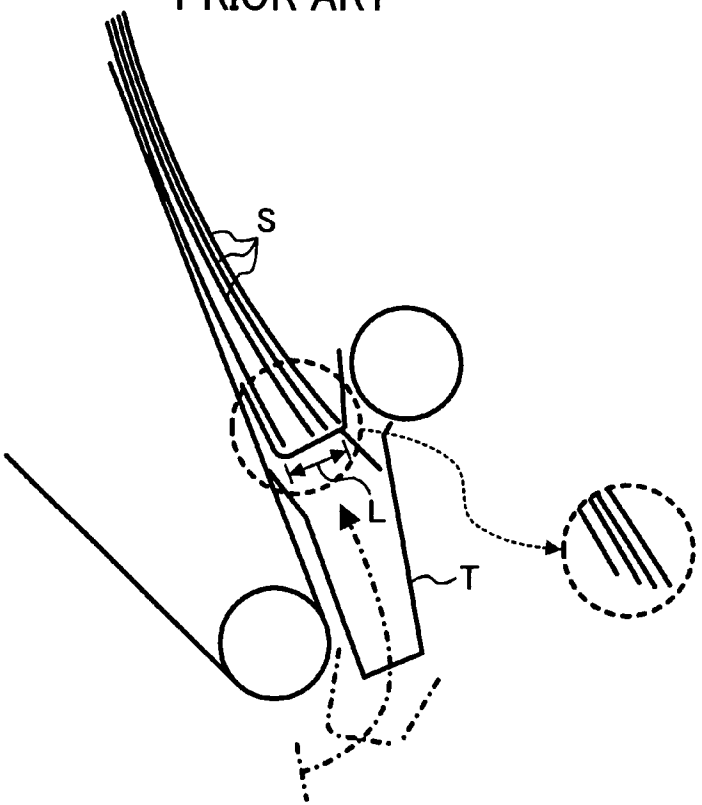
FIG. 1B PRIOR ART
FIG. 1A and FIG. 1B are diagrams for explaining the problems in a conventional sheet processing apparatus.
Figure 1A:
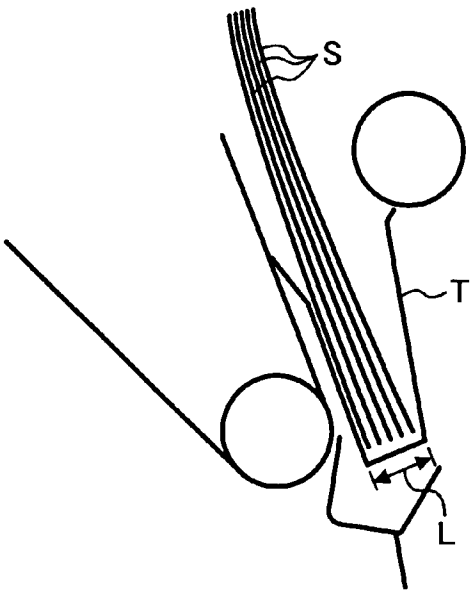
FIG. 1A PRIOR ART
Figure 2:
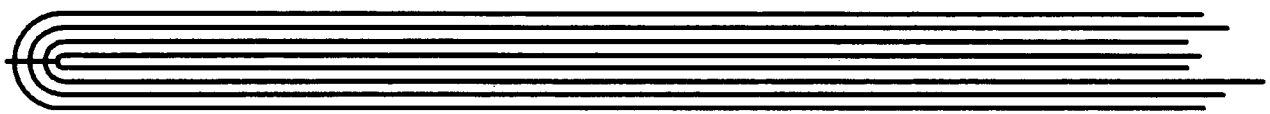
FIG. 2 PRIOR ART
FIG. 2 is a diagram showing a case where such problem is presented.

As shown in FIG. 1A, with a conventional sheet processing apparatus, when the end edge of sheets S that slid off and are housed in a pawl member T is not subject to binding processing, the end edge will rise pursuant to the movement of the pawl member T. Here, when the thickness based on the number of sheets is close to the space L of the inner bottom face of the pawl member T, movement of the end edge will be restricted by the wall surfaces at both sides of the inner bottom face of the pawl member T, and, therefore, disarrangement will not occur easily. Nevertheless, when the number of recording sheets S causes a large gap in the space L, the end edge will be able to move relatively freely, and disarrangement will thereby occur easily. In particular, sheets after being subject to photographic fixing often curl due to the difference in the contained moisture content of the front and back faces depending on the heated state, and, in such a case, the end edge will warp easily and become misaligned as illustrated in FIG. 1B. Thus, when this kind of conventional sheet processing apparatus is used for binding via saddle stitching or middle folding, the misaligned state of the end edge of the bound sheets will become noticeable as depicted in FIG. 2.

The present embodiment which overcomes the problems encountered in such conventional sheet processing apparatuses is now explained.

Figure 3:
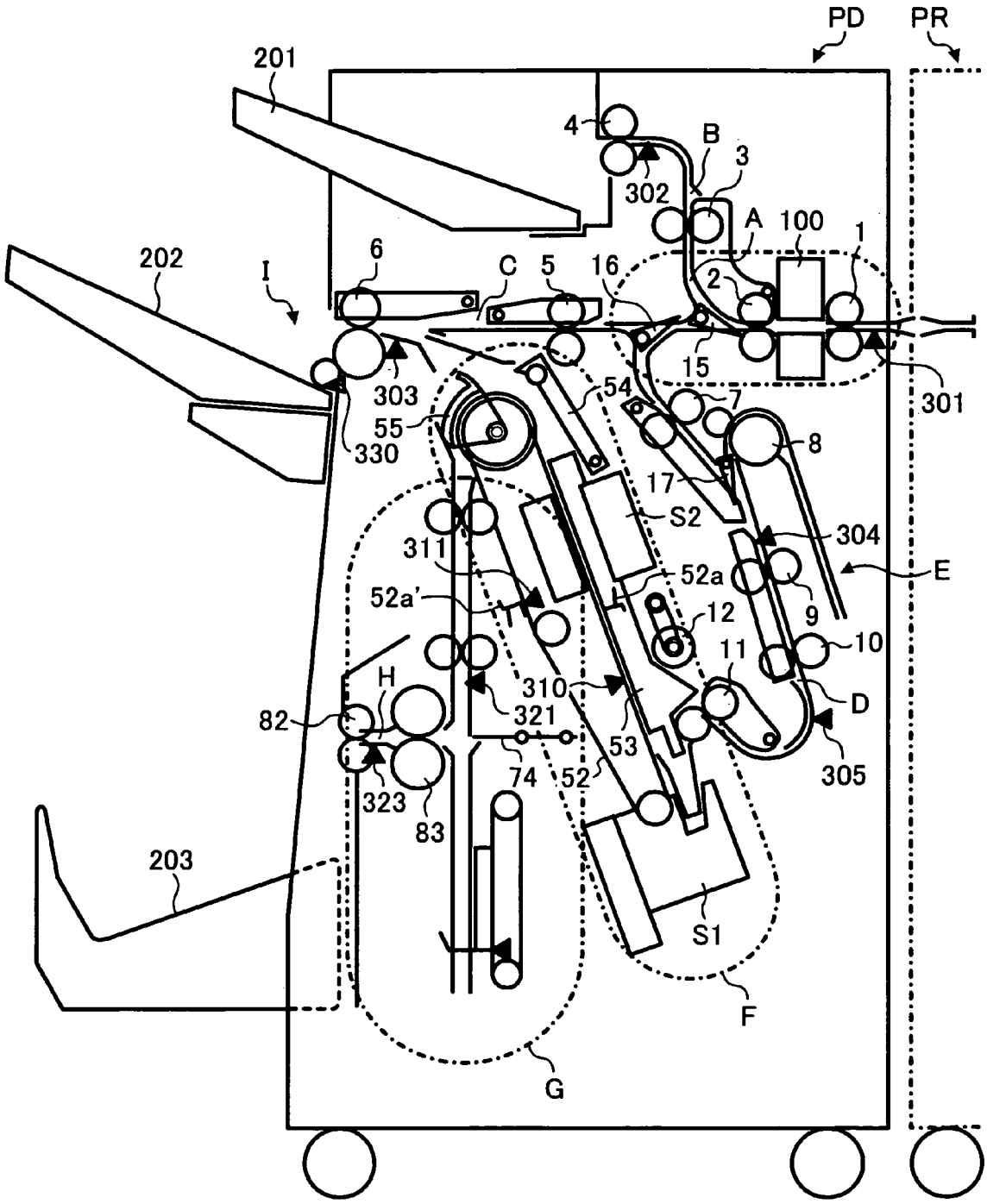
FIG. 3 is a diagram showing the schematic configuration of a sheet processing apparatus according to the first embodiment of the present invention.

FIG. 3 shows the schematic configuration of the sheet post-processing apparatus or finisher to be used as the sheet processing apparatus according to the present embodiment. The sheet post-processing apparatus of this embodiment is used by being connected to the discharge unit of sheets in an image forming processing apparatus such as a photocopier or printer, but it may also be used by being built in the image forming apparatus.

In FIG. 3, the sheet post-processing device PD is connected by being mounted on the side portion of the image forming apparatus PR, and recording paper such as sheets discharged from the image forming apparatus are guided to the sheet post-processing apparatus PD.

The sheets are configured to pass through a transport path A having a post-processing means (punch unit 100 as a perforation means in the present embodiment) for performing post-processing to a single sheet, and be sorted respectively with a path selector 15 and path selector 16 in relation to a transport path B for guiding the sheets to an upper tray 201, a transport path C for guiding the sheets to a shift tray 202, and a transport path D for guiding the sheets to a processing tray F (hereinafter sometimes referred to as a staple processing tray) for performing alignment and stapling.

The sheets that were guided to the staple processing tray F via the transport paths A and D and subject to alignment and stapling at the staple processing tray are configured to be sorted to the transport path C for guiding the sheets to the shift tray 202, or to the processing tray G (hereinafter sometimes referred to as a middle folding processing tray) for folding the sheets via a branching guide plate 54 and movable guide 55, which are deflection means, and the sheets subject to folding at the middle folding processing tray G pass through a transport path H and are guided to the lower tray 203.

Further, a path selector 17 is disposed in the transport path D and retained in the state illustrated in FIG. 3 with a low force spring not shown. After the back end of a sheet passes therethrough, such back end of the sheet is guided to a housing unit E and accumulated therein by reversing at least the transport roller 9 among the transport rollers 9, 10 and staple discharging roller 11 so as to be superimposed with the subsequent sheet and transported. By repeating this operation, two or more sheets may be superimposed and transported.

Sequentially disposed to the transport path A common at the upstream of transport path B, transport path C and transport path D, respectively, are an inlet sensor 301 for detecting the sheets to be received from the image forming apparatus, an inlet roller 1 at the downstream thereof, a punch unit 100, a punch or hopper (not shown) positioned on the lower side of the punch unit 100, a transport roller 2, a path selector 15 and a path selector 16.

The path selector 15 and path selector 16 are retaining in the state illustrated in FIG. 3 with a spring not shown, and, by turning on a solenoid not shown, the path selector 15 turns upward (in the counterclockwise direction) and the path selector 16 turns downward (in the clockwise direction) respectively, so as to sort the sheets to the transport path B, transport path C and transport path D.

The path selector 15 will be rotated upward when guiding the sheets to the transport path B by the solenoid being turned OFF in the state of FIG. 3, and the path selector 16 will be rotated downward when guiding the sheets to the transport path C by the solenoid being turned ON from the state of FIG. 3, respectively. When guiding the sheets to the transport path D, the path selector 16 will be rotated upward by switching OFF the solenoid in the state of FIG. 3, and the path selector 15 will be rotated upward by switching OFF the solenoid from the state of FIG. 3, respectively. Incidentally, reference numerals 3, 4, 5, 7 and 8 are transport rollers for transporting the respective sheets.

The sheet post-processing apparatus configured as described above is able to perform various processes to the sheets, such as punching (punch unit 100), sheet alignment+ end binding (jogger fence 53, end face binding stapler S1), sheet alignment+saddle stitching (jogger fence 53, saddle stitching stapler S2), sorting of sheets (shift tray 202), middle folding (folding plate 74, folding rollers 81, 82), and so on.

In the present embodiment, the image forming apparatus PR is an image forming apparatus that employs a so-called electrophotographic process of forming a latent image on a photoconductive drum surface by performing optical writing to an image forming medium such as a photoconductive drum based on the input image data, subjecting the formed latent image to toner development, transcribing and fixing this to a recording medium such as a sheet, and discharging the sheet. Since an image forming apparatus employing the electrophotographic process itself is well known, the explanation and illustration of the detailed configuration thereof are omitted. Incidentally, although an image forming apparatus employing the electrophotographic process is exemplified is this embodiment, in addition thereto, a system using a publicly known image forming apparatus and a printing machine (printer) such as an inkjet or printing press may also be used as a matter of course.

A shift tray discharge unit 1 positioned at the most downstream portion of the sheet post-processing apparatus PD is configured from a shift discharge roller 6, a return roller 13, a paper detection sensor 330, a shift tray 202, a shift mechanism (not shown) and a shift tray elevation mechanism (not shown).

In FIG. 3, the return roller 13 represents a sponge roller for coming into contact with the sheets discharged from the shift discharge roller 6 and pressing the back end of the sheets to the end fence positioned at the base end of the shift tray 202. This return roller 13 rotates based on the rotating effort of the shift discharge roller 6. A tray rise limit switch (not shown) described later is provided near the return roller 13, and when the shift tray 202 rises and the return roller 13 is thereby pressed upward, it is turned on and the tray elevation motor (not shown) will stop. This will thereby prevent the overrun of the shift tray 202. Further, as will be explained with reference to FIG. 4, a paper detection sensor 333 as a paper position detection means for detecting the paper position of the sheet or sheet bundle discharged on the shift tray 202 is provided near the return roller 13.

Figure 4:
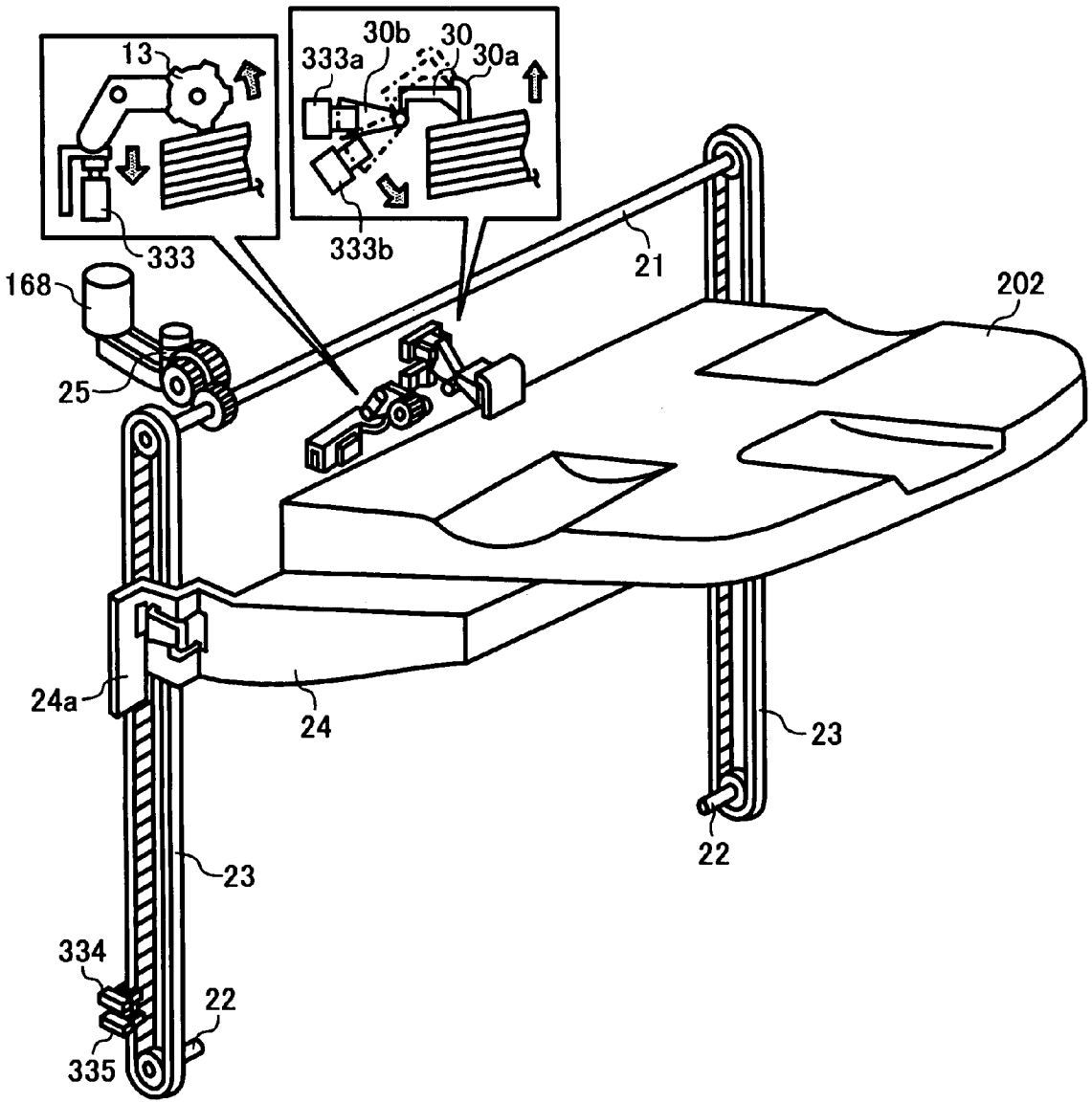
FIG. 4 is a diagram for explaining the configuration and operation of the elevation mechanism of a shift tray to be used in the sheet processing apparatus.

The paper detection sensor 333, as shown in FIG. 4, has a paper detection sensor 333*a* for detecting the paper surface of sheets subject to staple processing, and a paper detection sensor 333*b* for detecting the paper surface of sheets that are discharged without being subject to staple processing.

The paper detection sensors 333*a*, 333*b* use an optical sensor capable of detecting changes in the transmittance based on a detection lever 30 provided oscillatably, and one of the oscillating ends in the detection lever 30 is a contact unit 30*a* for contacting the upper face of the sheets loaded on the shift tray 202, and the other oscillating end is a light blocking unit for blocking the optical path of the respective paper detection sensors 333*a*, 333*b*. The paper detection sensor 333*a* positioned upward in FIG. 4 is used for controlling the discharge of sheets subject to staple processing, and the paper detection sensor 333*b* position downward in FIG. 4 is used for controlling the discharge of sheets in anon-stapled state. In other words, when the shift tray 202 rises and the contact unit 30*a* of the detection lever 30 rises, the paper detection sensor 333*a* is turned on, and when the detection lever 30 is further rotated, the paper detection sensor 333*a* is turned off and the paper detection sensor 333*b* is turned on. Thereby, when the height of the paper surface of sheets; that is, when the height of the load reaches a prescribed height, the paper detection sensors 333*a*, 333*b* are used to elevate the shift tray 202 a prescribed amount in order to maintain the height of the paper surface of the shift tray 202 roughly constant.

Reference numeral 13 in FIG. 4 represents a return roller, and the return roller 13, as described above, is a member for contacting the back end face of sheets in the discharging direction and pressing the back end thereof against an end fence using the wall surface of the sheet post-processing apparatus PD or an end fence not shown. As a result, the back end of the discharged sheets can be aligned by the actuator being oscillated by the solenoid 333 each time a sheet is discharged.

The shift tray 202 is elevated with the elevation mechanism shown in FIG. 4. Incidentally, the discharge roller 6 illustrated in FIG. 3 is omitted in FIG. 4.

In FIG. 4, the elevation mechanism of the shift tray 202 has a belt 23 placed around pulleys coaxially supported respectively by both ends in the axial direction of a drive axis 21 coaxially supported with a gear for engaging with a worm gear 25 to be driven with a motor 168 capable of normal and reverse rotation, and by a driven shaft 22 provided to a position facing the drive axis 21 in the elevation direction of the shift tray 202, which supports the shift belt 202 in a cantilevered state by a shift tray support member 24 being integrally formed with a part of the belt 23. With the elevation mechanism of the shift tray 202, since the worm gear 25 is interposed in the drive transport pathway in relation to the drive axis 21, unnecessary lowering on the shift tray 202 side can be prevented, and incidents of sheets falling off can be prevented.

The shift tray support member 24 is provided with a light blocking unit 24*a* on the side thereof, and the light blocking unit 24*a* is capable of being equal to a full space detection sensor 334 and a minimum limit sensor 335 formed from a photosensor disposed facing the extended portion of the belt 23. The full space detection sensor 334 is a sensor for detecting the full state of sheets loaded on the shift tray 202; that is, that the load has reached the limit, and the minimum limit sensor 335 is a sensor for detecting the minimum limit position of the shift tray 202. When these sensors are turned on, the procedures for suspending the discharging of sheets and suspending the lowering operation of the shift tray 202 will be adopted.

The shift tray 202 is provided with a mechanism capable of sorting the respective sheet groups in the horizontal direction upon distributing each sheet group.

Figure 5:
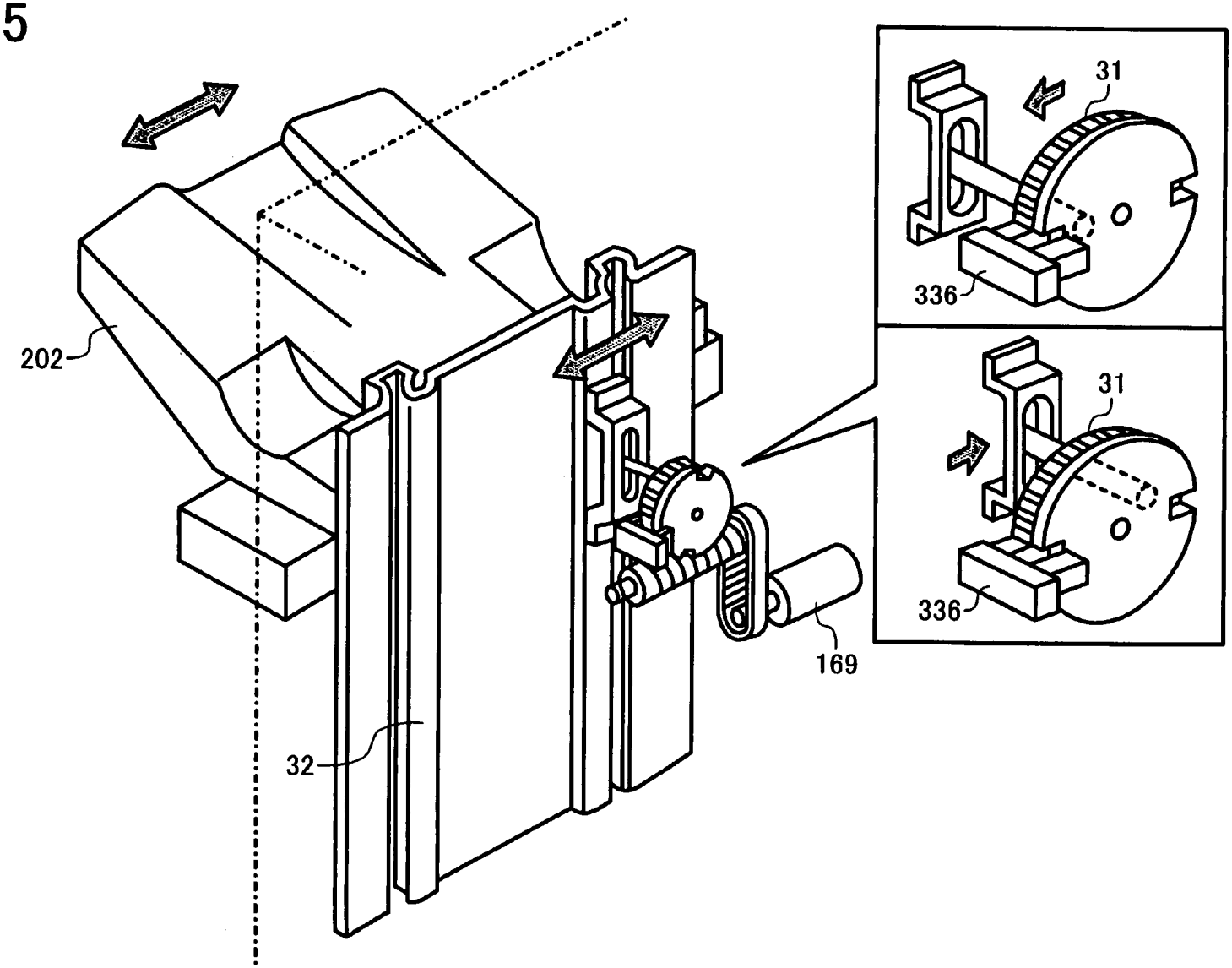
FIG. 5 is a diagram for explaining the configuration and operation of the oscillating mechanism of the shift tray.

FIG. 5 shows the oscillating mechanism upon sorting the shift tray 202, and the oscillating mechanism shown in FIG. 5 has a shift cam 31 having a shift motor 169 as the drive force thereof. With the shift cam 31, a pin provided in the eccentric position is inserted through a slotted hole of an engagement member 32*a* provided to the end fence 32 on the shift tray 202 side. Thereby, when oscillating the shift tray 202, by rotating the shift cam 31, the end fence 32 will be able to reciprocate in a direction that is perpendicular to the discharging direction of the sheets; that is, the front and back sides in the width direction of the sheets, and then stop. And, by receiving the sheets at the respective reciprocating positions, the discharge position of the sheet group to be loaded on the shift tray 202 can be changed. The rotating and stopping timing of the shift motor 169 is set by the oscillating position of the shift tray 202 being detected with the position detection sensor formed from a photosensor disposed in correspondence with the cutouts distributed and formed on the peripheral face of the shift cam 31.

Figure 6:
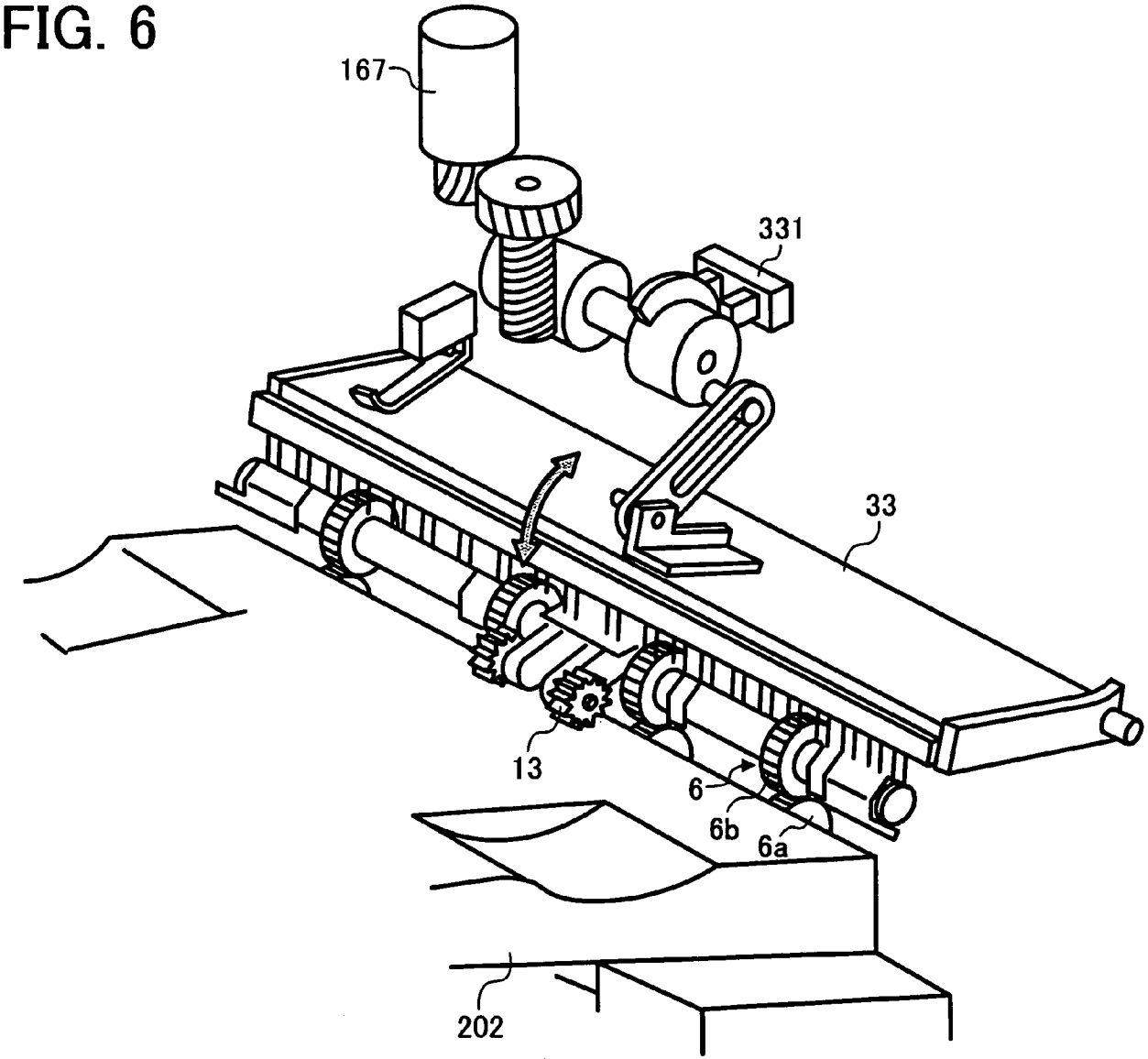
FIG. 6 is a diagram for explaining the configuration and operation of the discharge mechanism of sheets in relation to the shift tray.

A shift discharge roller 6 provided for discharging sheets to the shift tray 202, as shown in FIG. 6, has a drive roller 6*a* and a driven roller 6*b* facing each other across the transport path of sheets, and, among the above, the driven roller 6*b* is disposed at the upstream side in the discharging direction of sheets and supported rotatably with the free end of a switching guide plate 33 capable of opening and closing upward and downward. The driven roller 6*b* is driven and rotated by contacting the drive roller 6*a* based on empty weight or with the bias force of a means not shown, and will discharge the sheets in a wedged state.

When sheets subject to binding processing are to be discharged, the switching guide plate 33 is rotated upward and returned in a prescribed timing, and this timing is determined based on the detection signal of the shift outlet sensor 303 (c.f. FIG. 3). And the stopping position upon rotating upward is determined based on the detection signal of a switching position sensor 331, and is set by the drive control of a switching motor 167, which is a switching drive force of the switching guide plate 33. Incidentally, the switching motor 167 is subject to drive control based on the ON/OFF of the limit switch 33.

Figure 7:
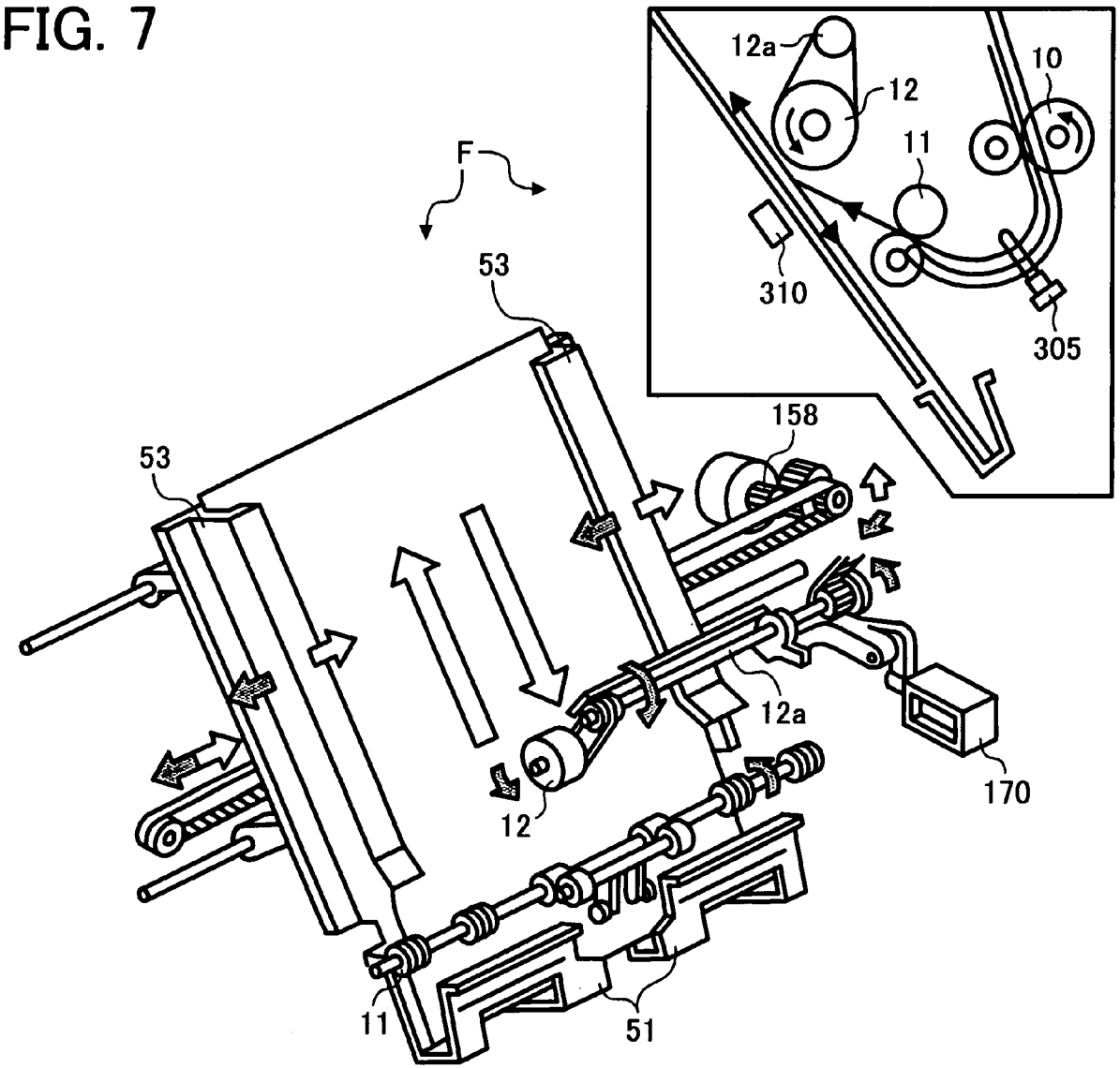
FIG. 7 is a diagram for explaining the configuration and operation of the housing mechanism of sheets to be used in the sheet processing apparatus.

Meanwhile, the staple processing tray F which performs binding processing has the configuration illustrated in FIG. 7.

In FIG. 7, the sheets guided to the staple processing tray F with the staple discharge roller 11 are sequentially loaded. Here, each sheet is aligned in the lengthwise direction (sheet transport direction) with a knock roller 12, and aligned in the longitudinal direction (sheet width direction orthogonal to the sheet transport direction) with the jogger fence 53. The jogger face 53 is driven with a jogger motor 158, which is capable of normal and reverse rotation, via a timing belt, and reciprocates in the sheet width direction.

The knock roller 12 shown in FIG. 7 is subject to a pendulum motion with a knock SOL 107 around a support 12*a*, intermittently works on the sheets delivered to the staple processing tray F, and presses the sheets against the back end face 51 configuring the sheet housing unit. Incidentally, the knock roller 12 rotates in the counterclockwise direction.

Figures 14, 14A:
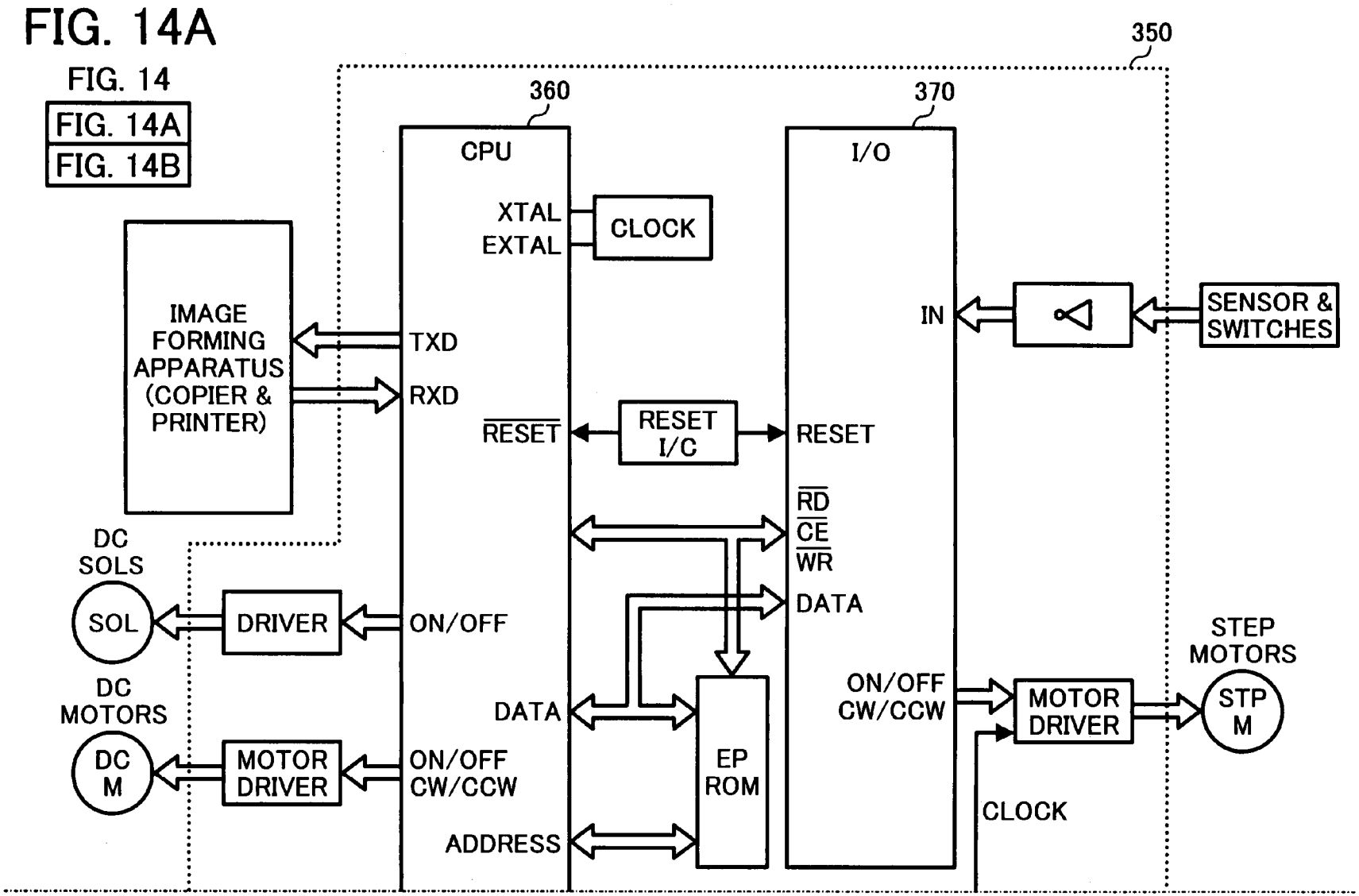
FIG. 14 is a bock diagram for explaining the configuration of the control unit to be used in the sheet processing apparatus.
Figure 14B:
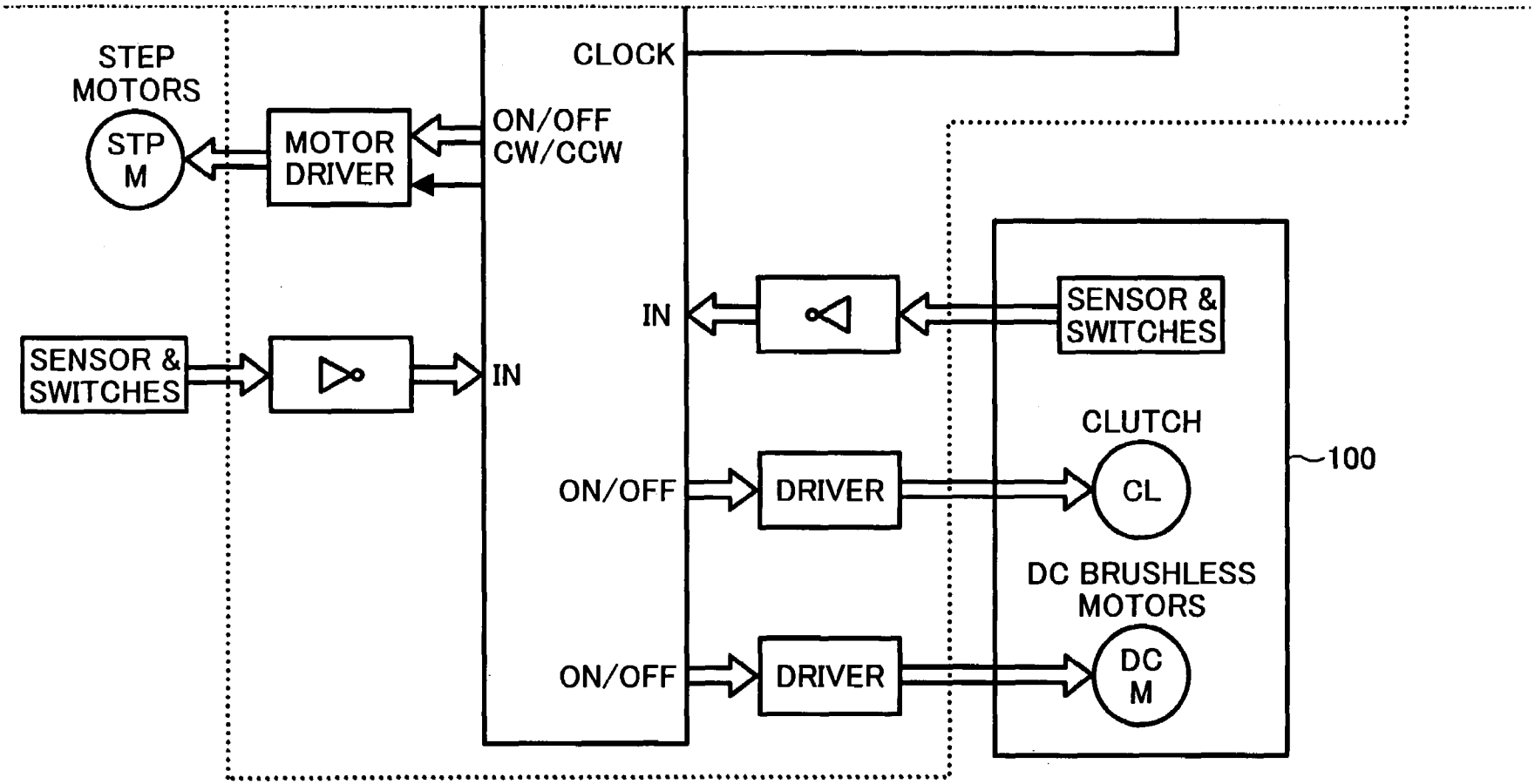

In the staple processing tray F, the end face binding stapler S1 is driven and binding processing is performed based on the staple signal from a control means 350 shown in FIG. 14 during the end of a job; that is, during the period from the final sheet of the sheet bundle to the first sheet of the subsequent sheet bundle. The sheet bundle subject to binding processing is immediately sent to the shift discharge roller 6 with the ejection belt 52 corresponding to the transport means of sheets having an ejection pawl 52*a* comprising a sheet loading face, and discharged to the shift tray 202 set in a receiving position.

Figure 8:
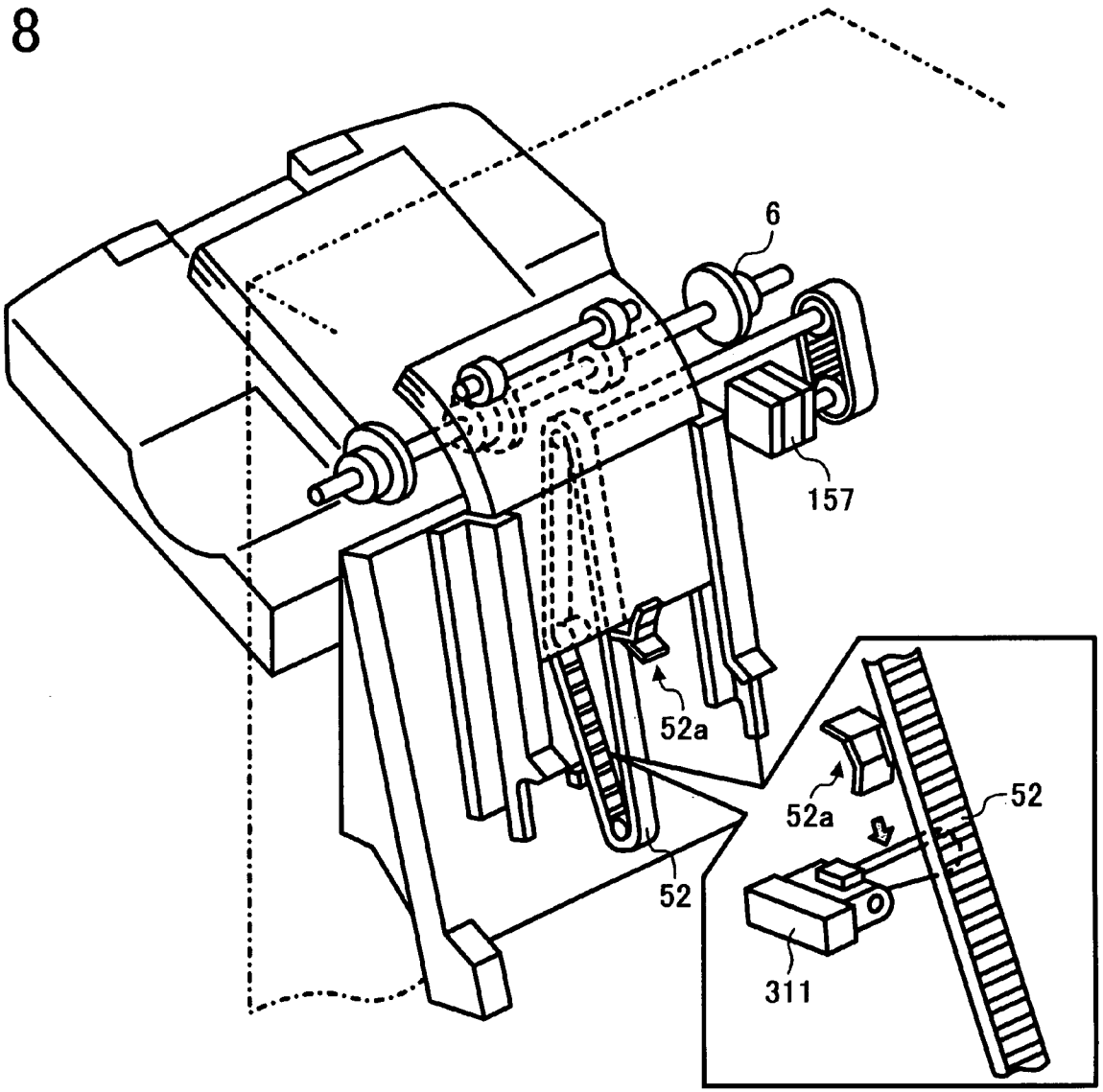
FIG. 8 is a diagram for explaining the configuration and operation of the transport mechanism of sheets in the housing mechanism of sheets.

As shown in FIG. 8, with the ejection pawl 52*a*, the home position thereof is detected with an ejection belt home position (HP) sensor 311, and this ejection belt HP sensor 311 turns ON/OFF the ejection pawl 52*a* provided to the ejection belt 52. Two ejection pawls 52*a* are disposed at opposite positions at the outer periphery of the ejection belt 52, and alternately move and transport the sheet bundles housed in the staple processing tray F. Further, as necessary, the ejection belt 52 may be rotated in reverse in order to align the leading edge in the transport direction of the sheet bundle housed in the staple processing tray F at the back face of the ejection pawl (represented with reference numeral 52*a*' in FIG. 3 as a matter of convenience) facing the ejection pawl 52*a* standing by so as to move the sheet bundle subsequently.

Figure 9:
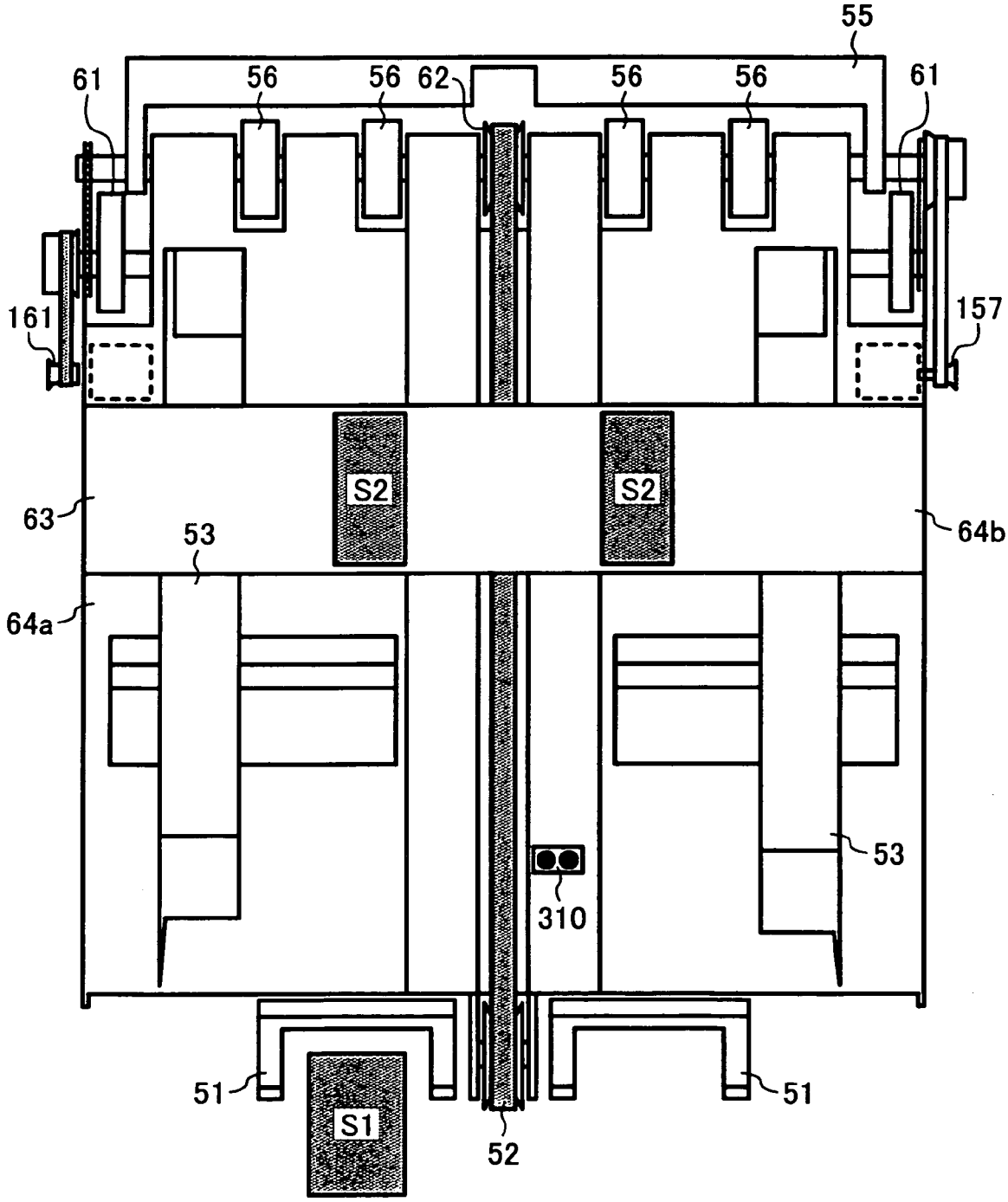
FIG. 9 is a plan view showing the configuration of the transport mechanism of sheets.

Further, as shown in FIG. 9, the ejection belt 52 and the drive pulley 62 thereof are disposed around the alignment in the sheet width direction at the drive axis of the ejection belt 52 driven with an ejection motor 157 (c.f. FIG. 8), an ejection roller 56 is disposed and fixed symmetrically thereto, and the peripheral velocity of the ejection roller 56 is set to be faster than the peripheral velocity of the ejection belt 52.

Incidentally, reference numeral 55 in FIG. 9, as shown in FIG. 3, is a movable guide that may be used as a deflection means of the sheet bundle, and reference numeral 61 is a cam for positioning the movable guide 55 as will be described in detail with reference to FIG. 12A to FIG. 12C, reference numerals 64*a*, 64*b* are side plates of the sheet post-processing apparatus, and reference numeral 63 is a stay for supporting the saddle stitching staplers S1, S2 described later.

Figure 10:
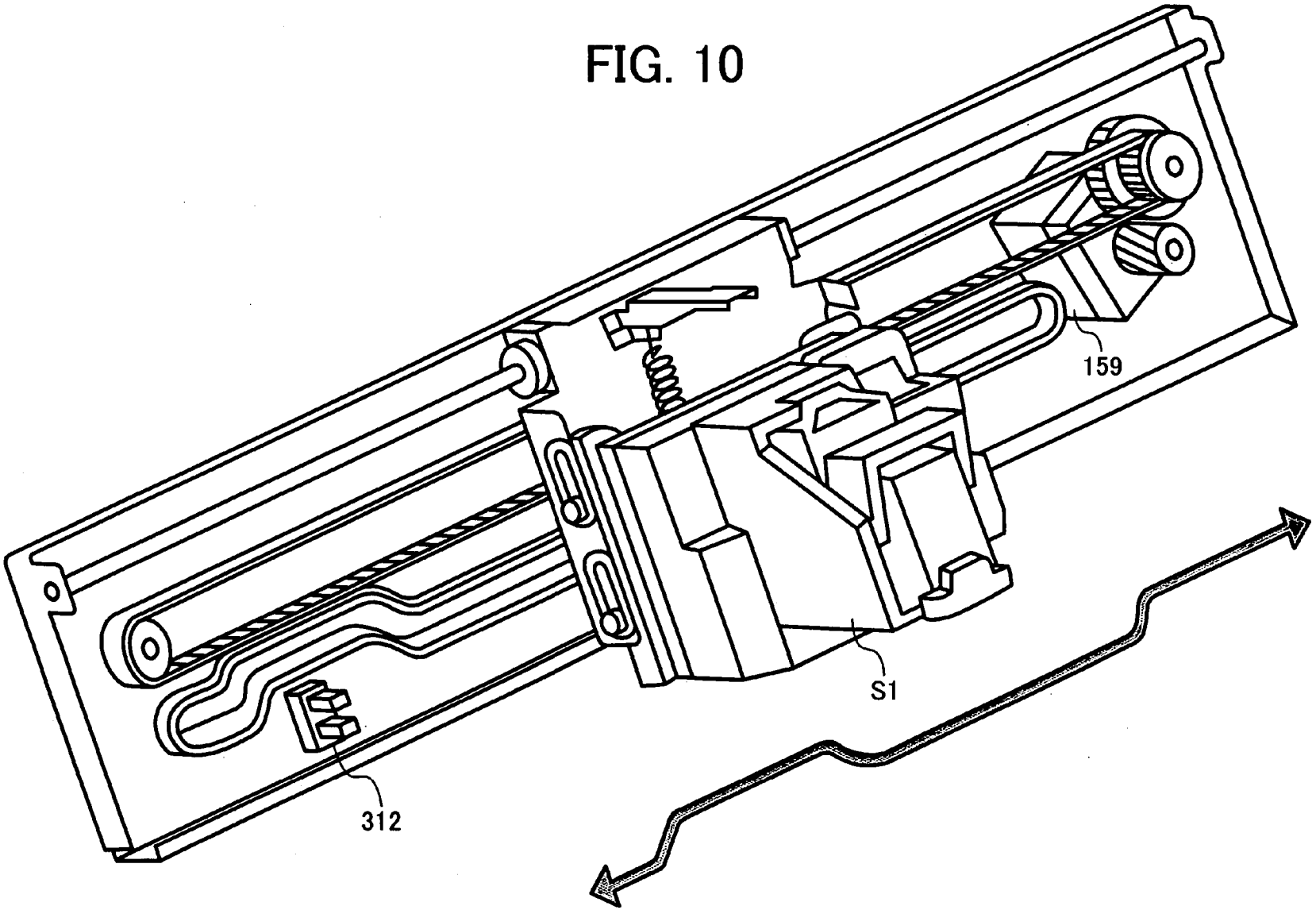
FIG. 10 is a diagram for explaining the configuration and operation of the end face binding mechanism to be used in the housing mechanism of sheets.

The member represented as reference numeral S1 in FIG. 9 is an end face binding stapler for performing binding processing to the end face of sheets, and the end face binding stapler S1, as shown in FIG. 10, is moved and driven in the sheet width direction with a stapler moving motor 159, which is capable of normal and reverse rotation, via a timing belt, and moves in the sheet width direction for binding a prescribed position of the sheet end edge. A stapler movement home position (HP) sensor 312 for detecting the home position of the end face binding stapler S1 is provided to one end of the moving range thereof, and the binding position in the sheet width direction is controlled by the travel distance of the end face binding stapler S1 from the home position.

The member represented as reference numeral S2 in FIG. 9 is a saddle stitch stapler for binding locations other than the end edge of sheets, and the saddle stitch stapler S2, for instance, is used for binding where the center position of the sheets in the discharging direction is bound and folded in the middle. Thus, the saddle stitch stapler S2, as shown in FIG. 3 and FIG. 9, is disposed such that the distance from the back end fence 51 to the stapling position of the saddle stitch stapler S2 will be longer than the distance corresponding to half the length in the transport direction of the maximum sheet size that can be saddle stitched. In addition, two saddle stitch staplers S2 are symmetrically disposed around the alignment in the sheet width direction and fixed with a stay 63.

Figure 11:
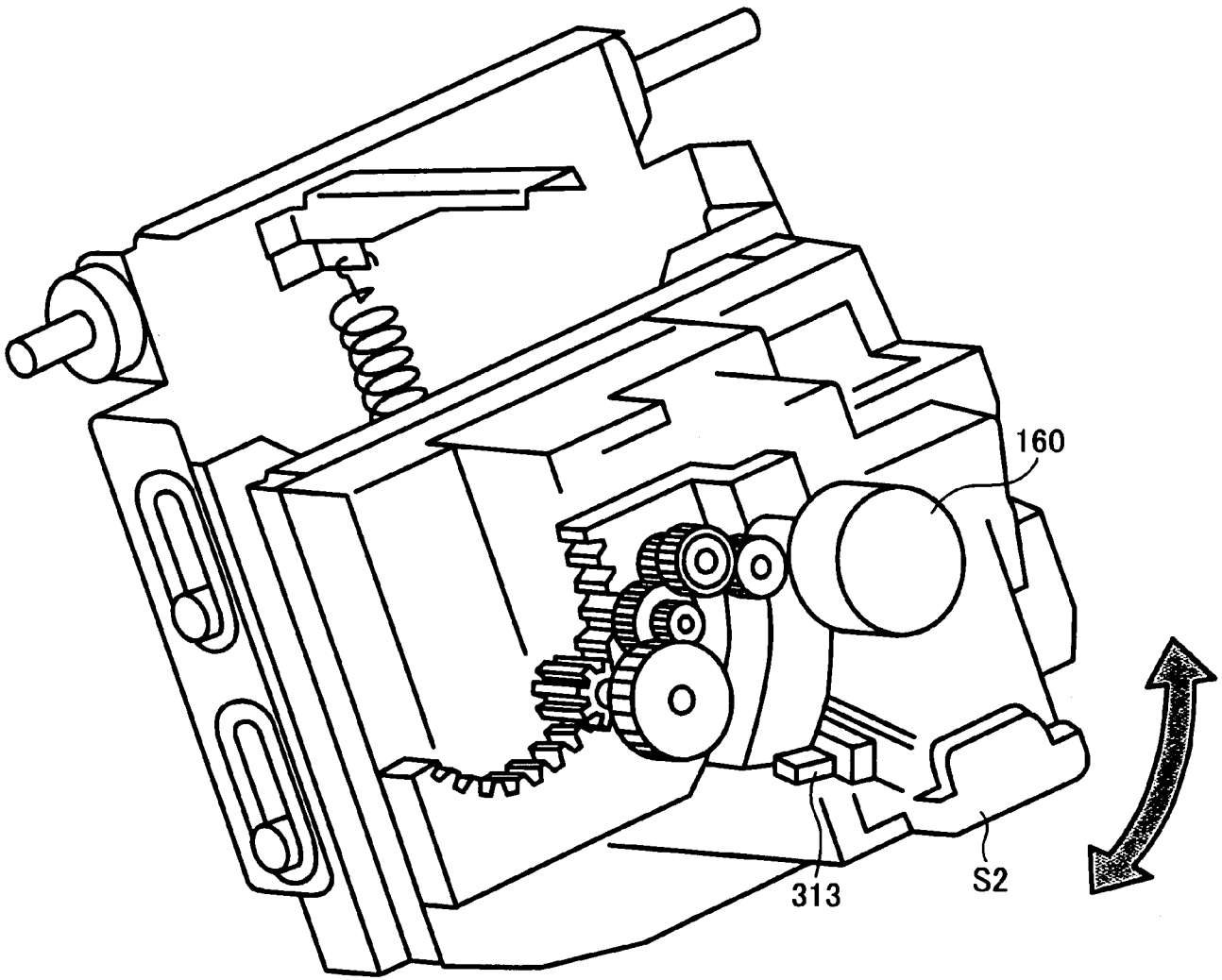
FIG. 11 is a diagram for explaining the configuration and operation of the saddle stitching mechanism to be used in the housing mechanism of sheets.

The saddle stitch stapler S2 in FIG. 11 has a gear for engaging with a sector gear fixed on the stay 63 side, and this gear will turn obliquely based on an inclination motor 160. The starting position of the saddle stitch stapler S2 is detected with a position detection sensor 313.

The branching guide plate 54 and movable guide 55 used as the deflection and ejection means of the sheet bundle subject to binding processing are now explained with reference to FIG. 12A to FIG. 12C.

The deflection means of the sheet bundle is a member for introducing the bound sheet bundle, or discharging the bound sheet bundle to the shift tray 202, or switching the transport direction upon transporting the bound sheet bundle to the middle folding processing tray G, and has a branching guide plate 54 capable of oscillating based on the support 54*a*. The branching guide plate 54 has a pressure roller 57 at the oscillating end thereof, and, when the ejection roller 56 comes in contact with the pressure roller 57 based on the mode of oscillation, it moves in concert with the ejection roller 56 to wedge and transport the sheet bundle. The branching guide plate 54 is provided with a rotating habit toward the ejection roller 56 at all times based on a spring 58 hooked to the oscillating end, and the oscillating position employing this rotating habit is prescribed with a large diameter peripheral face 61*a* of a cam 61 to be rotatably driven with a bundle branching drive motor 161.

Figure 12A:
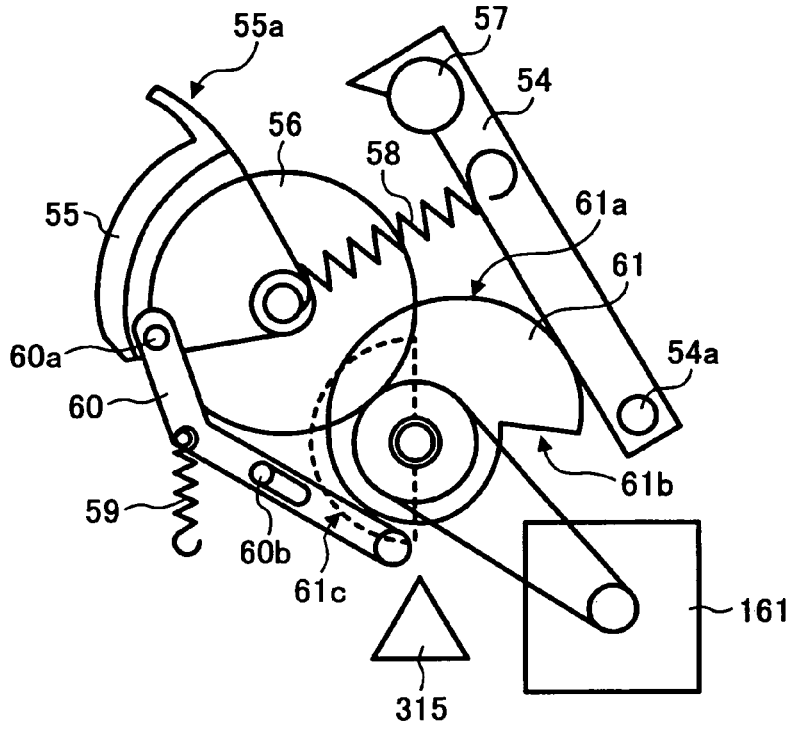
FIG. 12A to FIG. 12C are diagrams for explaining the configuration and operation of the sheet branching mechanism to be used in the sheet processing apparatus.
Figure 12B:
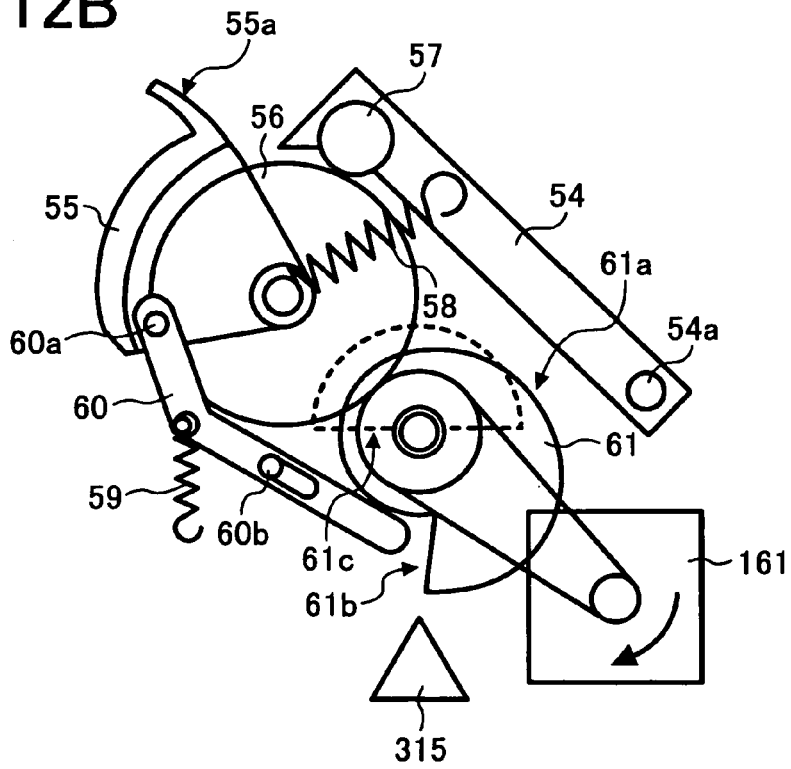
Figure 12C:
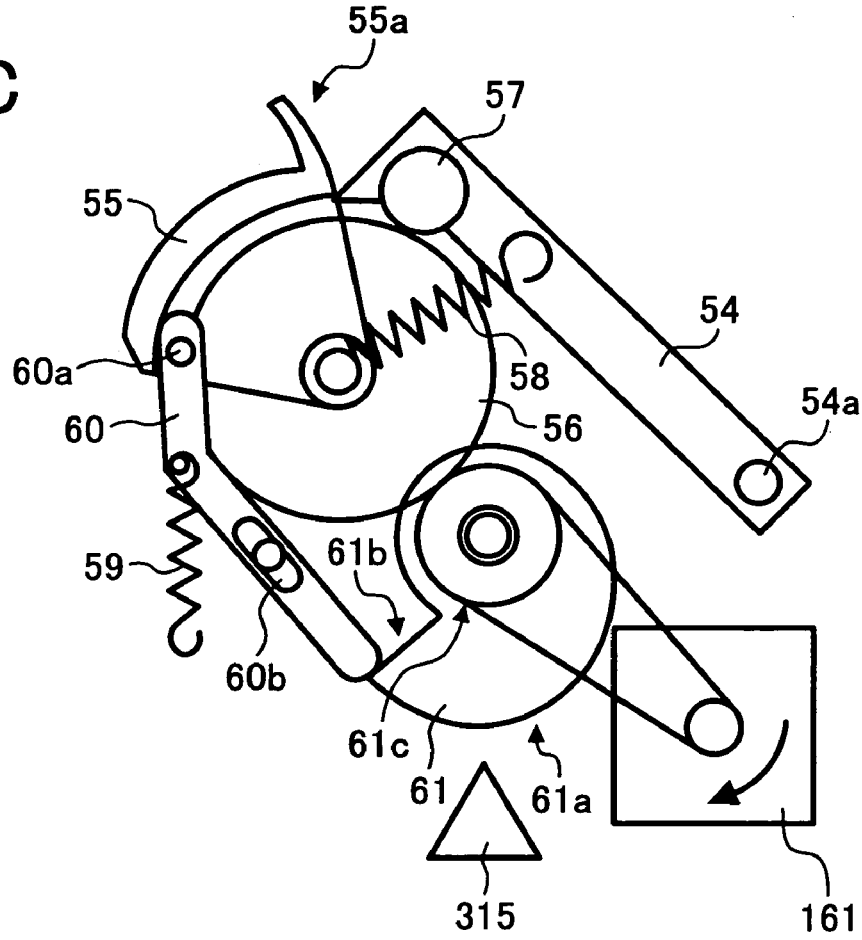

The movable guide 55 shown in FIG. 12A to FIG. 12C is a member capable of rotating by being coaxially supported with the ejection roller 56, and one end of the link arm 60 in the longitudinal direction is connected to the outer periphery thereof.

The rotating range of the link arm 60 is restricted by having a slotted hole for engaging with an immovable pin provided to the sidewall of the sheet post-processing apparatus (members represented with reference numerals 64*a*, 64*b* in FIG. 9). A spring 59 that is hooked across an immovable portion not shown is hooked to the link arm 60, and is normally set in the state shown in FIG. 12A; that is, a state of not transporting the sheet bundle to the middle folding processing tray G. As a result of the link arm 60 facing the cam 61, it is able to turn the movable guide 55 in the clockwise direction as a result of the step portion 61*b* of the cam 61 receiving the same. The home position of the cam 61 is to be detected with the bundle branching home position sensor 315, and the rotational position of the bundle branching drive motor 161 will be determined based on the detection signal from this sensor 315. In this embodiment, a pulse motor is used as the bundle branching drive motor 161, and it determines the pulse at the time the detection signal is output from the bundle branching home position sensor 315, and makes it stop at a position where the status of the branching guide plate 54 and movable guide 55 described later can be set.

FIG. 12A to FIG. 12C show the state of displacement of the branching guide plate 54 and movable guide 55 in relation to the rotational phase of the cam 61, and FIG. 12A shows a case where the cam 61 is positioned in the home position, and, in such a case, a guide face 55*a* of the movable guide 55 will be in a state of permitting the transport of sheets to the shift discharge roller 6.

FIG. 12B shows a case where the branching guide plate 54 rotates downward and the pressure roller 57 is pressing the ejection roller 56 due to the rotation of the cam 61, and, in such a case, this is in the middle stage of rotating the movable guide 55 as shown in FIG. 12C, and, further as shown in FIG. 12C, the cam 61 rotates further and the movable guide 55 rotates upward, and the path for guiding the sheet bundle from the staple processing tray F to the middle folding processing tray G is set. Here, the pressure roller 57 equipped to the link arm 54 will contact the ejection roller 56 and enter a condition where it will be able to wedge and transport the sheet bundle. Incidentally, although the branching guide plate 54 and movable guide 55 are made to operate with a single drive motor 161, without limitation thereto, each may comprise a drive source and be independently controlled regarding the timing of movement or stopping position according to the sheet size or number of bound sheets.

Figure 13A:
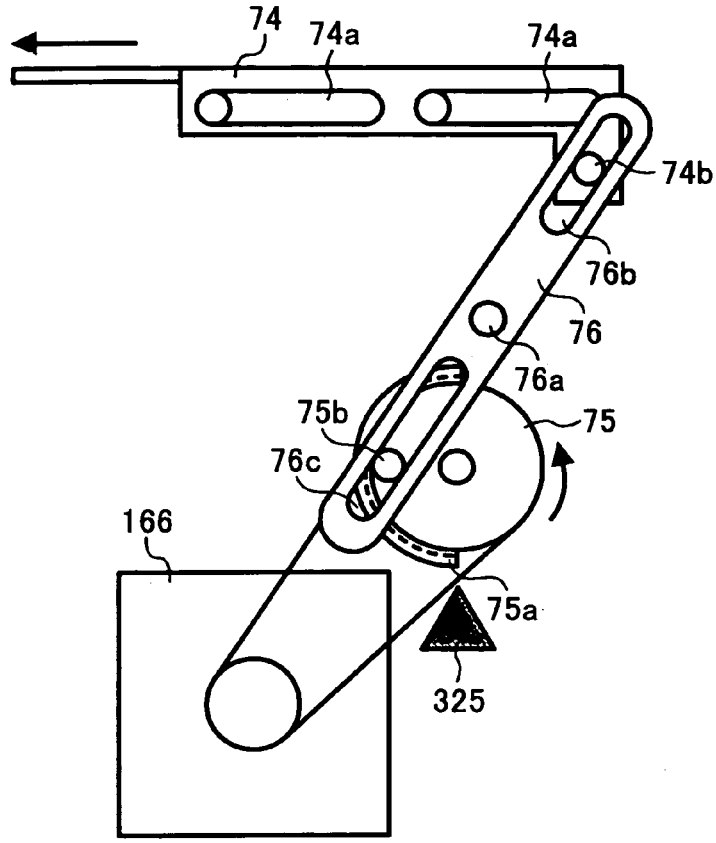
FIG. 13A and FIG. 13B are diagrams for explaining the configuration and operation of the sheet middle-folding mechanism to be used in the sheet post-processing apparatus illustrated in FIG. 1.
Figure 13B:
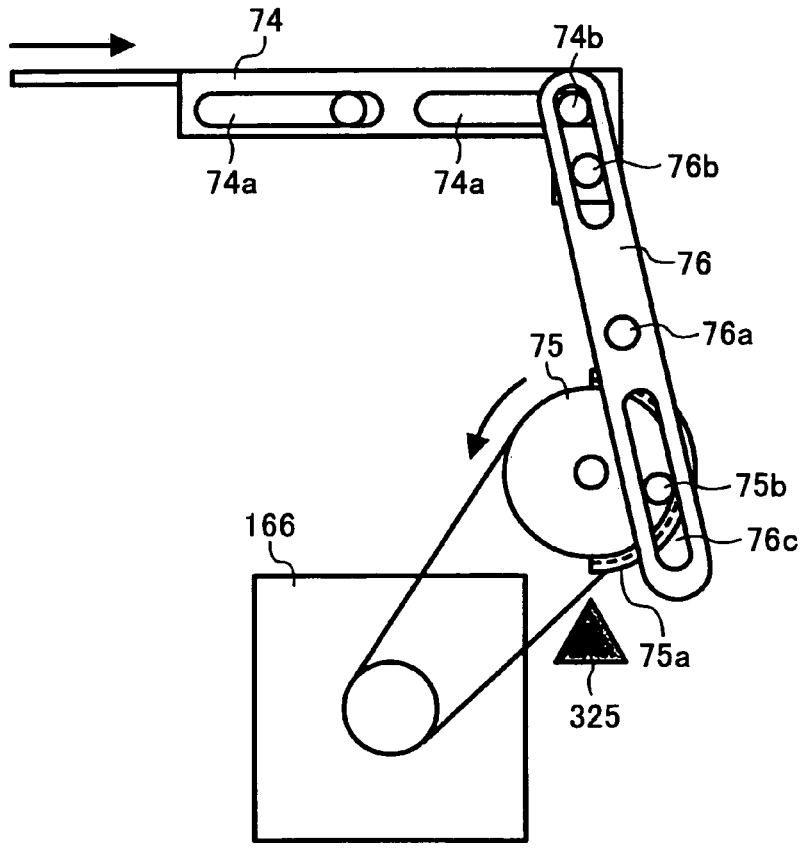

The folding plate 74 used in the middle folding processing tray G has the configuration illustrated in FIG. 13A and FIG. 13B, and is capable of folding the sheet bundle introduced into the tray G.

In FIG. 13A and FIG. 13B, the folding plate 74 is supported by a slotted hole 74*a* being engaged with two axes placed at the front and back sides of the plate, the axis 74*b* and the slotted hole 76*b* of the link arm 76 are engaged, and, by the link arm 76 oscillating around the support 76*a*, the folding plate 74 is able to reciprocate in the left and right directions in FIG. 13A and FIG. 13B.

The slotted hole 76*c* of the link arm 76 are engaged with the axis 75*b* of a folding plate drive cam 75, and the link arm 76 is oscillated by the rotation of the folding plate drive cam 75.

The folding plate drive cam 75 will rotate in the direction shown with the arrow (counterclockwise direction) in FIG. 13A and FIG. 13B by a folding plate drive motor 166, and the stopping position is set by the crescentic shielding unit 75*a* provided to the outer periphery being detected with the folding plate home position sensor 325.

FIG. 13A shows a state where the folding plate 74 is not being used; that is, where it is positioned at the home position retreated to a position that is far from the sheet bundle, and, when the folding plate drive motor 166 is rotatably driven in this state, the folding plate 74 will advance from the home position as shown with the arrow and protrude to the sheet bundle housing area in the middle folding processing tray G.

FIG. 13B shows a state where the folding plate 74 is protruding to the sheet bundle housing area illustrated in FIG. 13A, and, as shown in FIG. 13B, this state corresponds to a state where the sheet bundle can be folded, and, when the folding plate drive motor 166 is rotatably driven in this state, the folding plate 74 will move in the direction shown with the arrow and retreat from the sheet bundle housing area in the middle folding processing tray G.

FIG. 14 is a block diagram for explaining the configuration of the control unit to be used in the sheet post-processing apparatus of the present embodiment, and the control unit 350 in FIG. 14 is a microcomputer having a CPU 360 and an I/O interface 370, and signals from the various switches of the control panel of an image forming apparatus not shown or from the various sensors such as the paper detection sensor 330 are input to the CPU 360 via the I/O interface 370.

The CPU 360 controls the drive of a tray elevation motor 168 for the shift tray 202, a discharge guide plate switching motor 167 for opening and closing the switching guide plate, a shift motor 169 for moving the shift tray 202, a knock roller motor for driving the knock roller 12, various solenoids such as the knock solenoid (SOL) 170, a transport motor for driving the various transport rollers, a discharge motor for driving the respective discharge rollers, an ejection motor 157 for driving the ejection belt 52, a stapler movement motor 159 for moving the end face binding stapler S1, an inclination motor 160 for obliquely rotating the end face binding stapler S1, a jogger motor 158 for moving the jogger fence 53, a bundle branching drive motor 161 for rotating the branching guide plate 54 and movable guide 55, a back end fence movement motor for moving the movable back end fence 73, a folding plate movement motor for moving the folding plate 74, a folding roller movement motor for driving the folding roller 81, and so on.

The pulse signal of the staple transport motor 155 not shown for driving the staple discharge roller is input to the CPU 360 and counted, and the knock SOL 170 and jogger motor 158 are controlled according to such count.

In the control unit 350, the following sheet discharge modes are set in accordance with the post-processing mode.

(1) Non-staple Mode A: The sheets pass through the transport path A and transport path B and are discharged to the upper tray 201.

(2) Non-staple Mode B: The sheets pass through the transport path A and transport path C and are discharged to the shift tray 202.

(3) Sort/Stack Mode: The sheets pass through the transport path A and transport path C and are discharged to the shift tray 202. Thereupon, the discharged sheets are sorted by the shift tray 202 oscillating in the direction orthogonal to the discharging direction of the sheets for each separation of units.

(4) Staple Mode: The sheets pass through the transport path A and transport path D, are aligned and bound at the staple processing tray F, pass through the transport path C, and are discharged to the shift tray 202.

(5) Saddle Stitch Binding Mode: The sheets pass through the transport path A and transport path D, are aligned and center bound at the staple processing tray F, are further folded at the middle folding processing tray G, pass through the transport path H, and are discharged to the lower tray 203.

Next, the operation of the foregoing modes (1) to (5) is explained. Incidentally, the components represented with reference numerals are those illustrated in FIG. 3.

(1) Operation of Non-staple Mode A:

The sheets from the transport path A sorted with the path selector 15 are guided to the transport path B and discharged to the upper tray 201 via the transport roller 3 and upper discharge roller 4. Further, the upper outlet sensor 302 disposed near the upper discharge roller 4 for detecting the discharge of the sheets will monitor the discharge status.

(2) Operation of Non-staple Mode B:

The sheets from the transport path A sorted with the path selector 15 and path selector 16 are guided to the transport path C and discharged to the shift tray 202 via the transport roller 5 and shift discharge roller 6. Further, the shift outlet sensor 303 disposed near the shift discharge roller 6 for detecting the discharge of the sheets will monitor the discharge status.

(3) Operation of Sort/Stack Mode:

The same transport and discharge operation as the non-staple mode B is performed. Thereupon, the discharged sheets will be sorted by the shift tray 202 oscillating in the direction orthogonal to the discharge direction for each separation of units.

(4) Operation of Staple Mode:

The sheets from the transport path A sorted with the path selector 15 and path selector 16 are guided to the transport path D and discharged to the staple processing tray F via the transport roller 7, transport roller 9, transport roller 10 and staple discharge roller 11. In the staple processing tray F, the sheets sequentially discharged from the discharge roller 11 are aligned, and subject to binding processing with the end face binding stapler S1 upon reaching a prescribed number of sheets. Thereafter, the bound sheet bundle is transported to the downstream (downstream in the direction heading toward the shift tray 202) with the ejection pawl 52*a*, and discharged to the shift tray 202 with the shift discharge roller 6. Further, the shift outlet sensor 303 disposed near the shift discharge roller 6 for detecting the discharge of the sheets will monitor the discharge status.

(5) Operation of Saddle Stitch Binding Mode:

In this mode, the sheets subject to center binding processing with the stapler S1 in the staple mode are transported via the following processes. In other words, pursuant to setting the movable guide 55 to a receivable state, by the pressure roller 57 and ejection roller 56 of the branching guide plate 54 contacting each other, and by being guided to the middle folding processing tray G upon being wedged with the ejection roller 56 and pressure roller 57, the front end of the sheets are abutted against the movable backend fence 73, folded between the nips of the folding roller 81 simultaneously with the protrusion of the folding plate 74 upon positioning the center binding position at the position of the folding plate 74 equipped to the middle folding processing tray G, and discharged to the lower tray 203 with the discharge roller 83 at the point in time when the folding processing is complete. Here, the sheets will be monitored with the bundle arrival sensor 321 positioned in front of the folding roller 81 and the folding unit passage sensor 323 positioned in front of the discharge roller 83, and the contact and timing of rotation of the folding roller 81 and the timing of rotation of the discharge roller 81 can be set thereby.

Next, the discharge state of sheets in the foregoing staple mode and saddle stitch binding mode is explained with reference to FIG. 15, FIG. 16A to FIG. 16D and FIG. 17A to FIG. 17D.

Figure 15:
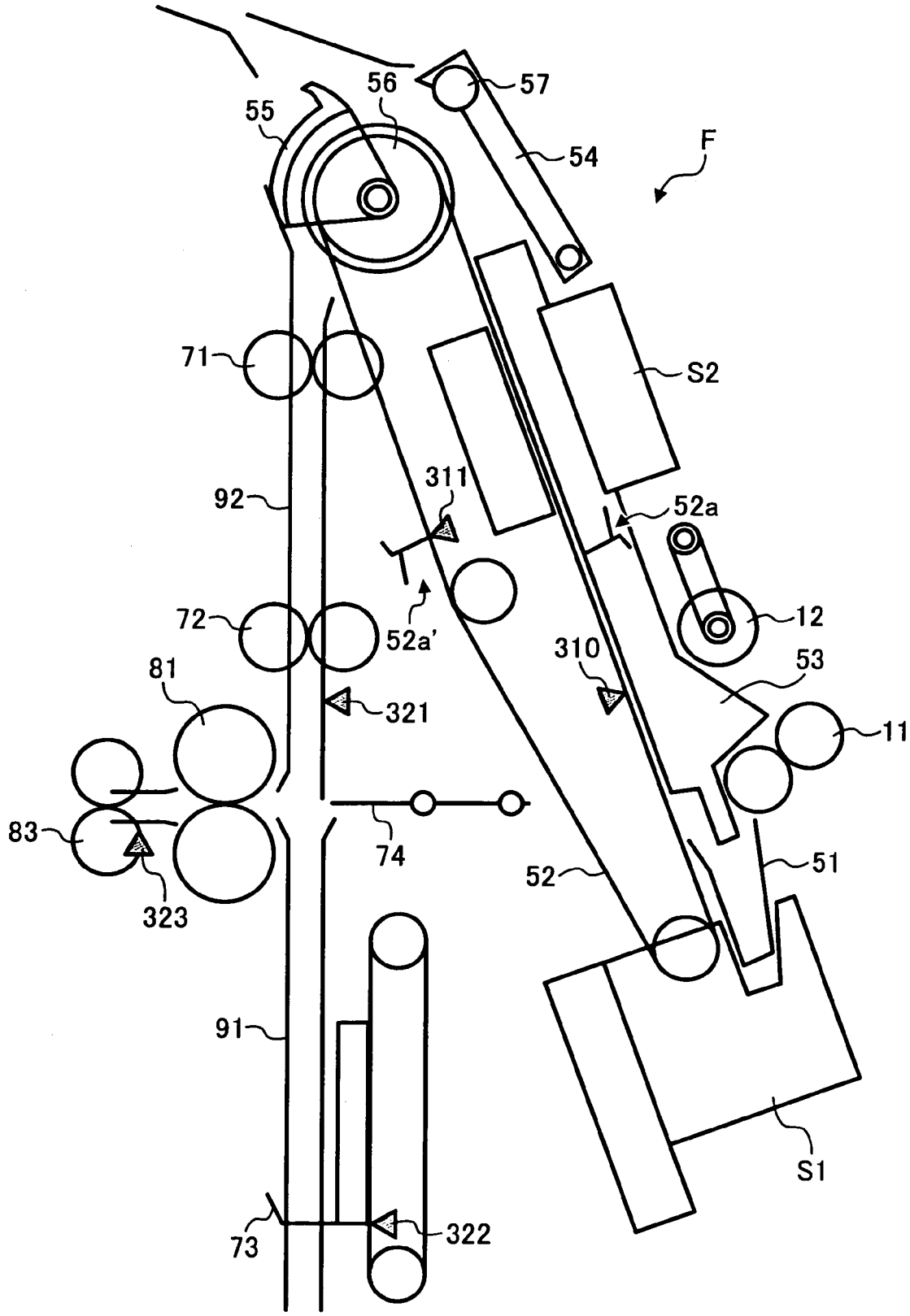
FIG. 15 is a partially enlarged view of the sheet post-processing apparatus for explaining the transport mechanism of sheets with the staple processing tray and middle folding processing tray to be used in the sheet processing apparatus.

FIG. 15 is an enlarged view of the configuration of the staple processing tray F and middle folding processing tray 1G illustrated in FIG. 3.

In FIG. 15, whether the sheets have been introduced into the staple processing tray F is monitored with a sheet existence monitor 310, the branching guide plate 54 is in a state where the pressure roller 57 is estranged from the ejection roller 56, and the ejection pawl 52*a* of the ejection belt 52 stands by at a position detected with the ejection pawl home position sensor 311.

When the staple mode is selected, foremost, the jogger fence 53 depicted in FIG. 8 moves from the home position, and stands by at a standby position that is 7 mm away on one side from the width of the sheets to be discharged to the staple processing tray F. When the sheets are transported with the staple discharge roller 11 and the back end of sheets passes through the staple outlet sensor 305, the jogger face 53 moves 5 mm inward from the standby position and stops. Further, the staple outlet sensor 305 detects this when the back end of sheets passes through, and this signal is input to the CPU 360 (c.f. FIG. 14). The CPU 360 counts the pulses transmitted from the staple transport motor 155 not shown for driving the staple discharge roller 11 at the point in time it receives this signal, and turns on the knock solenoid (SOL) 170 (c.f. FIG. 7) after the transmission of a prescribed number of pulses.

The knock roller 12 engages in a pendulum motion with the ON/OFF of the knock solenoid (SOL) 170, and knocks the sheets and returns downward, and presses and aligns the sheets against the back end fence 51 when turned on. Here, each time the sheets housed in the staple processing tray F pass through the inlet sensor 301 or the staple outlet sensor 305, that signal is input to the CPU 360, and the number of sheets is counted.

When the knock solenoid (SOL) 170 is turned off and a prescribed period of time elapses, the jogger fence 53 will move 2.6 mm inside based on the jogger motor 158 and stop once, and complete the lateral alignment. Thereafter, the jogger fence 53 will move 7.6 mm outside and return to the standby position, and wait for the next sheet. This operation is conducted until the final page. Thereafter, it moves 7 mm inside once again and prepares for the staple operation by pressing both sides of the sheet bundle.

After a prescribed period of time, the end face binding stapler S1 will operate based on a staple motor not shown to perform binding processing. Here, when two or more locations are designated for the binding, after the binding processing of one location is completed, the staple movement motor 159 (c.f. FIG. 10) is driven, and the end face binding stapler S1 is moved to an appropriated position along the back end of the sheets, and the binding processing for the second location is conducted. Further, when the third location and beyond are designated, the foregoing process is repeated.

When the binding processing is completed, the ejection motor 157 (c.f. FIG. 8) is driven, and the ejection belt 52 is driven. Here, the discharge motor is also driven, and the shift discharge roller 6 to receive the sheet bundle scooped with the ejection pawl 52*a* begins to rotate.

The jogger fence 53 is controlled to be different based on the sheet size and number of bound sheets. For instance, when the number of bound sheets is less than the set number, or the size is smaller than the set size, the jogger fence 53 will hold down the sheet bundle while the ejection pawl 52*a* will hook the back end of the sheet bundle and transport the same.

In the staple processing tray F, based on the detection by the sheet existence sensor 310 or the ejection belt home position sensor 311 illustrated in FIG. 15, the jogger fence 53 is retreated 2 mm after a prescribed pulse in order to release the binding of sheets. This prescribed pulse is set between the period when the ejection pawl 52*a* contacts the back end of sheets and then passes by the leading edge of the jogger fence 53.

Further, when the number of bound sheets is greater than the set number or the size is larger than the set size, the jogger fence 53 is retreated 2 mm in advance to perform ejection. In either case, when the sheet bundle passes through the jogger fence 53, the jogger fence 53 moves 5 mm outward and returns to the standby position, and prepares for the next sheet. Incidentally, it is also possible to adjust the binding force based on the distance of the jogger fence 53 to the sheets.

FIG. 16A to FIG. 16D and FIG. 17A to FIG. 17D show the discharge state of sheets in the saddle stitch binding mode described above. When this mode is selected, the sheets from the transport path A sorted with the path selector 15 and path selector 16 are guided to the transport path D and discharged to the staple processing tray F via the transport roller 7, transport roller 9, transport roller 10 and staple discharge roller 11.

Figure 16A:
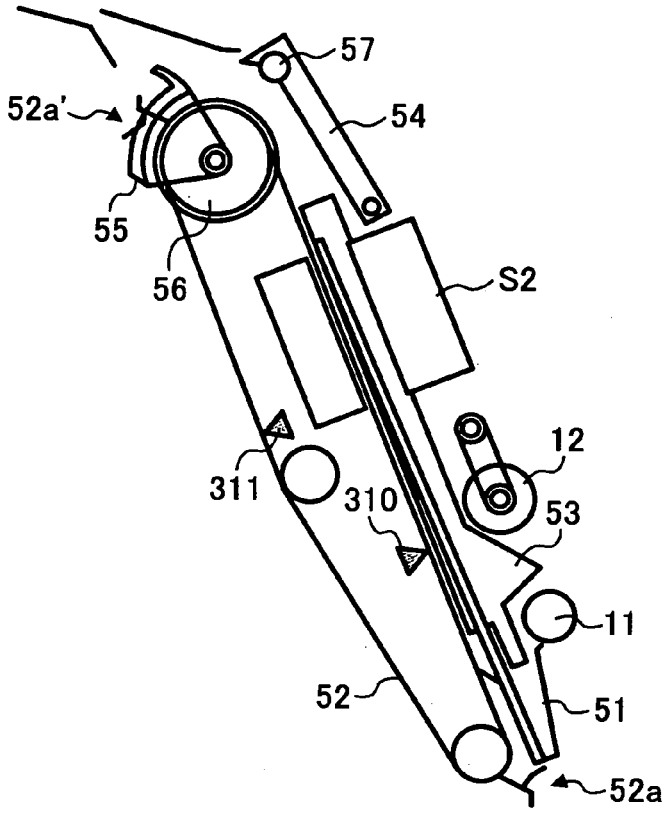
FIG. 16A to FIG. 16D are diagrams for explaining the transport mode with the staple processing tray, which is one of the transport modes in the sheet transport mechanism.
Figure 16B:
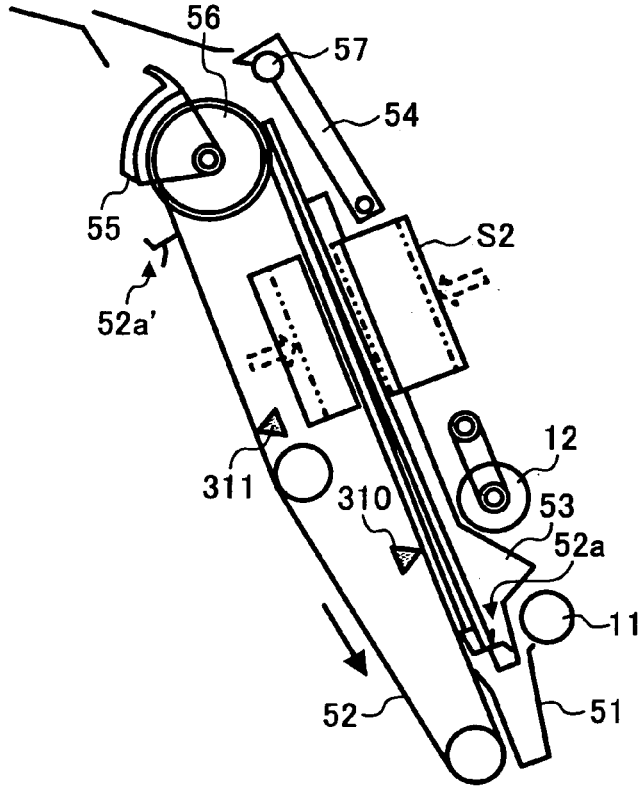

In the staple processing tray F, as with the foregoing staple mode, the sheets sequentially discharged from the discharge roller 11 are aligned, and subject to binding processing with the end face binding stapler S1 upon reaching a prescribed number of sheets (c.f. FIG. 16A). In other words, only the alignment processing is performed, and the end face binding processing is not performed. Thereafter, as shown in FIG. 16B, the sheet bundle is carried downstream for a prescribed distance set for each sheet size by the ejection pawl 52*a*, and the center thereof is subject to binding processing with the saddle stitching stapler S2. The bound sheet bundle is transported downstream a prescribed distance set for each sheet size by the ejection pawl 52*a*, and once stops at the position depicted in FIG. 16C. This moving distance is managed with the drive pulse of the ejection motor 157.

Figure 16C:
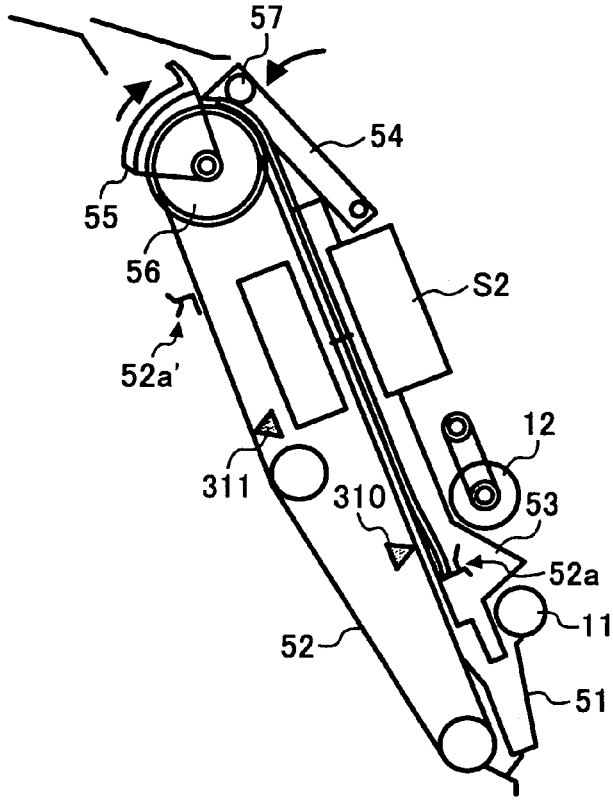

Thereafter, as shown in FIG. 16C, the front end of the sheet bundle is wedged between the ejection roller 56 and the pressure roller 57, and enters a state of moving to the path to guide the sheet bundle to the middle folding processing tray G by the rotation of the branching guide plate 54 and movable guide 55, and is transported downstream once again by the ejection pawl 52*a* and ejection roller 56. This ejection roller 56 is driven in sync with the ejection belt 52 provided to the drive axis of the ejection belt 52.

Figure 16D:
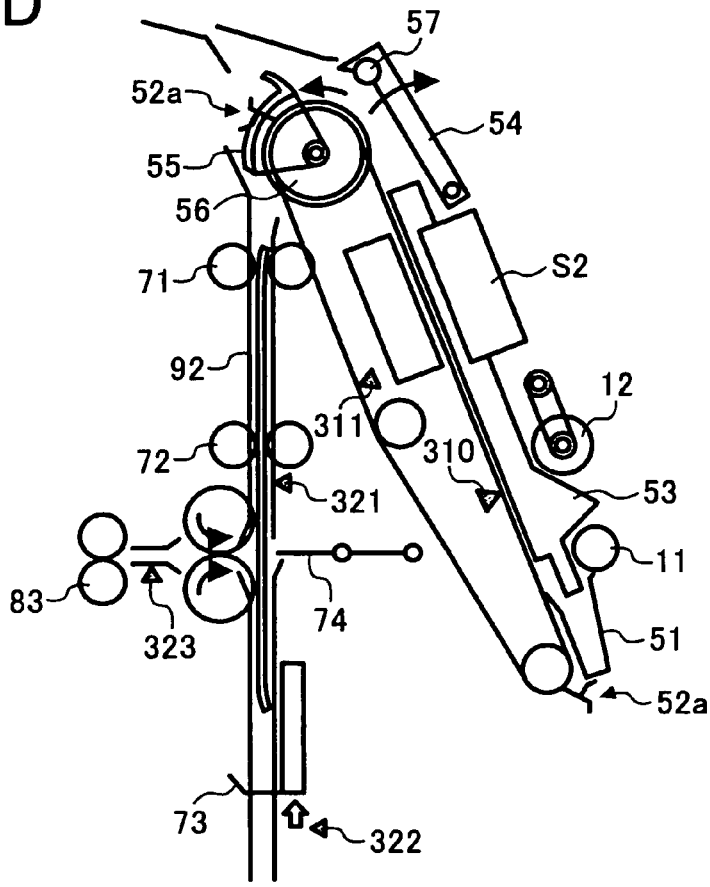

And, as shown in FIG. 16D, the sheet bundle is transported by the upper bundle transport roller 71 and lower bundle transport roller 72 to the movable back end fence 73 for guiding the end face of the lower part of the sheet bundle by being moved in advance from the home position to a position according to the sheet size. Here, the ejection pawl 52*a* stops at a position where another ejection pawl (as a matter of convenience, this is shown as reference numeral 52*a*' in FIG. 16D) disposed at an opposite position on the outer periphery of the ejection belt 52 reaches the vicinity of the back end fence 51, and the branching guide 54 and movable guide 55 return to the home position and prepare for the next sheet.

Figure 17B:
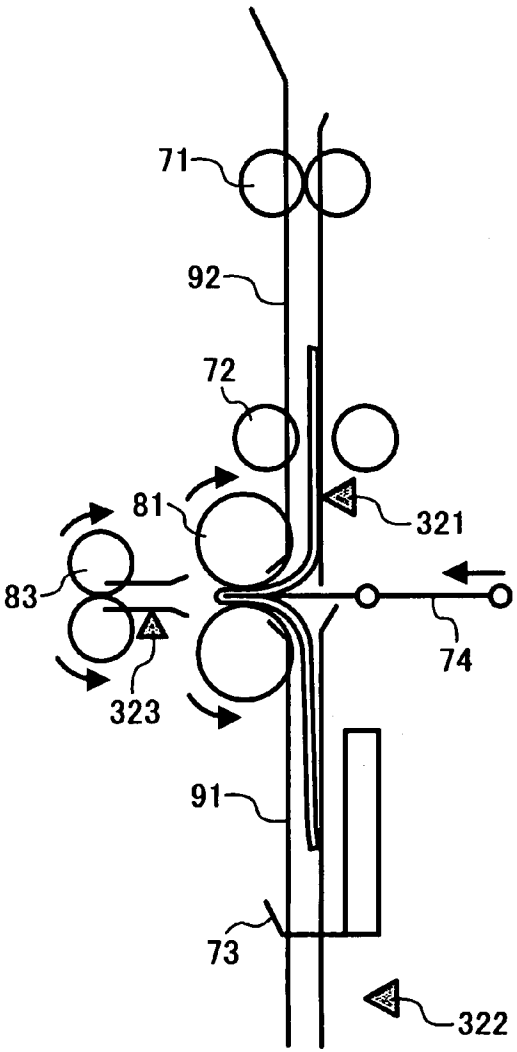
FIG. 17A to FIG. 17D are diagrams for explaining the transport mode with the middle folding processing tray, which is one of the transport modes in the sheet transport mechanism.
Figure 17A:
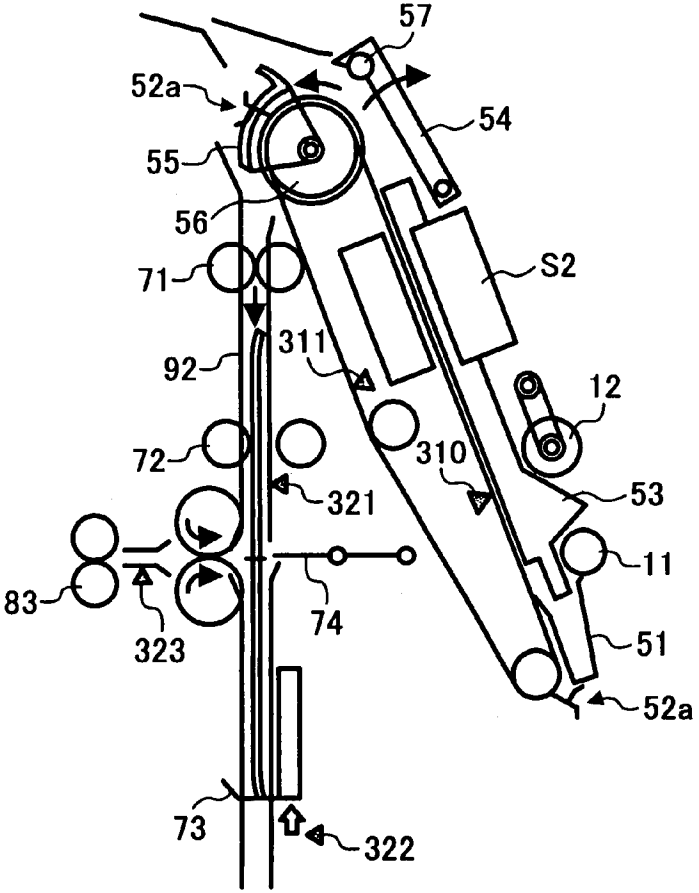

In FIG. 17A, the sheet bundle pressed against the movable back end fence 73 is released with the pressure of the lower bundle transport roller 72. Thereafter, as shown in FIG. 17B, the vicinity of the bound needle portion is pressed by the folding plate 74 in an approximate perpendicular direction, and the sheet bundle is guided to the nip of the folding roller 81 positioned at the side where the folding plate 74 is protruding. The folding roller 81 folds the center of the sheet bundle by pressing and transporting such sheet bundle.

Figure 17D:
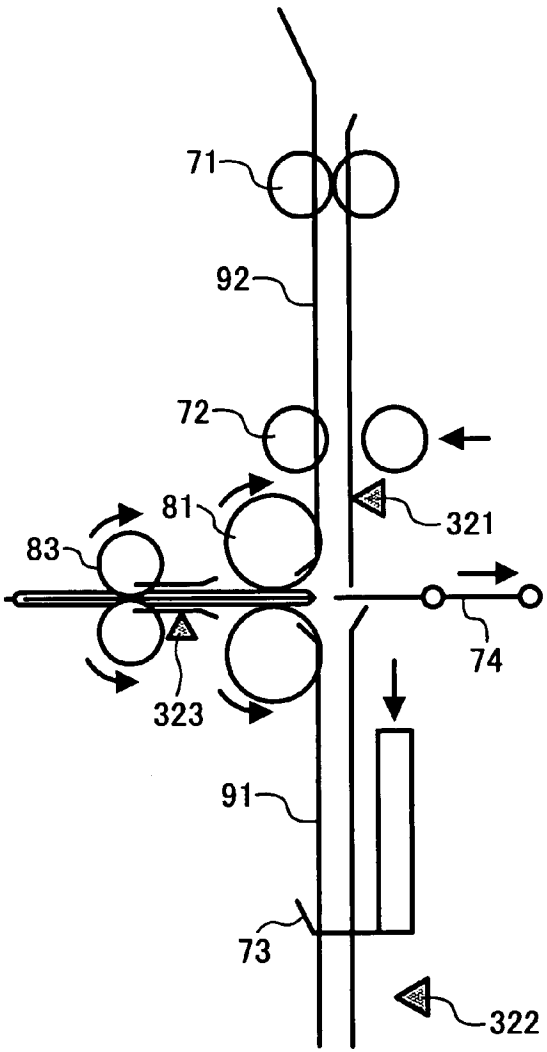
Figure 17C:
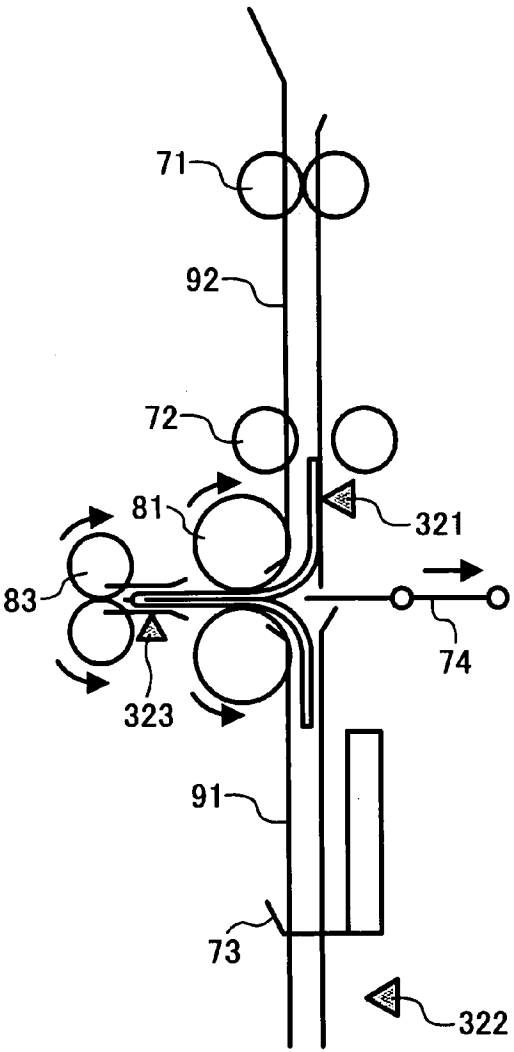

In FIG. 17C, when the front end of the folded sheet bundle is detected with the folding unit passage sensor 323, the folding plate 74 returns to the home position. Thereafter, as shown in FIG. 17D, the sheet bundle is discharged to the lower tray 203 with the lower discharge roller 83. Here, when the back end of the sheet bundle is no longer detected with the bundle arrival sensor 321, the movable back end fence 73 returns to the home position, the pressure of the bundle transport roller 72 is recovered, and prepares for the next sheet. Further, if the next job is the same sheet size and same number of sheets, the movable back end fence 73 could standby at such position.

In this embodiment, when each of the respective discharge modes of the foregoing sheets is selected, processing corresponding to the mode is performed in the control unit 350.

Figure 18:
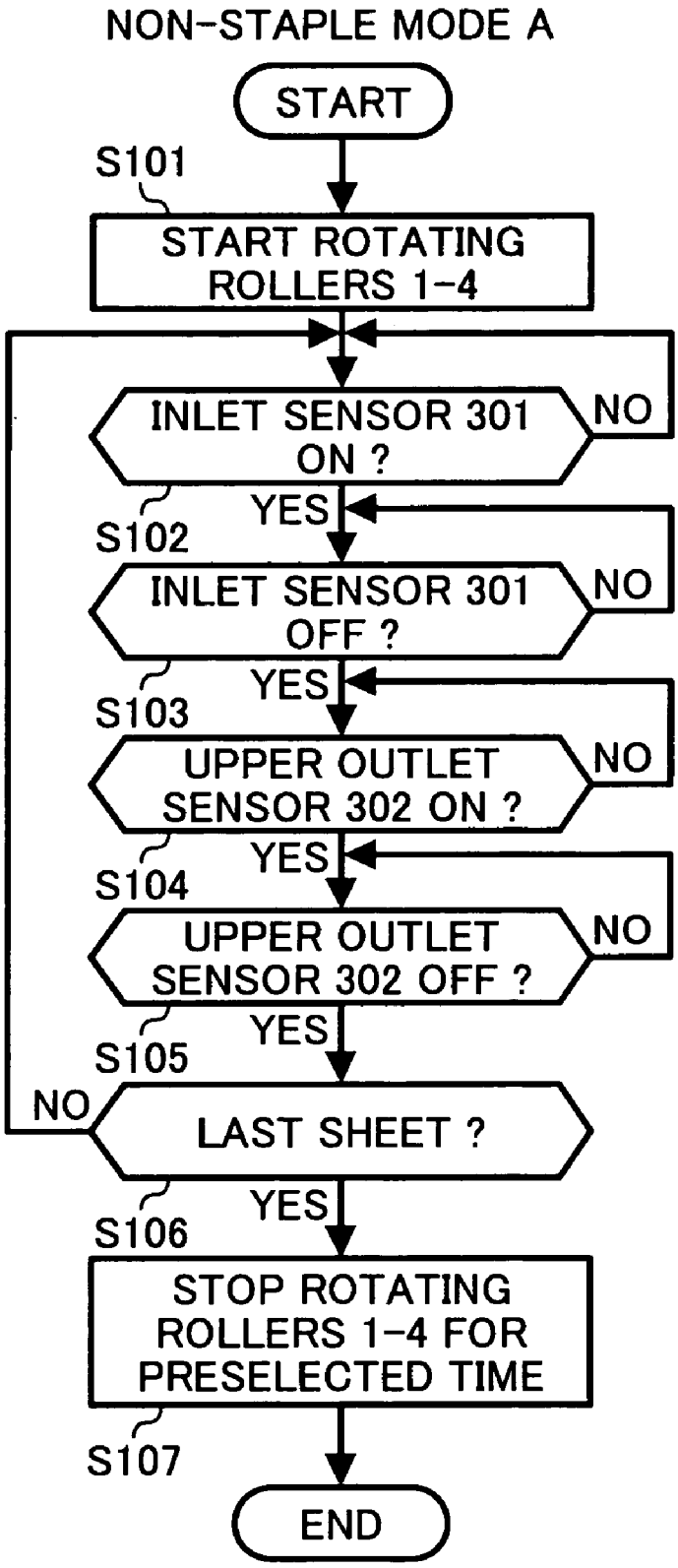
FIG. 18 is a flowchart for explaining the description of control to be executed in one of the non-staple processing steps to be executed with the control unit depicted in FIG. 14.

FIG. 18 to FIG. 22 are flowcharts for explaining the description of control to be executed in the control unit 350, and FIG. 18 and FIG. 19 show the non-staple modes A and B; FIG. 20 shows the sort/stack mode; FIG. 21 shows the staple mode; and FIG. 22 shows the saddle stitch binding mode.

In FIG. 18, when the non-staple mode A is selected, the following control contents are used. Incidentally, in the description of control explained below, a sheet is explained as paper, and the reference numerals of the respective components are those illustrated in FIG. 3.

When paper is to be transported from the imaging forming apparatus, the inlet roller 1 positioned on the transport path to which a punching apparatus 100 is disposed, a transport roller 2, and a transport roller 3 and an upper discharge roller 4 positioned on the transport paths A, B to the upper tray 201 begin to rotate, respectively (S101). Then, the ON state of the inlet sensor 301 is determined (S102), and, when it is turned ON, whether the inlet sensor 301 is OFF is determined (S103).

While determining the ON/OFF of the upper outlet sensor 302 (S104, S105) and counting the number of sheets that passed through based on the determination in each of the foregoing steps, when it is determined that the final paper has passed through (S106), the rotating of the inlet roller 1 and transport rollers 2, 3 and the upper discharge roller 4 is stopped after the lapse of a prescribed period of time (S107).

Thereby, all the sheets transported from the image forming apparatus are discharged to and loaded on the upper tray 201 without being bound.

Incidentally, the paper transported from the image forming apparatus may be subject to punching processing while passing through the punching apparatus 100, and may be discharged on the upper tray 201 in a state of being perforated as necessary.

Figure 19A:
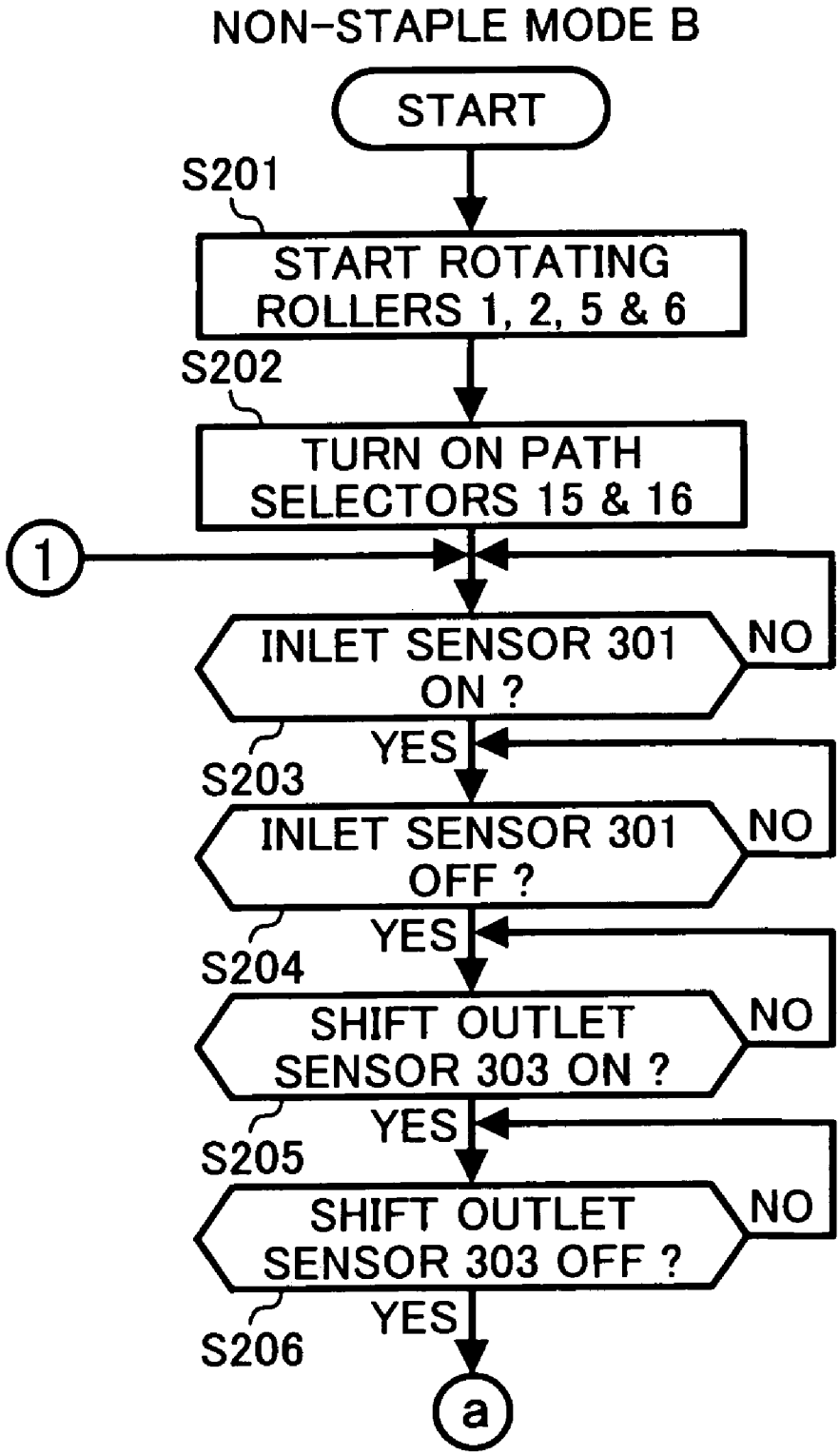
FIG. 19A and FIG. 19B are flowcharts for explaining the description of control of the non-staple processing to be executed with the control unit.
Figure 19B:
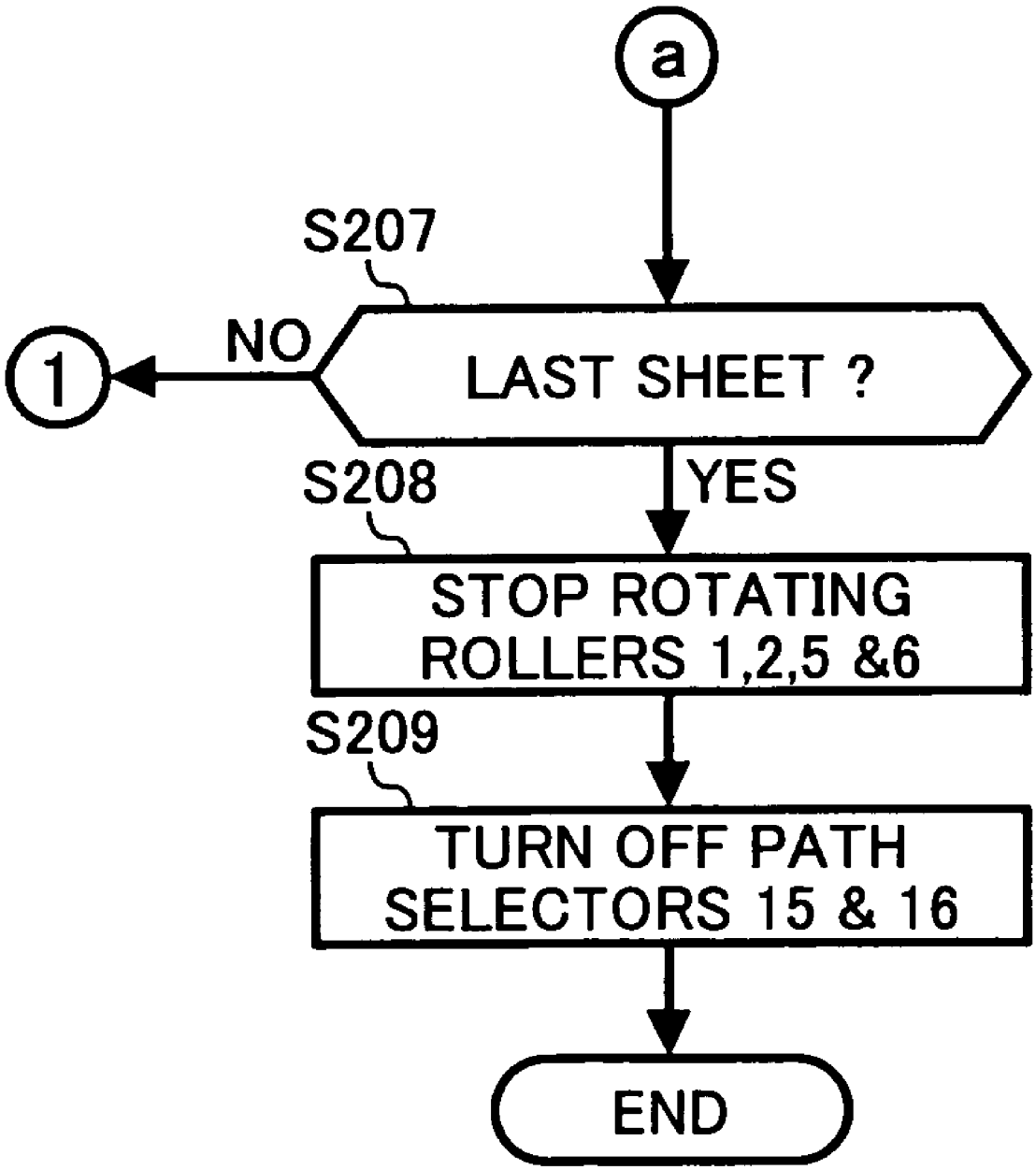

Next, the non-staple mode B is explained with reference to FIG. 19A and FIG. 19B.

When paper is to be transported from the imaging forming apparatus, the inlet roller 1 positioned on the transport path to which a punching apparatus 100 is disposed, a transport roller 2, a transport roller 5 positioned on the shift tray transport path C and a shift discharge roller 6 begin to rotate, respectively (S201). Then, the solenoid for driving the path selector 14 and path selector 15 is turned ON, and the path selector 14 is rotated counterclockwise and the path selector 15 is rotated clockwise, respectively (S202).

The ON state of the inlet sensor 301 is determined (S203) and, when it is ON, whether the inlet sensor 301 turned OFF is determined (S204), the ON state of the shift outlet sensor 303 is determined (S205), whether the shift outlet sensor 303 turned OFF is determined (S206), and upon confirming the number of transported sheets that passed through and determining that the final sheet has passed through (S207), the rotating of the inlet roller 1 and transport roller 2 on the transport path, and the transport roller 5 and shift discharge roller 6 on the shift tray transport path is stopped after the lapse of a prescribed period of time (S208), and the solenoid driving the path selector 14 and path selector 15 is turned OFF (S209).

As a result, all sheets introduced from the image forming apparatus can be discharged and loaded on to the shift tray 202 without being bound. Incidentally, in this mode also, sheets that pass through the punching apparatus 100 may be subject to punching processing before being discharged.

Figure 20A:
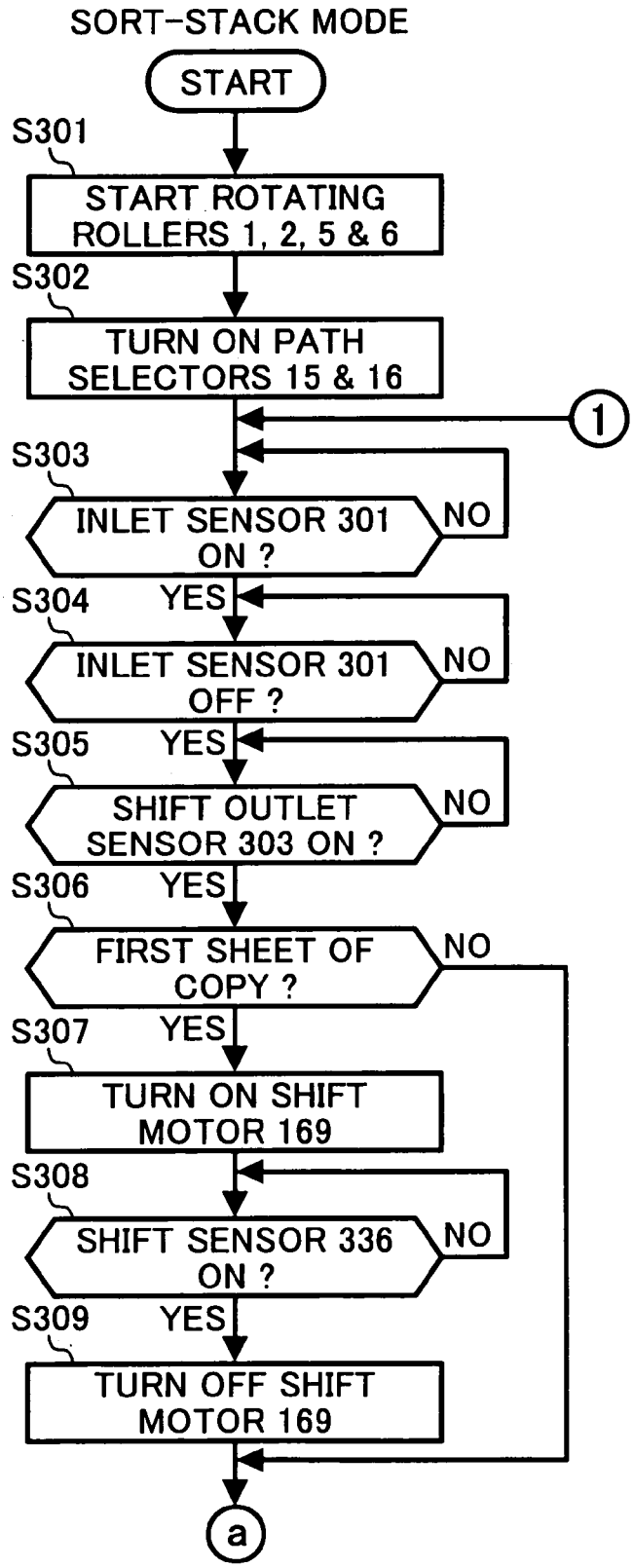
FIG. 20A and FIG. 20B are flowcharts for explaining the description of control of the sort/stack processing to be executed with the control unit.
Figure 20B:
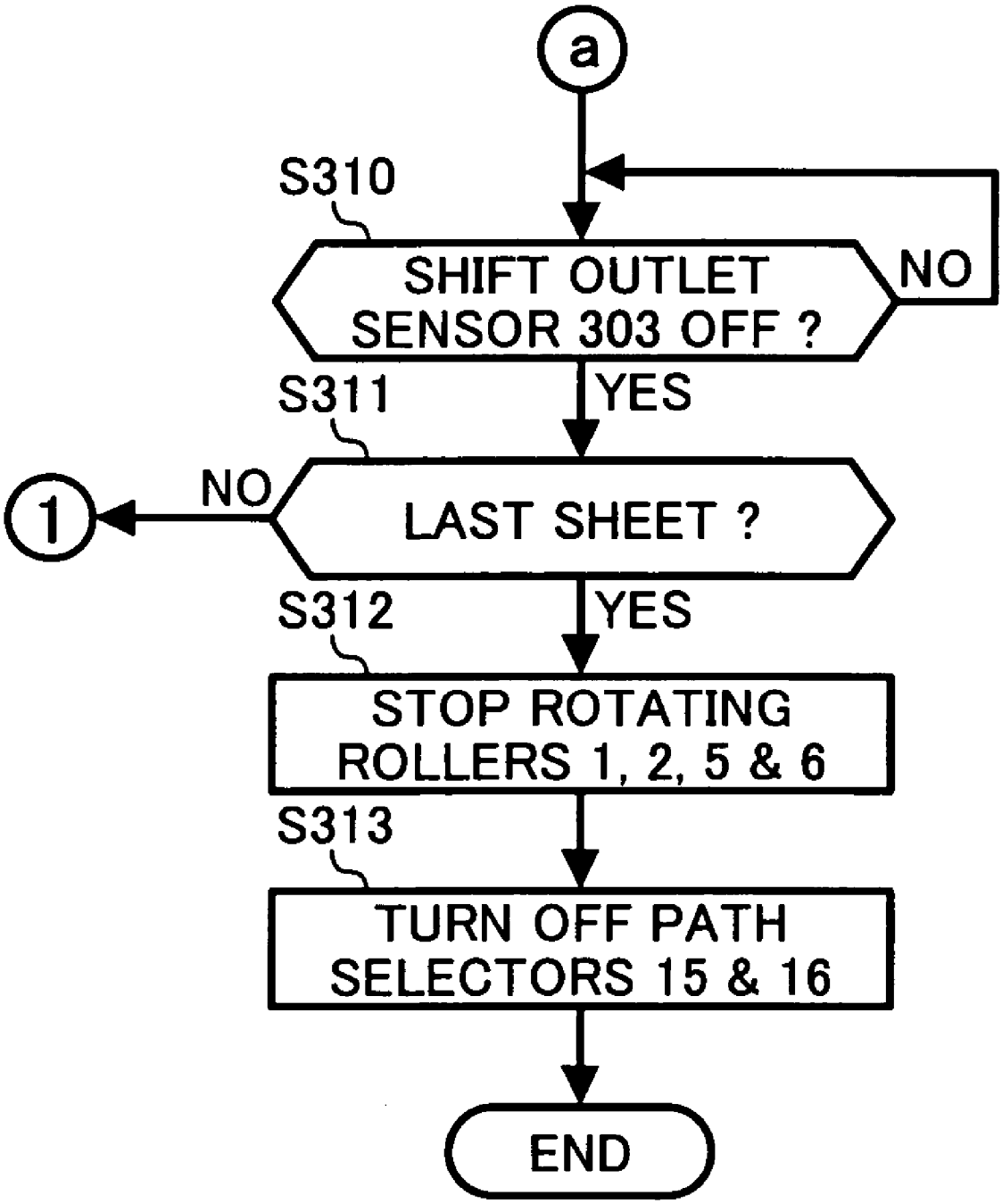

Next, the description of control in the sort/stack mode is explained with reference to FIG. 20A and FIG. 20B.

When paper is to be transported from the imaging forming apparatus, the inlet roller 1 and transport roller 2 on the punching transport path, and the transport roller 5 and shift discharge roller 6 in the middle of the shift tray transport path C begin to rotate, respectively (S301). Then, the solenoid for driving the path selector 14 and path selector 15 is turned ON, and the path selector 14 is turned counterclockwise and the path selector 15 is turned clockwise, respectively (S302).

The ON state of the inlet sensor 301 is determined (S303) whether the inlet sensor 301 turned OFF is determined (S304) the ON state of the shift outlet sensor 303 is determined (S305), and whether the portion of the paper that passed through the shift outlet sensor 303 is the top paper is determined (S306).

If the paper is not the top paper, since the shift tray 202 has already moved, the paper is discharged as is. If the paper is the top paper, the shift motor 169 (c.f. FIG. 5) is turned ON (S307), and the shift tray 202 is moved in a direction that is orthogonal to the transport direction of sheets until the shift sensor 336 (c.f. FIG. 5) detects the shift tray 202 and turns it ON (S308).

By the shift sensor 336 detecting the shift tray 202, it turns OFF the shift motor 169 (S309), discharges the paper to the shift tray 202, determines the OFF state of the shift outlet sensor 303 (S310), determines whether such paper is the final paper (S311), and, when it is not the final paper, it repeats the process from (S303). And, when it is the final paper, at the point in time when a prescribed time elapses after the passage of the final paper, the rotating of the inlet roller 1 and transport roller 2 on the punching transport path, and the transport roller 5 and shift discharge roller 6 in the middle of the shift tray transport path is stopped (S312), and the solenoid for driving the path selector 14 and path selector 15 is turned OFF (S313). As a result, all sheets introduced from the image forming apparatus can be discharged and sorted to the shift tray 202 without being bound. Here, sheets that pass through the punching apparatus 100 may be subject to punching processing before being discharged.

Figure 21A:
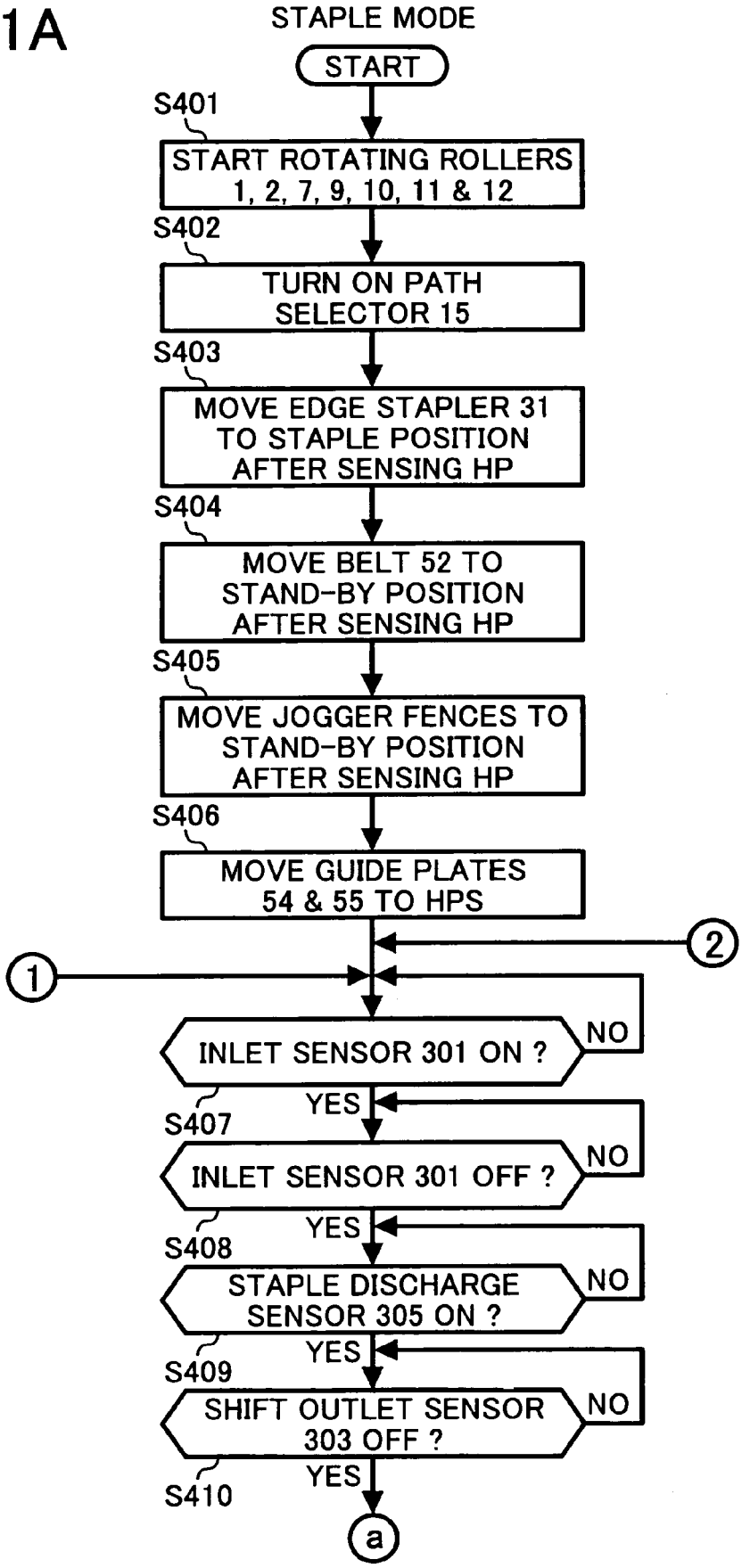
FIG. 21A to FIG. 21C are flowcharts for explaining the description of control of the staple processing to be executed with the control unit.
Figure 21B:
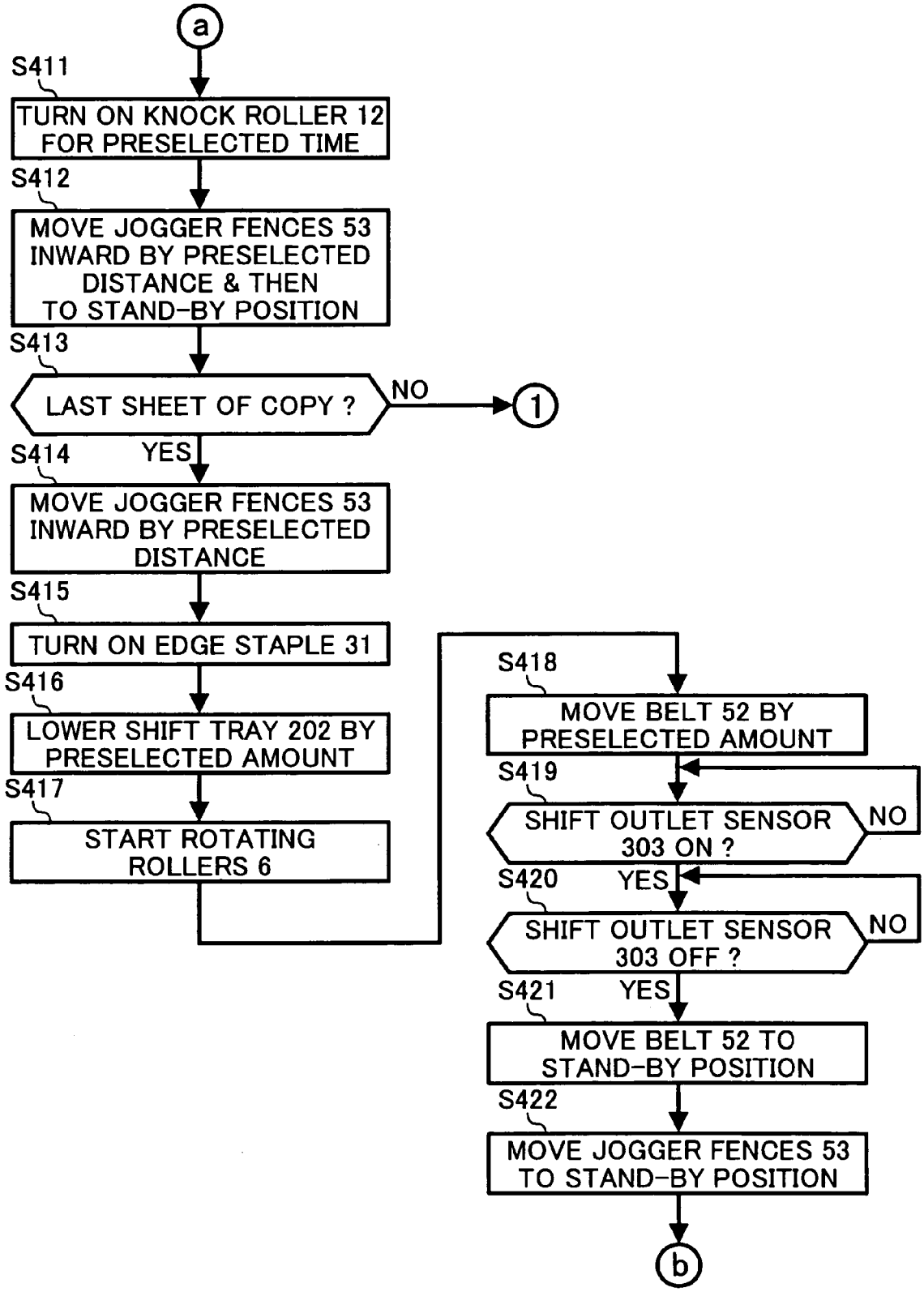
Figure 21C:
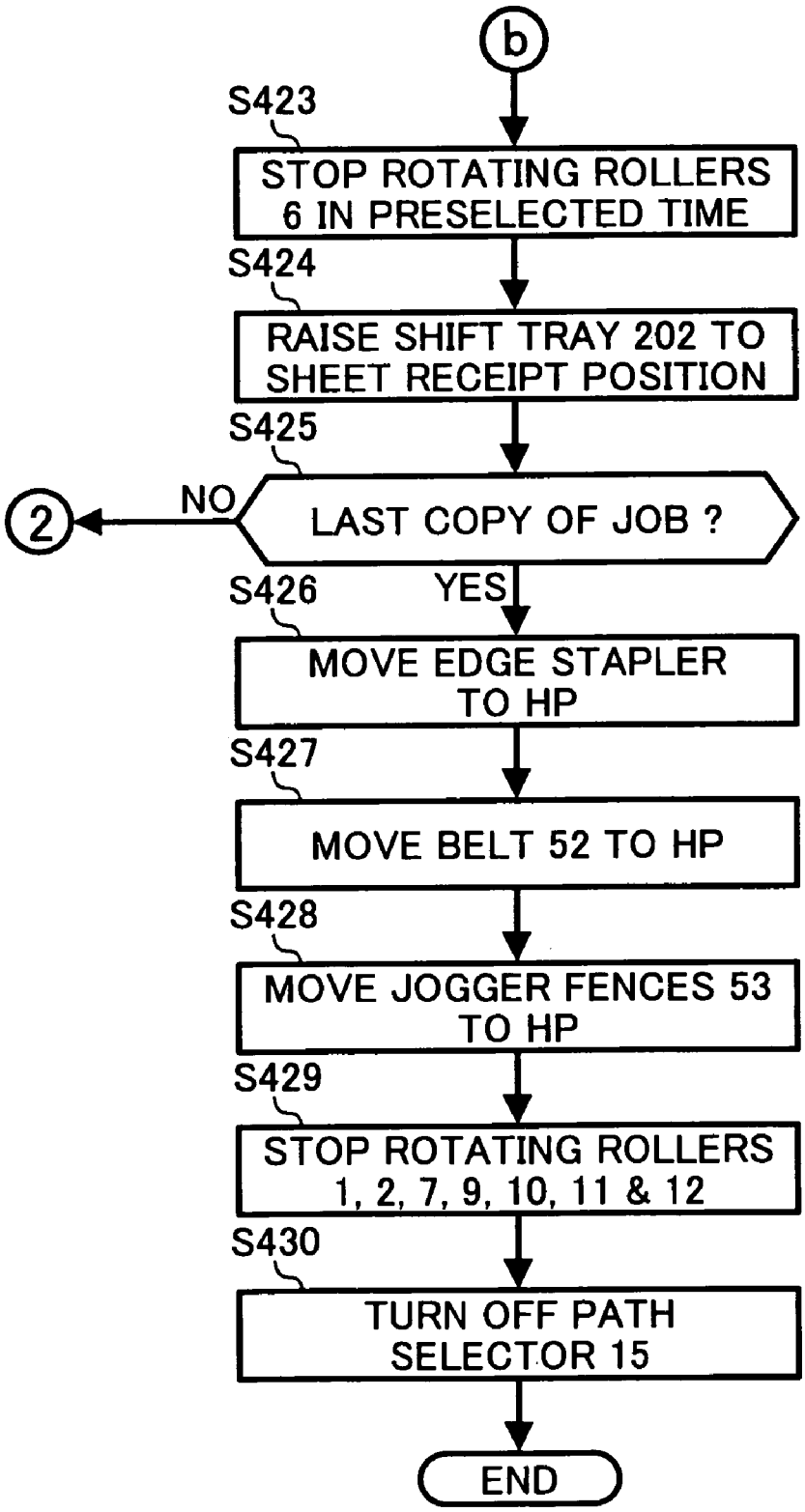

FIG. 21A to FIG. 21C show the description of control in the staple mode. Incidentally, in FIG. 21, the home position of the members may be referred to as HP.

In FIG. 21, when paper is inserted from the image forming apparatus, the inlet roller 1 and transport roller 2 in the punching transport path; the transport roller 7, transport roller 9 and transport roller 10 in the transport path D; the staple discharge roller 11; and the knock roller 12 disposed in the staple processing tray F begin to rotate, respectively (S401), the solenoid for driving the path selector 14 is turned ON, and the path selector 14 is rotated in the counterclockwise direction (S402).

Next, the end face binding stapler S1 is detected with the staple movement home position (HP) sensor 312 (c.f. FIG. 10), and, after confirming the home position, the stapler movement motor 159 (c.f. FIG. 10) is driven, the end face binding stapler S1 is moved to the binding position (S403), or the home position of the ejection belt 52 is also detected with the ejection belt HP sensor 311 (c.f. FIG. 8), and, after confirming the position thereof, the ejection motor 159 is driven in order to move the ejection belt 52 to the standby position (S404).

In conjunction with the foregoing process, the home position of the jogger fence 53 is also detected with the jogger fence HP sensor (not shown), and thereafter moved to the standby position (S405). Further, the branching guide plate 54 and movable guide 55 are moved to the home position (S406). Then, whether the inlet sensor 301 is ON is determined (S407), whether the inlet sensor 301 turned OFF is determined (S408), whether the staple outlet sensor 305 is ON is determined (S409), and whether the shift outlet sensor 303 turned OFF is determined (S410). If the shift outlet sensor 303 is OFF, paper is discharged to the alignment binding processing tray and, since there is paper, the knock solenoid (SOL) 170 (c.f. FIG. 5) is turned ON for a prescribed period of time, the knock roller 12 is turned ON for a prescribed period of time to come in contact with the paper, and, by biasing the paper toward the back end fence 51 side, the back end of paper is aligned (S411).

Next, by driving the jogger motor 158 (c.f. FIG. 7), the jogger fence 53 is moved inward a prescribed amount, and this is returned to the standby position after performing the alignment operation in the direction orthogonal to the width direction of the paper and transport direction of the paper (S412). Thereby, the length and breadth of the paper delivered to the alignment binding processing tray 1 and the direction orthogonal to the direction parallel to the transport direction of the paper can be aligned, and these processes (S407) to (S413) are repeated for each sheet of paper. When it is the final paper of the stack (S413), the jogger fence 53 is moved inward a prescribed amount to prevent the end face of the sheets from becoming misaligned (S414), the end face binding stapler S1 is turned ON in this state, and the end face binding is turned ON and executed (S415).

Meanwhile, the shift tray 202 is lowered a prescribed amount to secure discharging space (S416), and the shift discharge motor is driven to start the rotation of the shift discharge roller 6 (S417). Further, the discharge motor 159 is turned ON to rotate the discharge belt 52 a prescribed amount, the bound sheet bundle is raised in the direction of the shift tray transport path C, the sheet bundle is wedged between the nips of the shift discharge roller 6, and discharge operation is executed to the shift tray 202 (S418). Then, whether the shift outlet sensor 303 is ON is determined (S419), and whether the sheet bundle passed through the shift outlet sensor 303 is determined (S420) by the sheet bundle advancing to the position of the shift outlet sensor 303 and the shift outlet sensor 303 being turned OFF.

When the sheet bundle is in a state of being ready to be discharged to the shift tray 202 with the shift discharge roller 6, the ejection belt 52 is moved to the standby position (S421), and the jogger fence 53 is also moved to the standby position (S422) Further, the rotating of the shift discharge roller 6 is stopped after the lapse of a prescribed period of time (S423), and the shift tray 202 is raised to the sheet reception position (S424). This raised position is controlled by detecting the upper face of the uppermost sheet of the sheet bundle loaded on the shift tray 202 with the sheet face detection sensor 330, and this series of operations is repeated until the final sheet of the job (S425) When it is the final sheet of the sheet bundle, the end face binding stapler S1 is moved to the home position (S426), the ejection belt 52 is also moved to the home position (S427), the jogger fence 53 is also moved to the home position (S428), the inlet roller 1 and transport roller 2 in the punching transport path; the transport roller 7, transport roller 9 and transport roller 10 in the transport path D; the staple discharge roller 11; and the knock roller 12 disposed in the staple processing tray F stop rotating, respectively (S429), and the solenoid for driving the path selector 14 is turned OFF (S430). Thereby, the sheets introduced from the image forming apparatus is subject to binding processing at the staple processing tray F, and discharged to and loaded on the shift tray 202. Incidentally, in this case also, sheets that pass through the punching apparatus 100 may be subject to punching processing before being discharged.

Next, the saddle stitch binding mode is explained with reference to FIG. 22A to FIG. 22C.

Figure 22A:
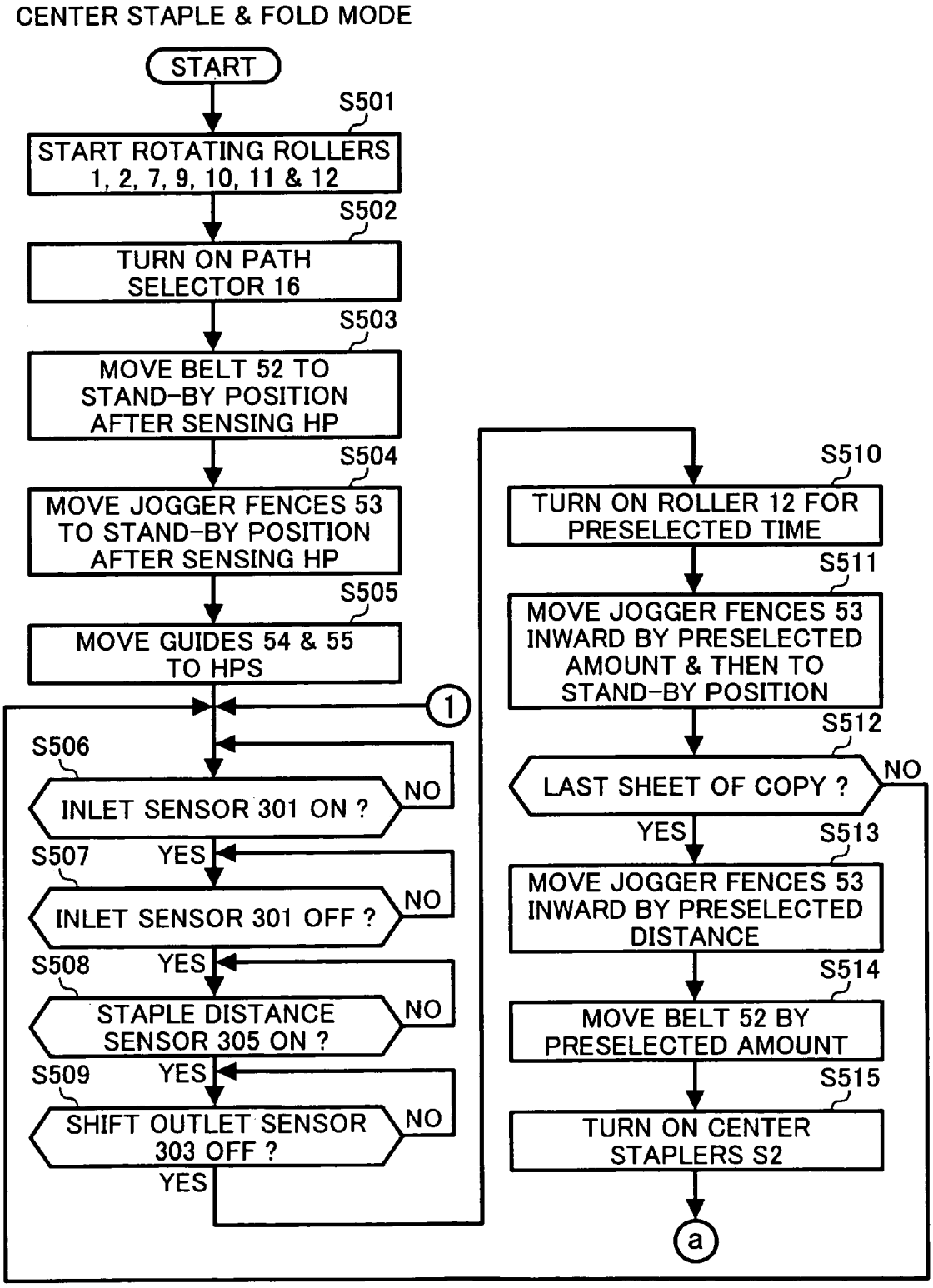
FIG. 22A to FIG. 22C are flowcharts for explaining the description of control of the saddle stitch binding processing to be executed with the control unit.
Figure 22B:
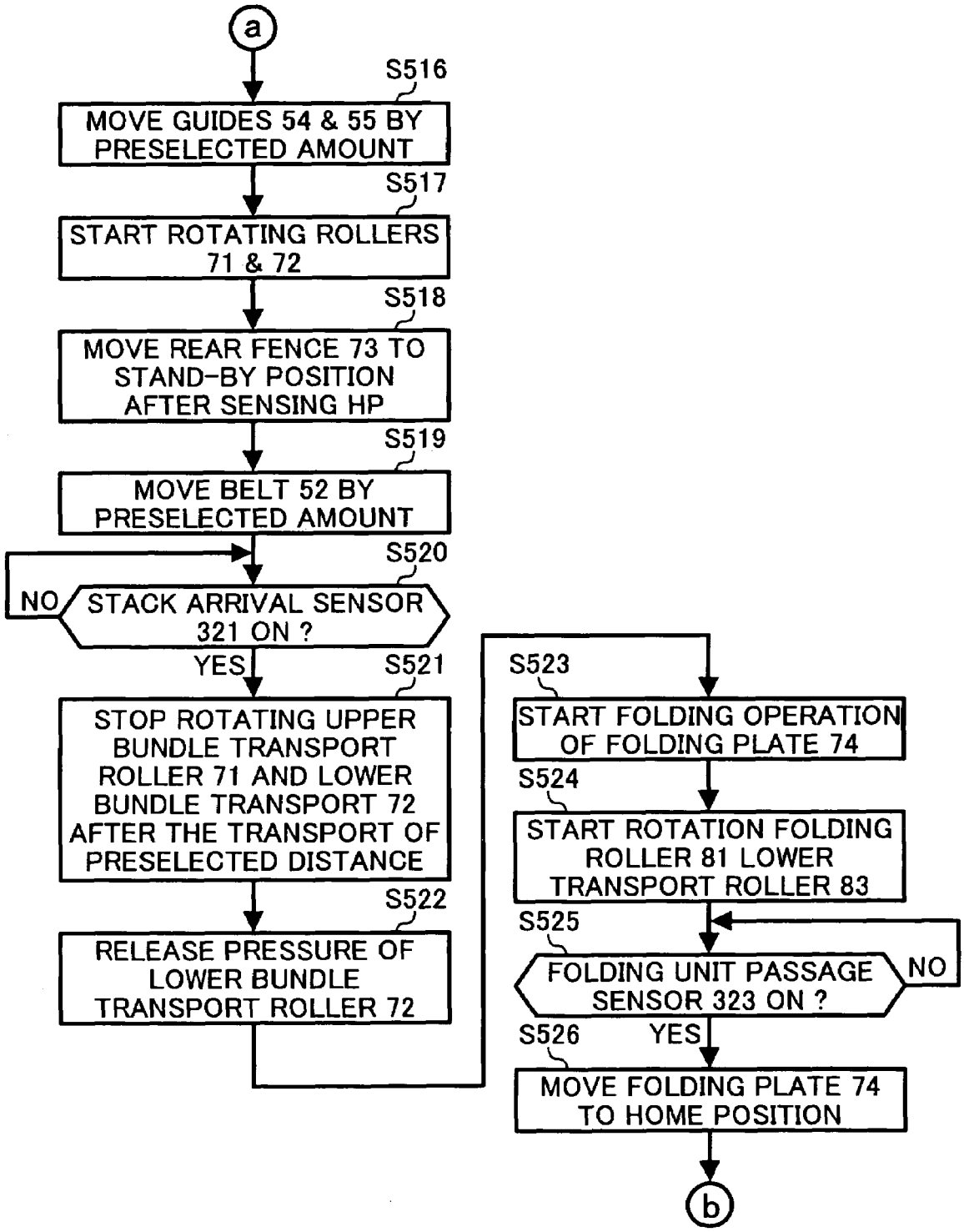
Figure 22C:
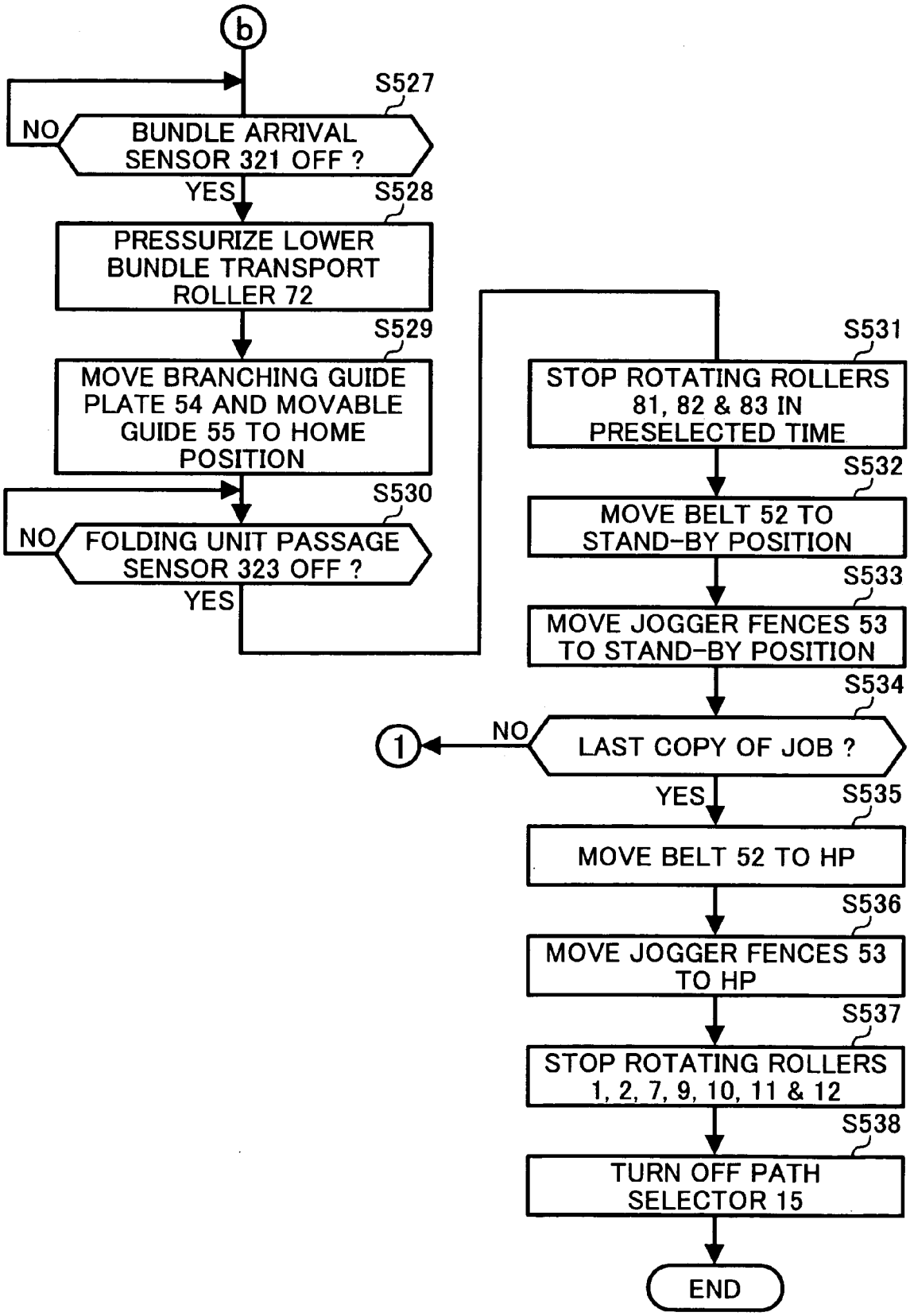

In FIG. 22A to FIG. 22C, when paper is inserted from the image forming apparatus, the inlet roller 1 and transport roller 2 in the punching transport path; the transport rollers 7, 9 and 10 in the transport path D; the staple discharge roller 11; and the knock roller 12 disposed in the staple processing tray F begin to rotate, respectively (S501), the solenoid for driving the path selector 15 is turned ON, and the path selector 15 is rotated in the counterclockwise direction (S502). Next, the home position of the ejection belt 52 is also detected with the ejection belt HP sensor 311, and, after confirming the position thereof, the ejection motor 157 is driven in order to move the ejection belt 52 to the standby position (S503).

Further, the home position of the jogger fence 53 is also detected with the jogger fence HP sensor (not shown), and thereafter moved to the standby position (S504). In conjunction with the foregoing process, the branching guide plate 54 and movable guide 55 are moved to the home position (S505). Then, whether the inlet sensor 301 is ON is determined (S506), whether the inlet sensor 11*a*1 turned OFF is determined (S507), whether the staple outlet sensor 305 is ON is determined (S508), and whether the shift outlet sensor 303 turned OFF is determined (S509).

If the staple outlet sensor 305 is ON and the shift outlet sensor 303 is OFF, since there is paper discharged to the staple processing tray F, the knock solenoid (SOL) 170 is turned ON for a prescribed period of time, the knock roller 12 is turned ON for a prescribed period of time to come in contact with the paper, and, by biasing the paper toward the back end fence 51 side, the back end of paper is aligned (S510).

Next, by driving the jogger motor 158, the jogger fence 53 is moved inward a prescribed amount, and this is returned to the standby position after performing the alignment operation in the direction orthogonal to the width direction of the paper and transport direction of the paper (S511). Thereby, the length and breadth of the paper delivered to the staple processing tray F and the direction orthogonal to the direction parallel to the transport direction of the paper can be aligned, and these processes S506 to S512 are repeated for each sheet of paper. When it is the final paper of the stack (S512), the jogger fence 6 is moved inward a prescribed amount to prevent the end face of the sheets from becoming misaligned (S513).

By turning ON the ejection motor 157 in this state, the ejection belt 52 is turned a prescribed amount (S514), the sheet bundle is raised to the binding position of the saddle stitch binding stapler S2, and the saddle stitch binding stapler S2 is turned ON at the center of the sheet bundle in order to perform saddle stitching (S515).

Next, the branching guide plate 54 and the movable guide 55 are displaced a prescribed amount to form a transport path toward the middle folding processing tray G (S516). Here, the upper bundle transport roller 71 and lower bundle transport roller 72 in the middle folding processing tray G begin to rotate, respectively (S517), and the home position (HP) of the movable back end fence 73 provided to the upper bundle transport guide 91 and lower bundle transport guide 92 in the middle folding processing tray F is detected, and these are moved to the standby position (S518).

As described above, when the system for receiving the sheet bundle in the middle folding processing tray G is arranged, the ejection belt 52 is additionally turned a prescribed amount (S519), and whether the front end of the sheet bundle wedged and transported by the ejection roller 56 and pressure roller 57 has reached the bundle arrival sensor 321 is determined (S520).

When it is determined that the bundle arrival sensor 321 has detected the front end of the sheet bundle, the rotation of the upper bundle transport roller 71 and lower bundle transport roller 72 is stopped (S521), and the pressurized state of the lower bundle transport roller 72 is released (S522).

Next, the folding operation of the folding plate 74 is commenced (S523). In this operation, the rotation of a pair of folding rollers 81 and a lower discharge roller 83 is started (S524), and the return plate 74 is returned to the home position (S526) by determining that the folding unit passage sensor 323 is turned ON upon the discharged and folded sheet passing therethrough (S525).

Whether the bundle passage sensor 321 is turned OFF as a result of the sheet bundle passing therethrough is determined (S527), and, by pressurizing the lower bundle transport roller 72 when such sheet bundle has passed through, it will prepare for the processing of the next sheet bundle to be transported (S528). Further when the discharge position for the sheet bundle is adopted, the branching guide plate 54 and the movable guide 55 are moved to the home position (S529).

When the folding unit passage sensor 323 is turned OFF as a result of the middle folded sheet bundle passing therethrough (S530), the pair of folding rollers 81 and the lower discharge roller 83 are stopped after a prescribed period of time (S531), the ejection belt 52 is moved to the standby position (S532), and the jogger fence 53 is also moved to the standby position (S533). Then, whether it is the last sheet of the job is determined (S534), and, if it is not the last sheet of the job, the routine returns to step S506 and repeats the subsequent steps. If it is the last sheet of the job, the ejection belt 52 is returned to the home position (S535).

Here, the jogger fence 53 is also moved to the home position (S536), the rotation of the inlet roller 1 and transport roller 2 in the punching transport path; the transport roller 7, transport roller 9 and transport roller 10 in the transport path D; the staple discharge roller 11; and the knock roller 12 disposed in the staple processing tray F is stopped (S537) and the branching solenoid for driving the path selector 14 is also turned OFF (S538), and everything is returned to the initial state. Thereby, the sheets introduced from the image forming apparatus is subject to saddle stitch binding processing at the staple processing tray F, subject to the middle folding processing at the folding processing tray G, and the middle folded sheets are discharged to and loaded on the lower tray 203.

In the sheet post-processing apparatus for executing the discharge modes described above, features of the present embodiment are now explained with reference to FIGS. 23A to 23C, 24, 25A and 25B.

Features of the present embodiment are in the configuration of the ejection belt 52 corresponding to the transport means, and the ejection pawl 52*a* provided thereto. The ejection pawl 52*a* prevents the end edge of the sheet bundle from becoming disarranged by bundling such sheet bundle in the thickness direction.

Figure 23A:
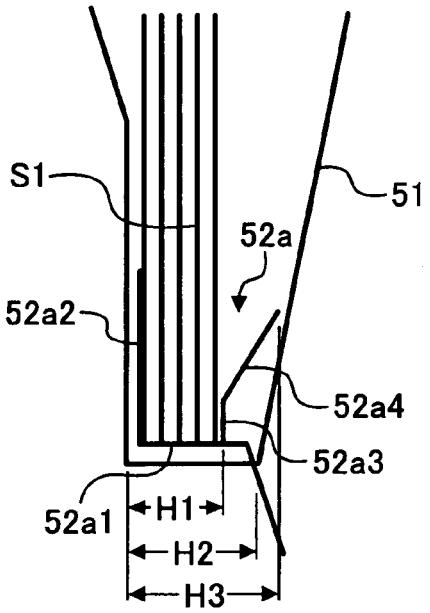
FIG. 23A to FIG. 23C are diagrams for explaining the difference between the configuration of the characterizing portion of the sheet transport mechanism to be used in the sheet processing apparatus and the conventional configuration.
Figure 23B:
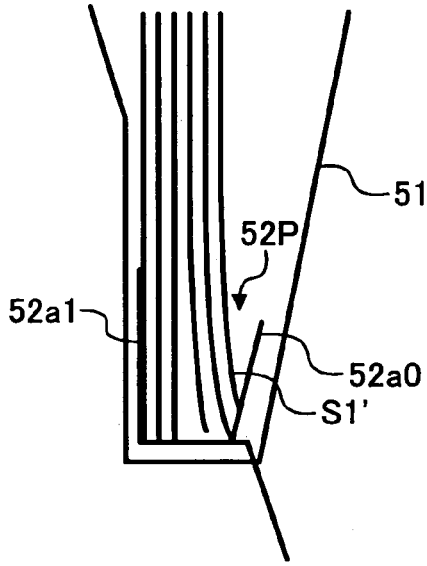
Figure 23C:
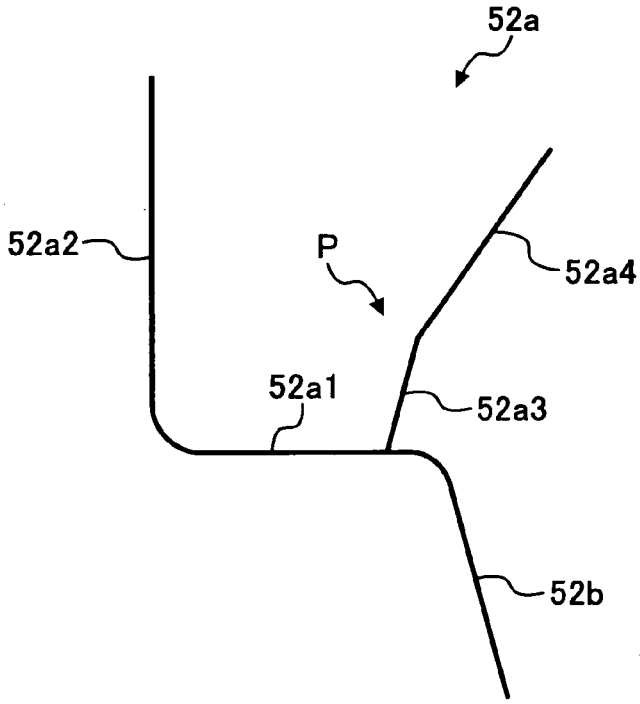

In FIG. 23A, the ejection pawl 52*a* provided to the ejection belt 52 is configured by having a mounting face 52*a*1 for mounting the sheets, a stopper 52*a*2 positioned on the ejection belt 52 side at one end in the thickness direction of the sheets from the mounting face 52*a*1, an opposite face 52*a*3 that is substantially parallel to the sheets, and a guide unit 52*a*4 opening outward toward the leading edge via the bend portion P (c f. FIG. 23C) provided to a part of the opposite face 52*a*3.

With the respective components of the ejection pawl 52*a*, the dimensions of the thickness direction of the sheets have the following relationship to the back end fence 51.

When the dimension of the thickness direction of the sheets in a range where the sheets are actually mounted up to the position where the base of the opposite face 52*a*3 in the mounting face 52*a*1 is fixed is H1, and the dimension of the thickness direction of the sheets in the sheet mounting face of the back end fence 51 is H2, $$H1<H2.$$

Figure 24:
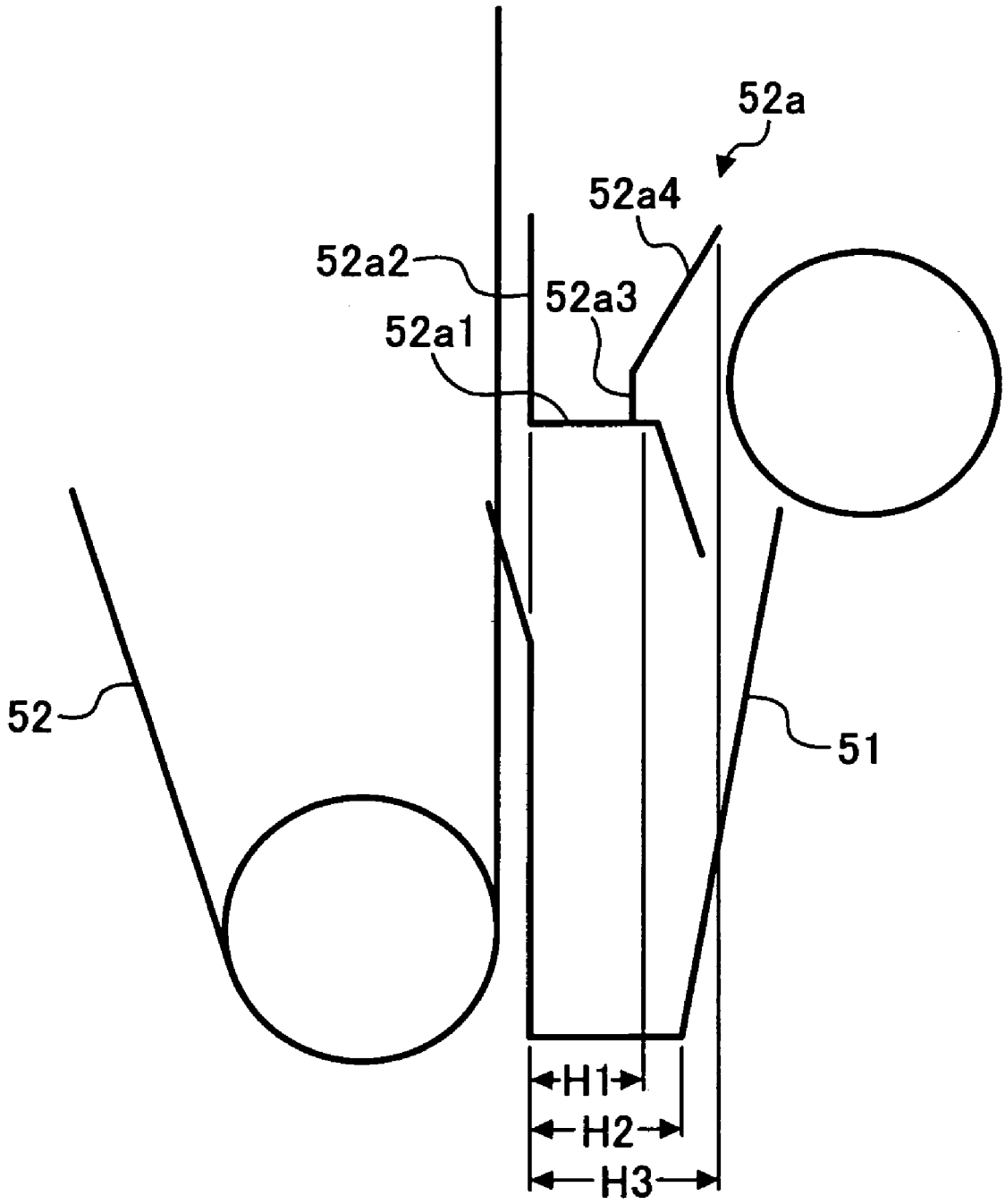
FIG. 24 is a diagram showing an abstraction of only the characterizing portion illustrated in FIG. 23.

Meanwhile, as shown in FIG. 23A and FIG. 24, when adding the dimension of the thickness direction of the sheets up to the leading edge of the guide unit as H3, $$H1<H2<H3.$$

The foregoing dimension H1 is a dimension which provides a margin of 1 to 2 mm to the thickness of the sheets that can be housed in the staple processing tray F.

In this kind of configuration, when the ejection pawl 52*a* is to work in conjunction with the ejection belt 52 to scoop the sheet bundle housed in the back end fence 51, the sheet bundle will be gathered toward the mounting face 52*a*1 with the guide unit 52*a*4, and the sheet group with misaligned end edges in the back end fence 51 will be bundled in one direction (thickness direction) of the sheet toward the stopper 52*a*2 side.

With the sheet group bundled on the stopper 52*a*2 side, when the end is received by the mounting face 52*a*1 of the ejection pawl 52*a*, the mounting face 52*a*1 will be made narrower than the dimension of the back end fence 51 in the thickness direction of the sheets, and the opposite face 52*a*3 is further provided in parallel to the sheets in such measured position. Thus, since the sheet bundle will be pressed in the thickness direction, the bound state of the end can be maintained. In other words, with the sheet group, since the end will slide across the guide unit 52*a*4 and be housed between the opposite face 52*a*3, as shown in FIG. 23B, unlike the ejection pawl (shown as reference numeral 52P as a matter of convenience) having only the guide unit 52*a*0, the end that slid across the guide unit 52*a*0 will not become disarranged at the position where it stopped sliding.

The configuration shown in FIG. 23C shows a case where the opposite face 52*a*3 is a face parallel to the sheets, but a slight inclination is set for the easy introduction of the end of sheets to the mounting face 52*a*1. Incidentally, reference numeral 52*b* in FIG. 23C is a guiding piece for aligning the top end of the sheets upon lowering the ejection pawl 52*a*.

According to this configuration, even if the edge is misaligned and disarranged in the back end face 51, when the ejection pawl 52 scoops the sheet group, the end of the sheets will be bundled in one direction (thickness direction), and will be transported while such bundled state is maintained as a result of being pressed in that direction. Thereby, it is possible to prevent the disarrangement of the end edge, and prevent the misaligned end edges becoming noticeable during the middle folding binding process. In particular, since the end of sheets gathered toward the mounting face with the guide unit 52*a*4 will be bound in the thickness direction at the point in time it is loaded onto the mounting face as a result of being scooped, the alignment of end edges can be automatically conducted only with the movement of the ejection belt 52, and it will not be necessary to prepare a special alignment mechanism.

Next, another feature of the present embodiment is explained with reference to FIG. 25A and FIG. 25B.

The other feature is a configuration of accurately and effectively performing the binding processing in the sheet thickness direction. In FIG. 25A and FIG. 25B, the ejection pawl 52*a* is provided with a flexible member 100 capable of facing and coming in contact with the sheets. The flexible member 100 is a member having a low friction coefficient such as a polyester sheet and capable of obtaining elastic resilience, the base portion is mounted on the guide unit 52*a*4, and the leading edge thereof is protruding near the mounting face 52*a*1 so that the sheets can be maintained in a state of entering the introductory position.

With the flexible member 100, the length from the portion formed integrally with the guide unit 52*a*4 to the protruding leading edge on the mounting face 52*a*1 side can be set to the following conditions so that the amount of elastic deformation can be changed according to the number of sheets.

Figure 25A:
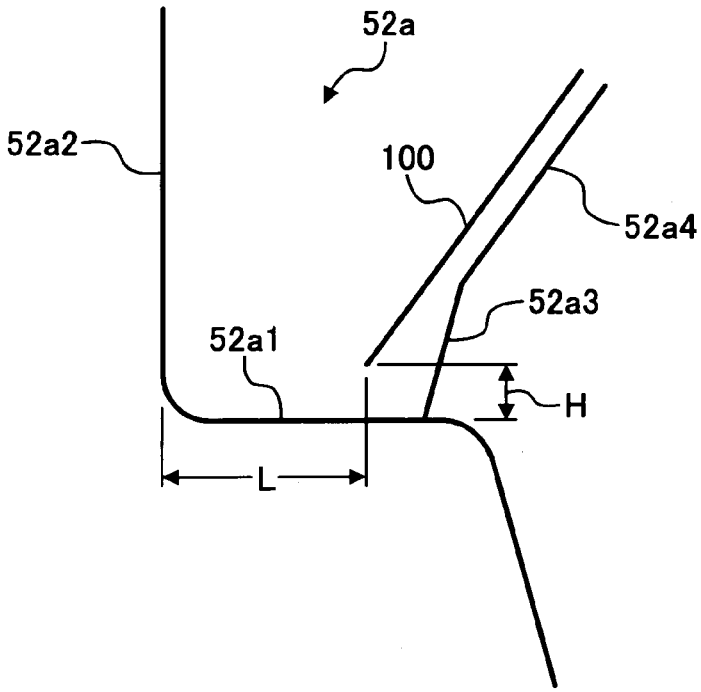
FIG. 25A and FIG. 25B are diagrams for explaining the configuration of another characterizing portion in the sheet transport mechanism illustrated in FIG. 23.
Figure 25B:
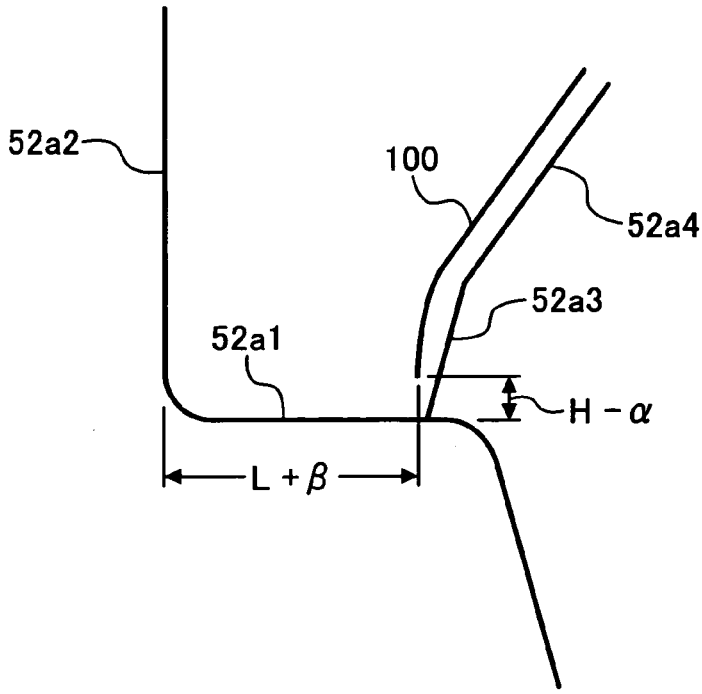

Normally, when a small number of sheets is to be used, as shown with reference numeral L in FIG. 25A, the dimension of the flexible member 100 should prevent the displacement of the sheet edge to the opposite face 52*a*3 side by coming in contact with the opposite sheet. In other words, when the number of sheets results in a thinner thickness than the dimension H1 of the mounting face 52*a*1, the flexible member 100 will come in contact with and press the sheets to prevent the disarrangement of the end edge thereof, and the gap between the leading edge and the mounting face 52*a*1 is set to a length of S0 so that the leading edge protrudes from the opposite face 52*a*3 at the mounting face 52*a*1 side.

Further, the length of the flexible member 100 described above also satisfies the following conditions.

When the sheets housed in the mounting face 52*a*1 is of a thickness that is close to the thickness (thickness shown with reference numeral L+β in FIG. 25B) of dimension H1 of the mounting face 52*a*1, the flexible member 100 will elastically deform, and the oscillating radius during such deformation is a dimension (state where a gap shown with reference numeral S0−α in FIG. 25B) that will not obstruct the introduction of sheets without the leading edge interfering with the mounting face 52*a*1. Thereby, the inserted sheets will slide across the surface of the flexible member 100 that is parallel with the guide unit 52*a*4 and the end edge thereof will be housed in the mounting face 52*a*1. Since the pressure can be applied to the sheets whether during elastic deformation or in the initial state regardless of the thickness thereof, the sheets housed in the mounting face 52*a*1 can be bundled on the stopper 52*a*2 side in the thickness direction, and the disarrangement of the sheet end edge can be prevented thereby.

According to the first embodiment, the following effects are yielded.

(1) The disarrangement of end edges can be eliminated by compulsorily bundling the sheets scooped with the transport means. In particular, by binding the sheets in a state where the thickness of sheets in the transport means is thinner than the thickness of sheets in the sheet housing unit, the disarrangement of end edges can be prevented and misalignment of end edges can be eliminated, and the occurrence of misaligned end edges during binding via saddle stitching or middle folding.

(2) Misaligned end edges can be reliably prevented by compulsorily bundling the sheets in the thickness direction with a simple configuration of merely prescribing the dimension in the thickness direction of the sheet mounting faces of the sheet housing unit and transport means.

(3) The wall surface facing the sheets in the transport means is constituted to be substantially parallel to the sheets, and such parallel wall surface will function as the holding unit of the sheets. Thus, it will be possible to prevent the sheets loaded on the mounting face of the transport means from collapsing carelessly, and the occurrence of misaligned end edges due to such collapse can also be prevented.

(4) Since the transport means is provided with guide unit opening outward from an opposite face at a wall surface facing the sheets via a bend portion continuous to the opposite face that is parallel to the sheets, the introduction of the scooped sheets can be conducted accurately, and the introduced sheets can be easily bundled by gathering the sheets at the opposite face. Misaligned end edges can be prevented thereby.

(5) With a simple configuration of merely measuring the mounting face of the sheets in the transport means, the mounting face of sheets in the sheet housing unit, and the leading edge of the guide unit, the introduction of sheets in the transport process of the transport means and the processing for eliminating misaligned end edges can be performed simultaneously.

(6) Since the transport means is provided with a flexible member capable of facing and coming in contact with the sheets, the sheets introduced to the transport means can be easily bundled with the elasticity of the flexible member.

(7) Since the flexible member is advancing toward the introductory position of the sheets, and in particular since the base end is integrally formed with a guide unit of the transport means, this may function as an extension from the guide unit. Thereby, it will be possible to assist the introduction of sheets, and to enable the easy bundling of sheets for eliminating misaligned end edges of the introduced sheets.

(8) Since the flexible member can be subject to elastic deformation according to the thickness of the sheets, and in particular since the oscillating radius upon such elastic deformation will not obstruct the introduction of the sheets, the introduced sheets can be easily bundled with the elastic resilience, and the occurrence of misaligned end edges can be prevented thereby.

(9) Since the sheets are scooped upon the transport means being mounted and connected to a part of the belt, misaligned end edges of the sheets can be corrected with existing configurations without having to add a special end edge bundling configuration.

(10) By preventing misaligned end edges during the binding process, it will be possible to prevent the inferior appearance of the end edges upon binding after the formation of images.

SECOND EMBODIMENT

The main purpose of the second embodiment is to achieve the second object of the present invention described above.

Incidentally, FIG. 3 to FIG. 22 referred to in the explanation of the first embodiment above as well as the explanation provided with reference to FIG. 3 to FIG. 22 are all substantially applicable to the second embodiment as well, and the redundant explanation thereof will be omitted. The following explanation is mainly directed to the features of the second embodiment.

Foremost, the fold line angle adjustment mechanism pertaining to the second embodiment is explained.

Figure 26B:
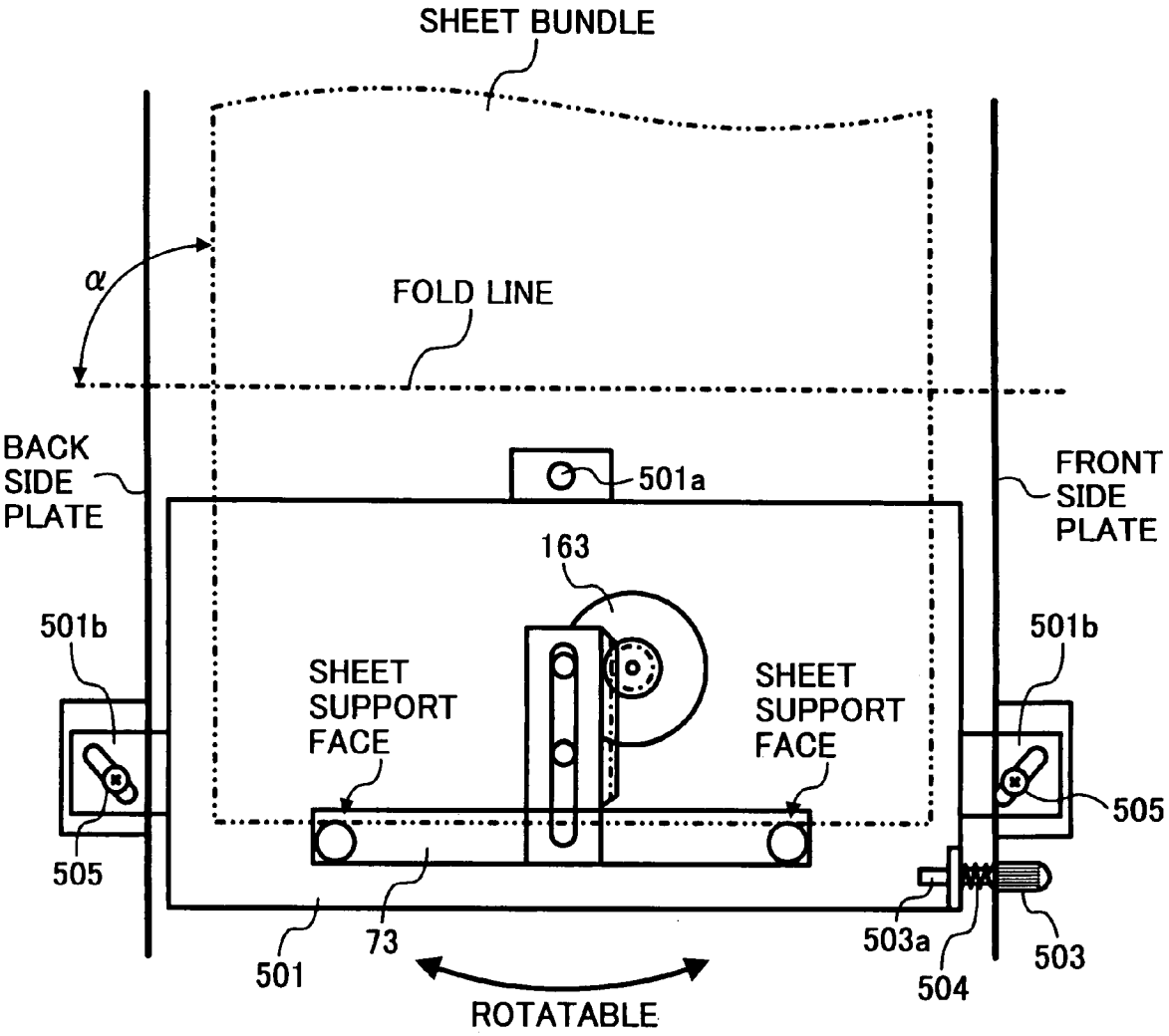
FIG. 26A and FIG. 26B are diagrams for explaining the configuration and operation of the first example of the angle adjustment mechanism of the middle folding processing tray pertaining to the second embodiment of the present invention.
Figure 26A:
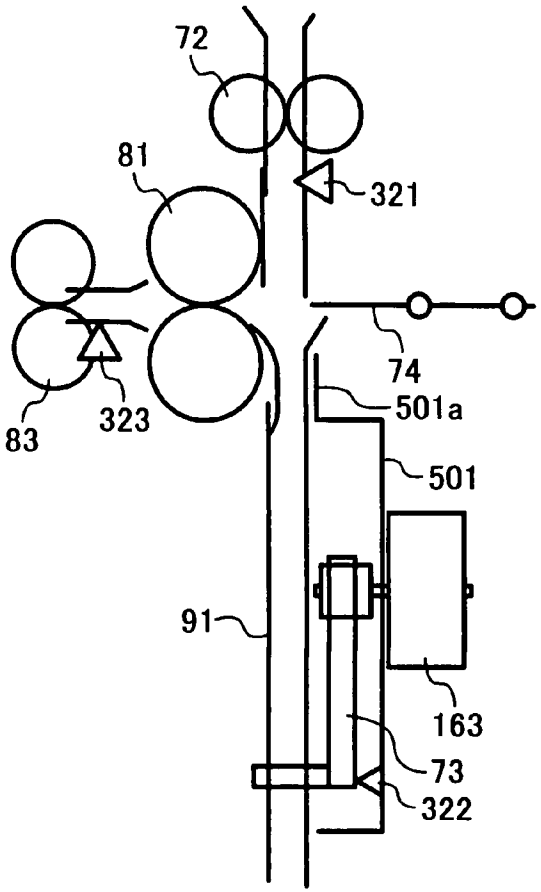

In the second embodiment, although the sheets are folded in the middle with the folding plate 74, there are cases where the fold line will be misaligned during the actual operation as described above. This occurs because sheets that are cut into standard sizes are not a perfect rectangle. Thus, in this embodiment, a fold line angle adjustment mechanism (hereinafter simply referred to as an adjustment mechanism) for adjusting the angle of the fold line of the sheet bundle is provided to deal with such a problem. FIG. 26A and FIG. 26B show the first example of this adjustment mechanism, and FIG. 26A is a front view seen from the front side of the sheet post-processing apparatus, and FIG. 26B is a side view of FIG. 26A.

As shown in FIG. 26A and FIG. 26B, a movable back end fence 73 having a support face for supporting and aligning the sheet bundle transported along the upper and lower bundle transport guides 92, 91 is provided so that it can rise and fall with the back end fence movement motor 163, and support the sheet bundle at two points. The movable back end fence 73 and the back end fence movement motor 163 are mounted on a base 501, and the base 501 is supported rotatably by the lower bundle transport guide 91 around a rotating support 501*a*. An adjustment screw 503 and compression spring 504 (right side of diagram) are provided to the lower end of the base. The adjustment screw 503 passes through the compression spring 504 from the outside of the front side plate and is connected to the base 501 with a screw portion 503*a*. The compression spring 504 constantly provides elastic force for rotating the base 501 toward the back plate side, and, by rotating the adjustment screw 503 rightward, it is able to draw in the base 501 with the screw portion 503*a* and rotate it toward the front plate side. Meanwhile, by rotating the adjustment screw 503 leftward, the screw will become loose, and the base 501 will rotate toward the back plate side due to the compression spring 504.

Thus, the base 501 is configured to adjust, with the adjustment screw 503, the fold line of the sheet bundle supported with the movable back end fence 73 and the end face in the transport direction of the sheet bundle; that is, the end face of the sheet bundle (sheet) supported at two points with the movable back end fence 73 so that the angle α formed thereby will be 0 degrees (parallel), and thereafter fixing these with a locking screw 505 to the front and back plates at a base fixation unit 501*b*. As necessary, a cam or the like may be used to facilitate the adjustment. Incidentally, the angle formed with the end face parallel to the sheet transport direction and the fold line may also be adjusted to become 90 degrees.

Figure 27B:
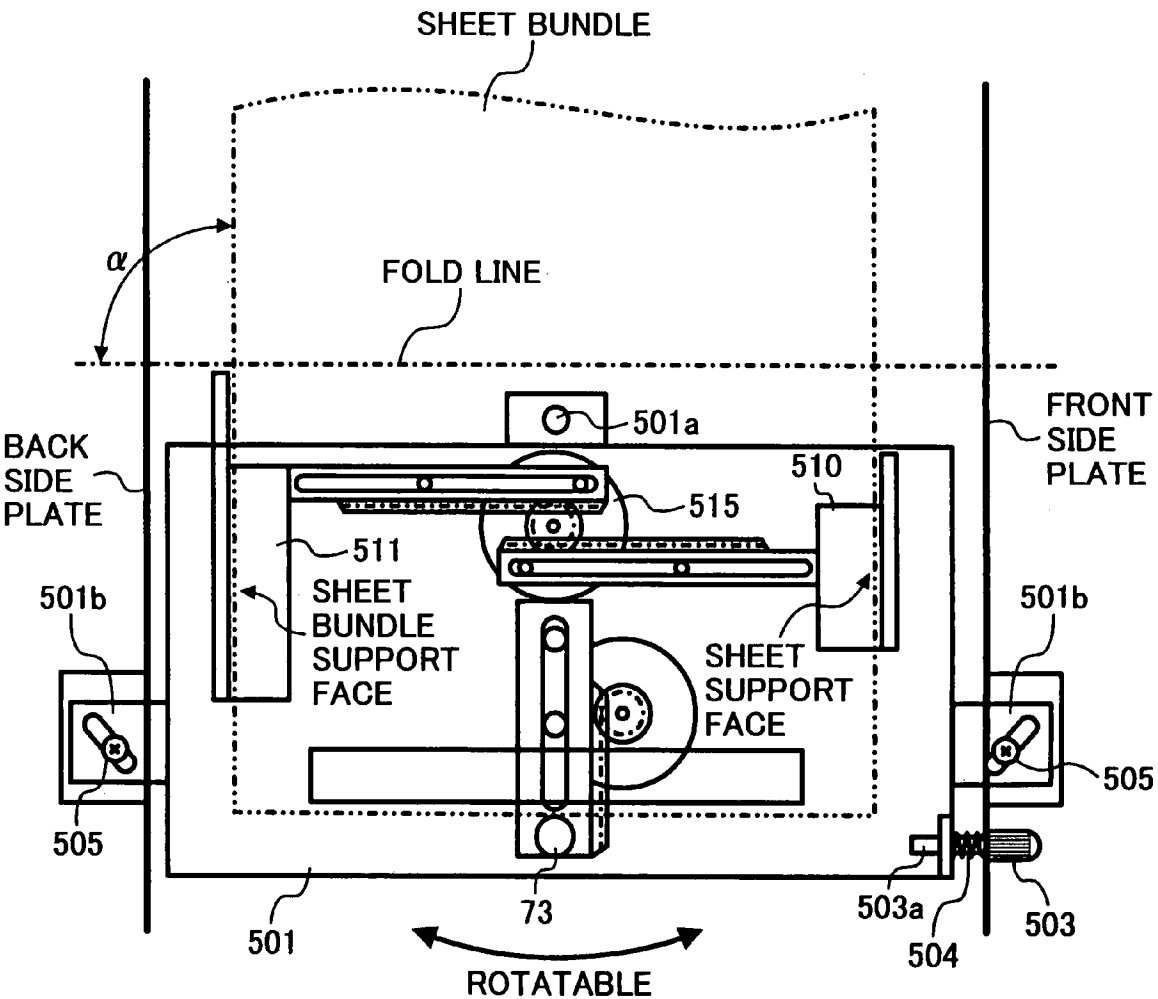
FIG. 27A and FIG. 27B are diagrams for explaining the configuration and operation of the second example of the angle adjustment mechanism of the foregoing middle folding processing tray.
Figure 27A:
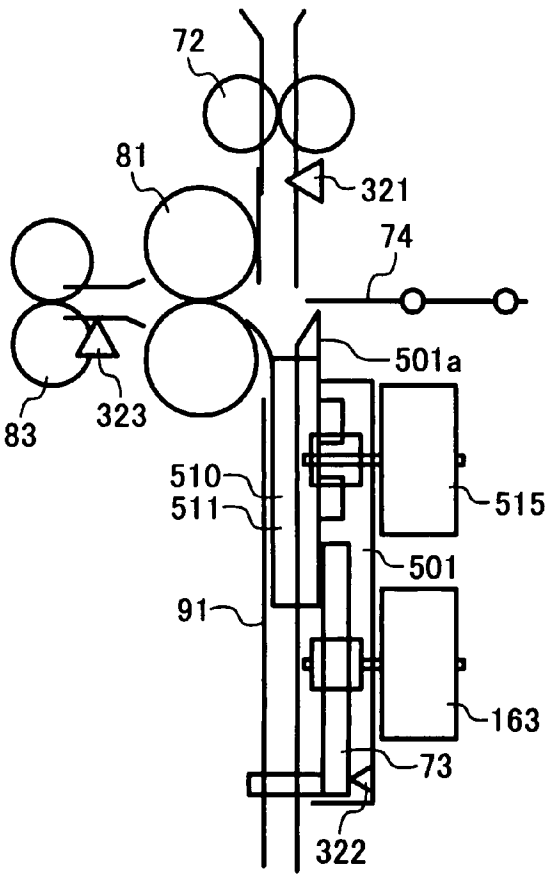

The second example of the adjustment mechanism is shown in FIG. 27A and FIG. 27B. FIG. 27A is a front view seen from the front side of the sheet post-processing apparatus, and FIG. 27B is a side view of FIG. 27A.

In this second example, side fences 510, 511 are provided to the adjustment operation in the direction parallel to the sheet transport direction of the sheet bundle of the first example. In the second example, a movable back end fence 73 having a support face for supporting the sheet bundle in a direction orthogonal to the transport direction, a back end fence movement motor 163 for driving this movable back end fence 73, a front side fence 510 and back side fence 511 having a retention face for retaining the sheet bundle in a direction (width direction) parallel to the transport direction, and a side fence movement motor 515 for driving both side fences 510, 511 are mounted on the base 501, and the base 501 is supported rotatably by the lower sheet transport guide 91 around the rotating support 501*a*. In this second example, the movable back end fence 73 supports the sheet bundle with one point, and both sides thereof are retained with the front and back side fences 510, 511. The other components are configured the same as with the first example.

In this second example, after adjusting the adjustment screw 503 so that the angle α formed with the end face parallel to the sheet transport direction of the sheet bundle and the fold line is adjusted to become 90 degrees, this is fixed with a locking screw 505 to the front and back plates at the base fixation unit 501*b*. In the case of this example, since the movable back end fence 73 is a one-point support, the angle is viewed with the side fences 510, 511.

Further, during the folding operation, after a predetermined time elapses from the folding plate 74 coming in contact with the sheet bundle supported by the side fences 510, 511 and the back end fence 73, the support operation of the sheet bundle with the side fences 510, 511 is stopped before coming in contact with the folding roller 81, and the sheet bundle is retreated a certain distance.

Incidentally, although the base 501 is rotated in the foregoing first and second examples, since the ultimate objective of the present embodiment is to adjust the angle α formed by the sheet bundle and fold line, and the position of the movable back end fence 73 and side fences 500, 501 may be adjusted independently in order to achieve an angle α of 0 degrees or 90 degrees. Further, although this angle adjustment is normally conducted by folding the sheets and viewing the folded state of the discharged sheets or sheet bundle, a scale is provided to the front plate 64*a* having the adjustment screw 503 so that the amount of adjustment of the adjustment screw 503 can be known, and users will be able to see the variation in the angle α of the sheets or sheet bundle in relation to the fold line based on the rotational amount of rotating the adjustment screw 503.

Figure 28:
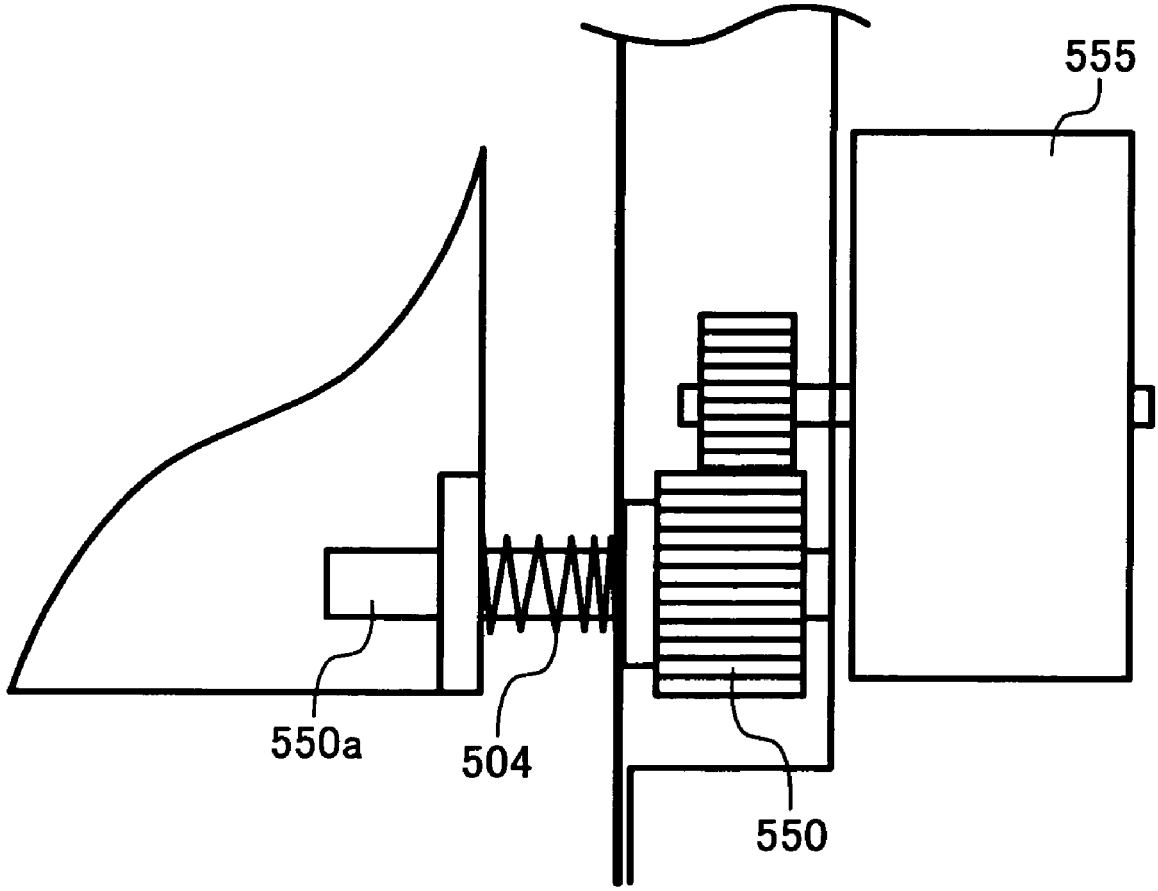
FIG. 28 is a diagram for explaining the configuration and operation of another example of the adjustment screw of the angle adjustment mechanism.

FIG. 28 shows the primary configuration of another example of the screw mechanism for adjusting the rotating position of the base 501 of the first and second examples. In this example, an adjustment gear 550 and an adjustment motor 555 are provided in substitute for the adjustment screw 503 illustrated in FIGS. 26A & 26B and FIG. 27A & FIG. 27B. This adjustment motor 555 is used to drive the adjustment gear 550, and the screw portion 550*a* provided coaxially (concentrically) to the adjustment gear 550 is rotated in order to adjust the angle as with the adjustment screw 503 described above. In other words, since the rotational amount of the screw and the rotating amount of the base 501 is roughly the same ratio, if a pulse motor is used for the adjustment motor 555, the rotating amount per pulse will be determined, and the adjustment of the angle α formed by the sheet bundle and fold line can be easily made with only the control of the motor. Further, since electrical control will be enabled, the adjustment operation can be easily made by operating an operation panel if the amount of adjustment can be input from a screen of an operation panel or the like.

Incidentally, since the length from the home position of the movable back end fence 73 to the fold line will change if the angle is adjusted, when the amount of adjustment is input for making such adjustment, the CPU 360 will operate the distance from the home position of the movable back end fence 73 to the fold line in order to adjust the angle, and simultaneously adjust the position (vertical direction) of the movable back end fence 73, and move the movable back end fence 73 so that the middle folding at the sheet center will be conducted accurately. Thereby, the misalignment of the fold line and misalignment of the middle folding position can be corrected accurately.

Figure 29A:
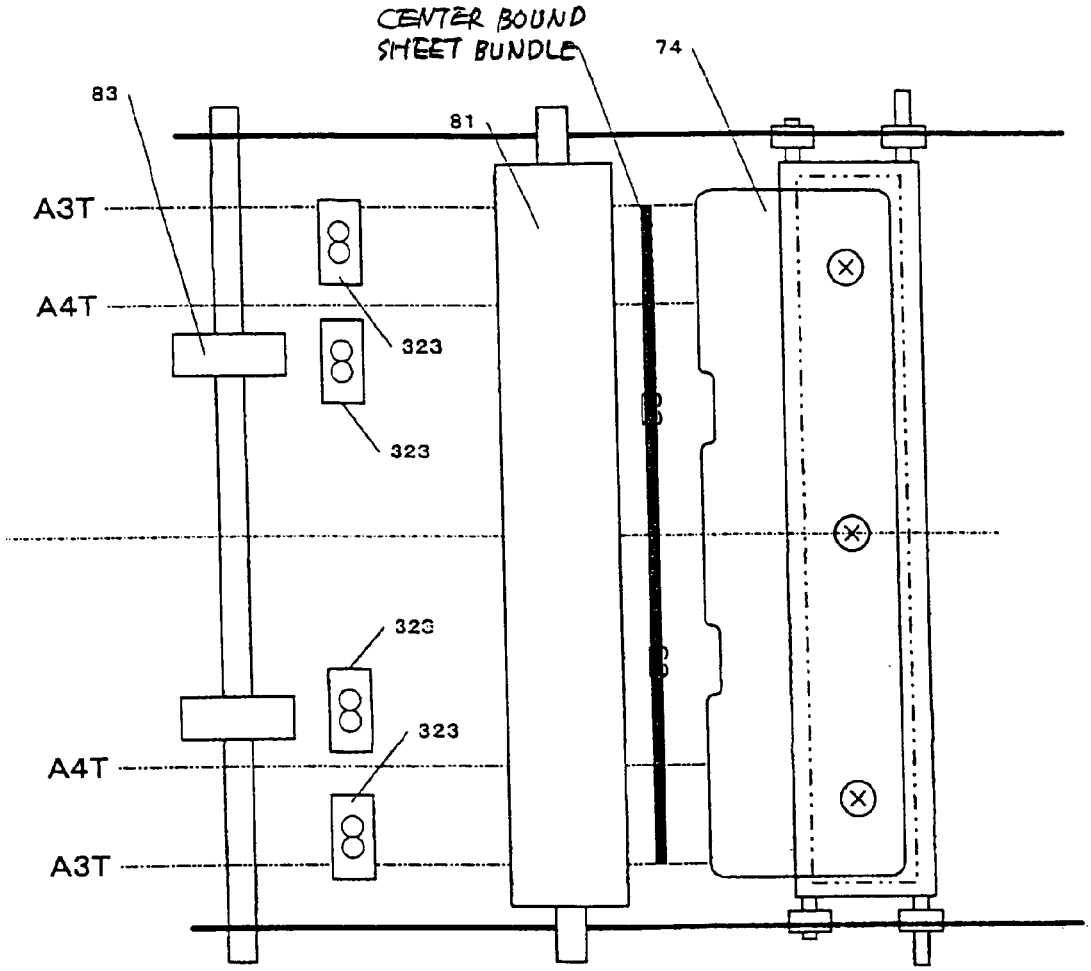
FIG. 29A and FIG. 29B are diagrams showing the configuration of the sheet folding inclination detection means for measuring the inclination of the back end of sheets in relation to the front end of sheets, and the automatic inclination adjustment means.
Figure 29B:
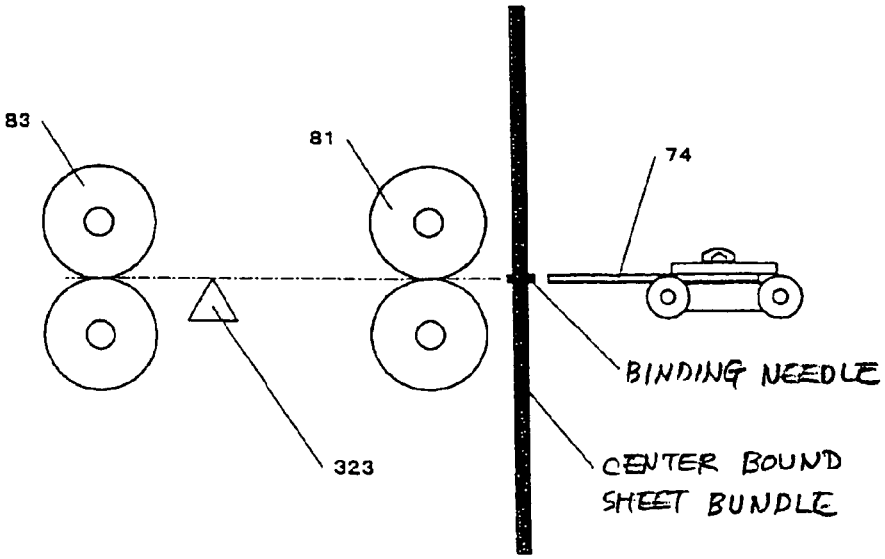

FIG. 29A and FIG. 29B are diagrams showing the configuration of the sheet folding inclination detection means for measuring the amount of inclination of the back end of sheets in relation to the front end of sheets, and the automatic inclination adjustment means, wherein FIG. 29A is a plan view new the folding roller, and FIG. 29B is a front view thereof. As shown in these diagrams, four light reflection sensors 323 as the detection means for detecting the inclination of the folded sheets are disposed in a direction orthogonal to the sheet transport direction on the downstream side in the sheet bundle transport direction of the folding roller 81, and these sensors measure the length of the sheet during the transport thereof in order to calculate the inclination of the back end in relation to the front end of the sheet bundle. The calculation is conducted with the CPU 350 described above, and if the inclination of the back end of sheets in relation to the front end of sheets can be calculated as described above, the information thereof can be displayed on a display means such as an operation panel or display panel not shown, and the user will thereby be able to recognize the amount of misalignment of the fold line without having to measure the folded sheet with the folding plate 74 and folding roller 81.

With the light reflecting sensor 323 in this embodiment, two are provided to both ends of the sheet size A3 portrait (A3T) and two are provided to both ends of the sheet size A4 portrait (A4T). As a result, in the least, the sheet sizes of A3 and A4 portrait can be dealt with accurately. Nevertheless, the quantity and positioning of the light reflecting sensors 323 may be set suitably according to the specification. Further, a pair of light reflecting sensors may be set movably in a direction orthogonal to the sheet transport direction according to the sheet size so as to stop and measure this at an optimum position. Further, a light transmission sensor may also be used in substitute for the light reflecting sensor.

In the example shown in FIG. 29A and FIG. 29B, when the screw mechanism for adjusting the rotating position of the base 501 illustrated in FIG. 28 is used, the inclination can be automatically corrected. In other words, by providing an adjustment gear 550 and an adjustment motor 555 in substitute for the adjustment screw 503 of the base 501, using this adjustment motor 555 to drive the adjustment gear 550, and rotating the screw portion 550*a* provided coaxially (concentrically) to the adjustment gear 550, the angle can be adjusted as with the foregoing adjustment screw 503. As described above, since the rotational amount of the screw and the rotating amount of the base 501 is roughly the same ratio, if a pulse motor is used for the adjustment motor 555, the rotating amount per pulse will be determined, and the adjustment of the angle α formed by the sheet bundle and fold line can be easily made with only the control of the motor. Therefore, by combining this with the sheet inclination detection means illustrated in FIG. 29A and FIG. 29B, the adjustment motor 555 can be driven such that the CPU 350 will automatically correct the amount of misalignment based on the misalignment of the fold line detected with the light reflecting sensor 323, and the adjustment of the angle α can be performed automatically with high precision without the user having to recognize the inclination or adjustment of the sheet.

According to the second embodiment, the misalignment of the fold line arising during actual use can be adjusted easily even by a user without special knowledge.

Various modifications will become possible for those skilled in the art after receiving the teachings of the present disclosure without departing from the scope thereof.

What is claimed is:

1. A sheet folding apparatus, comprising:

sheet transport means for transporting sheets or a sheet bundle along a sheet transport path;

a base configured to rotate;

support means that is movable in a transport direction of the sheets or sheet bundle, and for supporting said sheets or sheet bundle in said sheet transport path, the support means mounted on the base;

a folding plate configured to move forward or backward in a direction substantially perpendicular to said transport path;

a pair of folding rollers disposed in a forward direction of said folding plate, and for folding the sheets or sheet bundle pressed into a nip with said folding plate; and angle adjustment means for adjusting an angle of an end face of said sheets or sheet bundle relative to a fold line by adjusting a rotated position of the base.

2. The sheet folding apparatus as claimed in claim 1, further comprising:

measurement means for measuring an amount of inclination of a back end of the sheets in relation to a front end of the folded sheets.

3. The sheet folding apparatus as claimed in claim 2, wherein said measurement means is positioned at a downstream side of said folding roller and includes a sensor for detecting a position of the fold line.

4. The sheet folding apparatus as claimed in claim 2, further comprising:

display means for displaying the amount of inclination measured by said measurement means.

5. The sheet folding apparatus as claimed in claim 2, wherein said support means includes a support face for supporting an end that is perpendicular to the transport direction of said sheets or sheet bundle;

said angle adjustment means includes drive means for rotatively driving a screw of a screw mechanism for rotating said support face and control means for controlling said drive means; and said control means drives said drive means based on the amount of inclination measured by said measurement means and corrects the inclination of said support means.

6. The sheet folding apparatus as claimed in claim 2, wherein said support means includes a retention face for retaining an end parallel to the transport direction of said sheets or sheet bundle;

said angle adjustment means includes drive means for rotatively driving a screw of a screw mechanism for rotating said retention face and control means for controlling said drive means; and said control means drives said drive means based on the amount of inclination measured by said measurement means and corrects the inclination of said support means.

7. The sheet folding apparatus as claimed in claim 1, wherein said support means includes a support face for supporting an end that is perpendicular to the transport direction of said sheets or sheet bundle; and said angle adjustment means is a screw mechanism for rotating said support face.

8. The sheet folding apparatus as claimed in claim 7, further comprising:

drive means for rotating a screw portion of said screw mechanism.

9. The sheet folding apparatus as claimed in claim 8, further comprising:

control means for controlling the drive of said drive means.

10. The sheet folding apparatus as claimed in claim 9, wherein said control means comprises input means for inputting an amount of rotation of said screw portion.

11. The sheet folding apparatus as claimed in claim 10, wherein said control means drives said drive means based on said amount of rotation input by said input means and corrects an inclination of said support means.

12. The sheet folding apparatus as claimed in claim 1, wherein said support means includes a retention face for retaining an end that is parallel to the transport direction of said sheets or sheet bundle; and said angle adjustment means is a screw mechanism for rotating said retention face.

13. The sheet folding apparatus as claimed in claim 12, further comprising:

drive means for rotating a screw portion of said screw mechanism.

14. The sheet folding apparatus as claimed in claim 13, further comprising:

control means for controlling the drive of said drive means.

15. The sheet folding apparatus as claimed in claim 14, wherein said control means comprises input means for inputting an amount of rotation of said screw portion.

16. The sheet folding apparatus as claimed in claim 15, wherein said control means drives said drive means based on said amount of rotation input by said input means and corrects an inclination of said support means.

17. The sheet folding apparatus as claimed in claim 1, wherein the angle adjustment unit is a screw mechanism.

18. A sheet processing apparatus comprising a sheet folding apparatus, wherein said sheet folding apparatus comprises:

sheet transport means for transporting sheets or a sheet bundle along a sheet transport path;

a base configured to rotate;

support means that is movable in a transport direction of the sheets or sheet bundle, and for supporting said sheets or sheet bundle in said sheet transport path, the support means mounted on the base;

a folding plate configured to move forward or backward in a direction substantially perpendicular to said transport path;

a pair of folding rollers disposed in a forward direction of said folding plate, and for folding the sheets or sheet bundle pressed into a nip with said folding plate; and angle adjustment means for adjusting an angle of an end face of said sheets or sheet bundle relative to a fold line by adjusting a rotated position of the base.

19. An image forming apparatus comprising a sheet folding apparatus, wherein said sheet folding apparatus comprises:

sheet transport means for transporting sheets or a sheet bundle along a sheet transport path;

a base configured to rotate;

support means that is movable in a transport direction of the sheets or sheet bundle, and for supporting said sheets or sheet bundle in said sheet transport path, the support means mounted on the base;

a folding plate configured to move forward or backward in a direction substantially perpendicular to said transport path;

a pair of folding rollers disposed in a forward direction of said folding plate, and for folding the sheets or sheet bundle pressed into a nip with said folding plate; and angle adjustment means for adjusting an angle of an end face of said sheets or sheet bundle relative to a fold line by adjusting a rotated position of the base.

20. An image forming apparatus comprising a sheet processing apparatus integrally or separately, wherein said sheet processing apparatus has a sheet folding apparatus, said sheet folding apparatus comprising:

sheet transport means for transporting sheets or a sheet bundle along a sheet transport path;

a base configured to rotate;

support means that is movable in a transport direction of the sheets or sheet bundle, and for supporting said sheets or sheet bundle in said sheet transport path, the support means mounted on the base;

a folding plate configured to move forward or backward in a direction substantially perpendicular to said transport path;

a pair of folding rollers disposed in a forward direction of said folding plate, and for folding the sheets or sheet bundle pressed into a nip with said folding plate; and angle adjustment means for adjusting an angle of an end face of said sheets or sheet bundle relative to a fold line by adjusting a rotated position of the base.

21. A sheet folding apparatus, comprising:

a sheet transport unit configured to transport sheets or a sheet bundle along a sheet transport path;

a base configured to rotate;

a support unit configured to move in a transport direction of the sheets or sheet bundle, and to support said sheets or sheet bundle in said sheet transport path, the support unit mounted on the base;

a folding plate configured to move forward or backward in a direction substantially perpendicular to said transport path;

a pair of folding rollers disposed in a forward direction of said folding plate, and configured to fold the sheets or sheet bundle pressed into a nip with said folding plate; and an angle adjustment unit configured to adjust an angle of an end face of said sheets or sheet bundle relative to a fold line by adjusting a rotated position of the base.

* * * * *